US011234526B1

(12) United States Patent
Levin

(10) Patent No.: US 11,234,526 B1
(45) Date of Patent: Feb. 1, 2022

(54) CHAIR CONFIGURED FOR PROGRESSIVE RECLINATION AND CONVERSION BETWEEN MULTIPLE USE AND/OR STORAGE POSITIONS, AND A METHOD OF USE THEREOF

(71) Applicant: Eric Martin Levin, Sevema Park, MD (US)

(72) Inventor: Eric Martin Levin, Sevema Park, MD (US)

( * ) Notice: Subject to any disclaimer, the term of this patent is extended or adjusted under 35 U.S.C. 154(b) by 0 days.

(21) Appl. No.: 16/884,693

(22) Filed: May 27, 2020

(51) Int. Cl.

| | |
|---|---|
| ***A47C 4/02*** | (2006.01) |
| ***A47C 4/52*** | (2006.01) |
| ***A47C 1/024*** | (2006.01) |
| ***A47C 7/50*** | (2006.01) |
| ***A47C 7/54*** | (2006.01) |
| ***A47C 7/42*** | (2006.01) |
| ***A47C 7/52*** | (2006.01) |
| ***A47C 7/40*** | (2006.01) |

(52) U.S. Cl.
CPC ..... *A47C 4/52* (2013.01); *A47C 1/024* (2013.01); *A47C 4/02* (2013.01); *A47C 4/028* (2013.01); *A47C 7/407* (2013.01); *A47C 7/42* (2013.01); *A47C 7/5062* (2018.08); *A47C 7/5066* (2018.08); *A47C 7/52* (2013.01); *A47C 7/541* (2018.08); *A47C 7/546* (2013.01)

(58) Field of Classification Search
CPC ..... A47C 4/02; A47C 4/52; A47C 7/5066; A47C 7/407; A47C 7/546; A47C 7/42; A47C 7/52
USPC ..... 297/16.2, 17, 34, 423.26, 423.28, 423.3, 297/440.21, 440.1, 440.16, 452.21, 297/452.22
See application file for complete search history.

(56) References Cited

U.S. PATENT DOCUMENTS

| | | | | |
|---|---|---|---|---|
| D121,266 | S | 7/1940 | Archer | |
| 2,232,175 | A * | 2/1941 | Goldstein | A47C 7/5066 297/111 |
| D135,333 | S | 3/1943 | Brown | |
| 2,615,500 | A * | 10/1952 | Thomas | A47C 4/52 297/54 |
| 2,701,009 | A * | 2/1955 | Richard | A47C 7/42 297/440.16 |
| 2,703,135 | A * | 3/1955 | Leatherman | A47C 4/03 297/239 |
| 2,792,053 | A | 5/1957 | Kursman | |
| 2,849,054 | A * | 8/1958 | Shepherdson | A47C 4/52 297/17 |
| 2,966,204 | A * | 12/1960 | Caravias | A47C 4/44 297/17 |
| 3,215,468 | A | 11/1965 | Swenson | |

(Continued)

*Primary Examiner* — Robert Canfield
(74) *Attorney, Agent, or Firm* — Garcia-Zamor Intellectual Property Law, LLC; Ruy Garcia-Zamor

(57) ABSTRACT

A chair preferably configured for conversion between a preferred storage configuration and at least one preferred use configuration. When in one of the use configurations, the chair may have a recliner mechanism which allows the angle of the back support assembly relative to the seat frame to be progressively changed such that the back support assembly may be positioned at a reclined angular position. When in the preferred storage configuration, the back support assembly may be positioned at least partially within the seat frame to decrease the area of the footprint of the chair to facilitate storage of the chair.

18 Claims, 30 Drawing Sheets

(56) References Cited

U.S. PATENT DOCUMENTS

| | | | | | |
|---|---|---|---|---|---|
| 3,347,572 | A | | 10/1967 | Pfaff, Jr. | |
| 3,556,594 | A | * | 1/1971 | Anderson | A47C 4/028 297/452.59 |
| 3,741,595 | A | | 6/1973 | Horgan, Jr. | |
| D227,833 | S | | 7/1973 | Olson | |
| 3,765,718 | A | * | 10/1973 | Chen | A47C 4/52 297/17 |
| D274,581 | S | | 6/1984 | Gallock | |
| 4,463,632 | A | | 8/1984 | Parke | |
| 4,926,783 | A | | 5/1990 | Lathers | |
| D312,004 | S | | 11/1990 | Smith | |
| 5,020,854 | A | | 6/1991 | Powell | |
| 5,052,076 | A | | 10/1991 | Spaeth | |
| 5,058,949 | A | | 10/1991 | Von Hoffman | |
| 5,171,063 | A | | 12/1992 | Stidd | |
| 5,301,570 | A | | 4/1994 | Li | |
| D377,574 | S | | 1/1997 | Mades | |
| 5,688,023 | A | | 11/1997 | Blocker, Jr. | |
| 5,688,024 | A | | 11/1997 | Arizpe-Gilmore | |
| 5,697,318 | A | | 12/1997 | Kobayashi | |
| 5,904,398 | A | | 5/1999 | Farricielli | |
| D411,381 | S | | 6/1999 | Greaves | |
| 6,135,476 | A | | 10/2000 | Dickie | |
| 6,283,059 | B1 | | 9/2001 | Scully, Jr. | |
| 6,321,912 | B1 | | 11/2001 | Lippert | |
| 6,322,145 | B1 | | 11/2001 | Melgarejo | |
| 6,513,876 | B1 | | 2/2003 | Agler | |
| 6,527,341 | B1 | | 3/2003 | Martin | |
| 6,880,482 | B2 | | 4/2005 | Huse | |
| 6,969,112 | B1 | * | 11/2005 | Sherrill | A47C 4/20 297/16.1 |
| 6,981,741 | B2 | | 1/2006 | Sirjoo | |
| 6,983,992 | B2 | | 1/2006 | Oomori | |
| 7,066,548 | B2 | | 6/2006 | Butler | |
| 7,107,927 | B2 | | 9/2006 | Hopper | |
| 7,125,079 | B1 | | 10/2006 | Lee | |
| 7,137,351 | B2 | | 11/2006 | Picou | |
| 7,213,692 | B2 | | 5/2007 | Wang | |
| D569,118 | S | | 5/2008 | Lin | |
| 7,367,616 | B2 | | 5/2008 | Summerford | |
| D673,786 | S | | 1/2013 | Szymaski | |
| D675,837 | S | | 2/2013 | Szymaski | |
| D675,838 | S | | 2/2013 | Szymaski | |
| D676,681 | S | | 2/2013 | Szymaski | |
| 8,960,799 | B2 | | 2/2015 | Yoon | |
| D727,046 | S | | 4/2015 | Alexander | |
| D727,047 | S | | 4/2015 | Alexander | |
| 9,021,975 | B1 | | 5/2015 | Fodor | |
| 9,138,059 | B2 | | 9/2015 | Kwok | |
| D740,579 | S | | 10/2015 | Begin | |
| 9,955,790 | B2 | | 5/2018 | Tang | |
| 10,040,378 | B2 | | 8/2018 | Hansen | |
| 10,065,711 | B2 | | 9/2018 | Fuller, IV | |
| 10,182,953 | B2 | | 1/2019 | Tsuber | |
| 10,980,347 | B1 | * | 4/2021 | Levin | A47C 4/02 |
| 2004/0184895 | A1 | | 9/2004 | Liao | |
| 2005/0179288 | A1 | | 8/2005 | Lizaso | |
| 2006/0033375 | A1 | | 2/2006 | Wu | |
| 2006/0202536 | A1 | | 9/2006 | Luchetti | |
| 2008/0035047 | A1 | | 2/2008 | McDonough | |
| 2009/0146477 | A1 | | 6/2009 | Yamada | |
| 2010/0037814 | A1 | | 2/2010 | Sahr | |
| 2010/0102613 | A1 | | 4/2010 | Labuwy | |
| 2012/0155949 | A1 | | 6/2012 | Chang | |
| 2013/0093232 | A1 | | 4/2013 | Lin | |
| 2015/0097405 | A1 | | 4/2015 | Schukalski | |
| 2015/0274263 | A1 | | 10/2015 | Nutz | |
| 2015/0313365 | A1 | | 11/2015 | Thomas | |
| 2016/0262543 | A1 | | 9/2016 | Currie | |

* cited by examiner

CHAIR CONFIGURED FOR PROGRESSIVE RECLINATION AND CONVERSION BETWEEN MULTIPLE USE AND/OR STORAGE POSITIONS, AND A METHOD OF USE THEREOF

BACKGROUND

The present invention is generally directed to furniture and, more specifically, to portable and storable furniture. More specifically still, the invention is directed toward chairs which may be convertible between a configuration designed to facilitate storage of the chair and one or more preferred configurations for use of the chair. The invention is further directed toward furniture and chair configured to be reclined.

Portable chairs are generally designed to maintain a single shape. Collapsible chairs may reduce certain aspects of the size of the chair, but still remain unwieldy and cumbersome, difficult to store, and/or may be more exposed to damage.

Chairs which are configured for reclining generally include mechanical aspects which decrease the portability and practicality of these chairs. For example, gears and springs may increase the weight and cost of chairs, and handles may increase elements of chairs which sick out at angles and may get caught on other objects.

Using chairs outside of their intended uses, such as trying to use non-portable chairs in portable settings or reclining or leaning back in chairs not configured to be reclined, may result in several deficiencies. Injuries or damage to the chair or other objects may occur when moving and using non-portable chairs on surfaces not configured to receive such chairs. Trying to find convertible use positions in chairs not configured to recline, such as leaning the entire chair backwards or onto its rear legs only, can lead to injuries to users or damage to the chair by placing pressure on elements not configured to receive pressure and changing the center of gravity to unintended locations on the chair.

It may be advantageous to provide a chair that is at least one of: easily portable; may be converted between multiple storage and/or use configurations; may include a back support structure that is configured to recline; may form a compact and easily storable storage configuration; and/or that is efficient to manufacture.

SUMMARY

Briefly speaking, one aspect of the present invention is directed to a chair that is configured to recline. The chair includes a seat frame with a rear panel, a back support assembly, and a threaded rod extending through both the rear panel of the seat frame and the back support assembly. The position of the back support assembly along the longitudinal rod axis of the threaded rod is fixed while the position of the rear panel along the longitudinal rod axis of the threaded rod is changed when the threaded rod is rotated about the longitudinal rod axis. The back support assembly is pivotally connected to the rear panel such that adjusting the position of the rear panel along the longitudinal rod axis changes the angle of the back support assembly relative to the seat frame.

In some aspects, the seat frame includes a reinforcement plate disposed on an inner surface of the rear panel of the seat frame. The rear panel may have a central face and lateral ends, with the central face being spaced from the lateral ends by oblique walls. The oblique walls, when viewed in cross section and planar parallel to a cushion support surface defined by the seat frame, may form an angle of between approximately 30-degrees and approximately 60-degrees relative to the lateral ends. More specifically, the oblique walls may form an angle of approximately 45-degrees relative to the lateral ends. The oblique walls provide resistance against deformation of the seat frame caused by a torque resulting from pressure on the back support assembly.

In some aspects, the reinforcement plate includes a first mounting boss and a second mounting boss, each of which extend through the rear panel on the central face proximate to one of the oblique walls. The first mounting boss and the second mounting boss are each configured to pivotally connect to the back support assembly via a first post receptacle and a second post receptacle which define a first rotation axis. The first post receptacle and the second post receptacle are each configured to receive a post and are connected by a cross-beam. The cross-beam is scalloped in a complementary fashion so as to nest within a recess in an outer surface of the rear panel that is created by the oblique walls. The cross-beam defines a downward extension, or guard, with a beveled edge which is centrally positioned to prevent contact between the knob and the rear panel. The cross-beam defines a first elongated cut-out and the rear panel and the reinforcement panel combine to define a second elongated cut-out, the elongated cut-outs being configured to roughly align with one another. This allows the threaded rod to pass through both elongated cut-outs simultaneously. The threaded rod has first and second axial ends. When the threaded rod is positioned through the first elongated cut-out and through the second elongated cut-out, the second axial end is located within the seat frame and the first axial end is located on a side of the cross-beam opposite from the seat frame. The second axial end is connected to a knob. The threaded rod also passes through a rotation guide disposed on the reinforcement plate and configured to rotate along a second rotation axis that is parallel to the first rotation axis. The rotation guide has a cam surface configured to support smooth angular adjustments of the threaded rod relative to the reinforcement plate. The rotation guide is configured such that when the threaded rod is at a predetermined angle relative to the rear panel, the rotation guide abuts the reinforcement panel to prevent further rotation of the back support assembly away from the seat frame.

In some aspects, when the back support assembly is in its fully upright position, the threaded rod is preferably held parallel to the cushion support surface such that a threaded rod angle in relation to the cushion support surface is zero degrees. The threaded rod angle increases as the back support assembly is reclined, with the threaded rod being held at an angle between 20-degrees and 80-degrees when the back support assembly is fully reclined.

In a separate aspect, the present invention is directed to a chair having a seat frame defining a bottom cavity and having a rear panel, and a back support assembly comprising a back rest frame and a back rest cushion. The back support assembly is separately detachably positionable in each of the following two locations: (1) at least partially within the bottom cavity of the seat frame; and (2) outside of the seat frame with the back support assembly connected to the seat frame. This allows the chair to be moveable between a first, storage configuration and a second, use configuration. When the chair is in the first, storage configuration, the back support assembly is at positioned least partially within the bottom cavity such that the chair can be stored on a support surface with the rear panel facing the support surface, When the chair is in the second, use configuration, the back support assembly is configured to be outside of the cavity and connected to the seat frame to support a person sitting on the seat frame. The seat frame further includes a first side panel and a second side panel. When the chair is in the first, storage configuration, the chair occupies a generally rectilinear volume defined on four sides by the rear panel, the front panel, the first side panel, the second side panel, and on the two major sides by two major surfaces generally defined by the seat cushion and the back rest cushion. The chair defines a first footprint when the chair is in the first, storage configuration and positioned on the support surface, and the chair defines a second footprint when the chair is the second, use configuration and is positioned on the support surface. In some aspects, the second footprint is at least five times greater than the second footprint. In other aspects, the second footprint is at least six times greater than the second footprint.

In some aspects, the seat frame may include a front panel and a cushion support surface which defines an upper well which opens in an opposite direction from the bottom cavity. The chair may include a foot support frame that is pivotally connected to the seat frame for movement between a first, foot support storage position, in which the foot support frame is located within the upper well, and a second, foot support use position, in which the foot support frame extends from the seat frame past the front panel and is configured for use. The chair also includes a seat cushion that is detachably positionable on the cushion support surface and covers the foot support frame and the upper well when the foot support frame is located in the upper well and the seat cushion is located on the cushion support surface. The seat cushion is held at angle relative to the supporting surface when the chair is in the second, use configuration.

In some aspects, the chair includes a first front leg, a second front leg, a first rear leg, and a second rear leg that are each separately detachably positionable in each of the following two locations: (1) within the bottom cavity of the seat frame; and (2) outside of the seat frame and attached thereto and configured to support the seat frame on the support surface. The first front leg, the second front leg, the first rear leg, and the second rear leg are stored within the bottom cavity while the chair is in the first storage configuration, and the first front leg, the second front leg, the first rear leg, and the second rear leg are connected to the seat frame while the chair is in the second, use configuration. The first front leg and second front leg are generally straight while the first rear leg and the second rear leg extend in a curvilinear fashion such that each extends through the rear panel to connect to a first rear leg receptacle and a second rear leg receptacle, respectively. This keeps the cushion support surface and the seat cushion at an angle relative to relative to the supporting surface when the chair is in the second, use configuration. In some aspects, the first rear leg receptacle and the second rear leg receptacle each include a key element to prevent rotation of the first rear leg and the second rear leg therein, respectively.

In some aspects, the chair includes a first arm rest and a second arm rest. The first and second arm rests are each separately detachably positionable in each of the following two locations: (1) within the bottom cavity of the seat frame; and (2) outside of the seat frame and attached to the seat frame. The first arm rest and the second arm rest are stored within the bottom cavity when the chair is in the first, storage configuration, and are connected to the back support assembly when the chair is in the second, use configuration. The first arm rest and the second arm rest are each configured to mount to the back support assembly via a pivoting bracket, allowing for angular adjustment thereof. In some aspects, the first arm rest and the second arm rest are each extendable, allowing a user to vary an arm rest length thereof.

In some aspects, the chair has a foot support frame with a foot support beam and a foot rest, connected to the front panel. The foot support frame is configured to allow the foot support frame to be extendable to vary a distance of the foot rest from the seat frame. The foot support frame is connected to the seat frame by two hinged connections positioned in a portion of the upper well defined by the seat frame and positioned adjacent to the front panel. The seat frame is formed of two layers including a chair pan formed of metallic material and a polymer layer. Each of the hinged connections include a channel layer formed by a portion of the seat pan, a hinge insert adjacently abutting thereon, the hinge insert configured to receive a portion of the foot support frame therein, and a hinge extending through the portion of the foot support frame. The hinge insert and the portion of the seat pan form a pivotal connection to facilitate rotation of the foot support assembly.

In some aspects, the back rest cushion is formed of a head rest cushion and a cushion bar. The the back support assembly is adjustable to vary a head support distance between the head rest cushion and the seat frame. The back support assembly is also adjustable to vary a cushion bar distance between the head rest cushion and the cushion bar.

In a separate aspect, the present invention is directed to a chair that is configured to recline via a dial such that the chair is incrementally/universally adjustable between its maximum rotation endpoints.

In a separate aspect, the present invention is directed to a chair that is configured to recline via a dial and to be compactable to provide easy storage with pads configured such that minimum scratches and damage to boats and boat compartments occurs during storage and/or during operation of the boat while the chair is in storage.

In a separate aspect, the present invention is directed to a chair that is configured to be compactable to provide easy storage with pads configured such that minimum scratches and damage to boats and boat compartments occurs during storage and/or during operation of the boat while the chair is in storage.

In a separate aspect, the present invention is directed to a chair that is configured to be positioned for use as any one of a: boat chair; stadium seat; deck chair; and recliner. That is the single chair can be used as any one of the above.

In a separate aspect, the present invention is directed to a chair that is configured to be positioned for use as any one of a: boat chair; stadium seat; deck chair; and recliner. That is the single chair can be used as any one of the above. Additionally, the chair can be compacted to form a briefcase shaped object that minimizes its volume and facilitates storage.

In a separate aspect, the present invention is directed to a chair that is configured to be compacted to form a briefcase shaped object that minimizes its volume and facilitates storage when not in use.

In a separate aspect, the present invention is directed to a chair that is structured of robust materials and with design configurations such that the chair is readily usable on boats, proximate bodies of water, and on land.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENT

Figure 1:
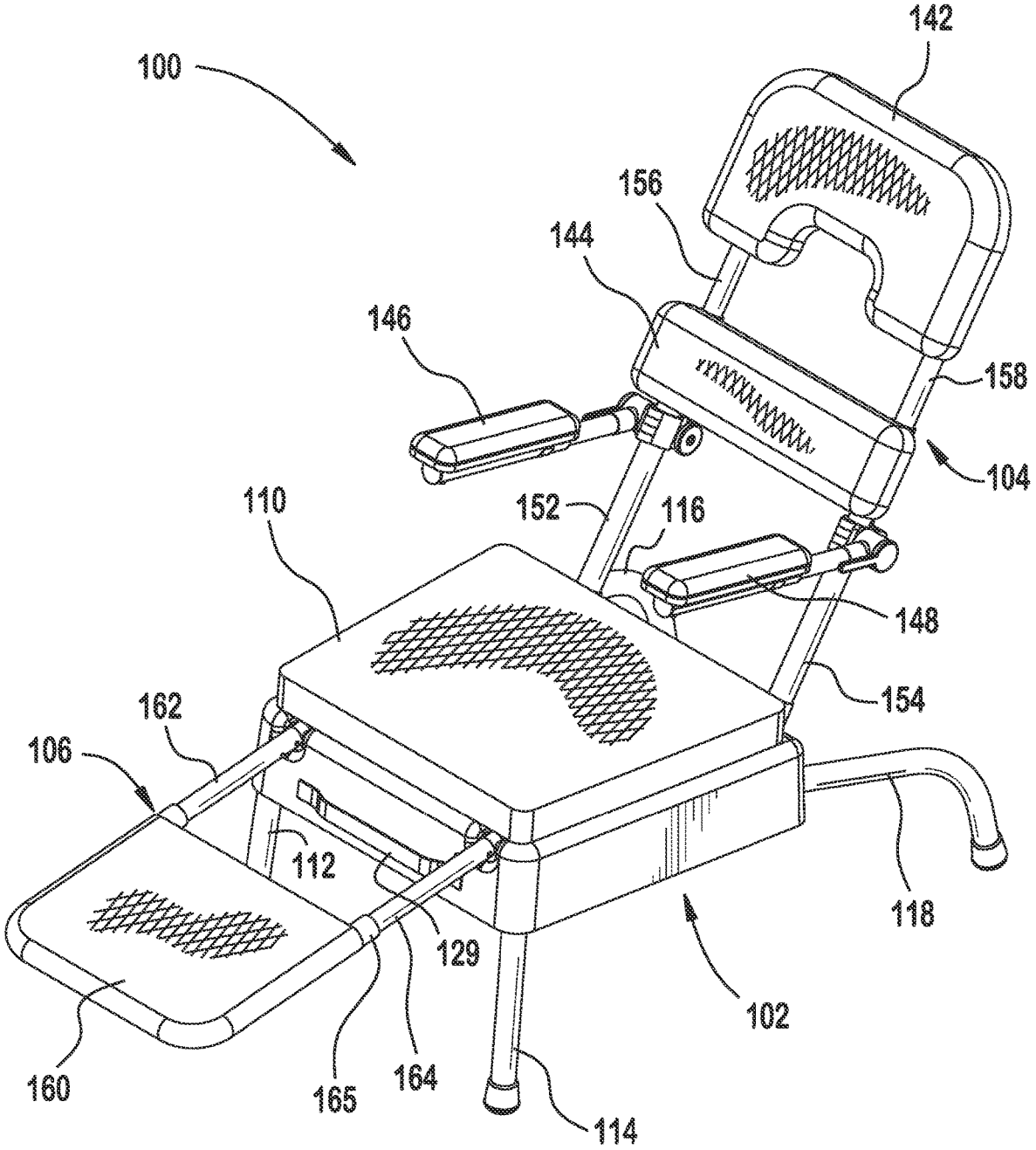
FIG. 1 is a front perspective view of the chair 100 of a preferred embodiment, wherein the chair 100 is in the second, use configuration. The back support assembly 104 is reclined in relation to the seat frame 102, and the foot support frame 106 is in the second, foot support use position and fully extended. The figure shows that the first front leg 112 and second front leg 114 are preferably straight and held more vertically than the first rear leg 116 and second rear leg 118. The first and second rear legs 116, 118 are preferably curved and sit lower to the support surface 190. This holds the seat frame 102 at an angle relative to the support surface 190 and places the center of gravity lower to keep the chair 100 from tipping over backwards when the back support assembly 104 is reclined. The seat cushion 110, positioned on the cushion support surface 108 of the seat frame 102, may also be held at an angle relative to the support surface 190. The first front leg 112, second front leg 114, first rear leg 116, and second rear leg 118 may all have caps 111, plastic or rubber footers, on their respective ends opposite the seat frame 102. The caps 111 preferably cover the lower ends of said the legs 112, 114, 116, 118 to keep the legs 112, 114, 116, 118 from directly contacting the support surface 190 (as the ends might damage the support surface 190) and might prevent the chair 100 from sliding on the support surface 190.
Figure 2:
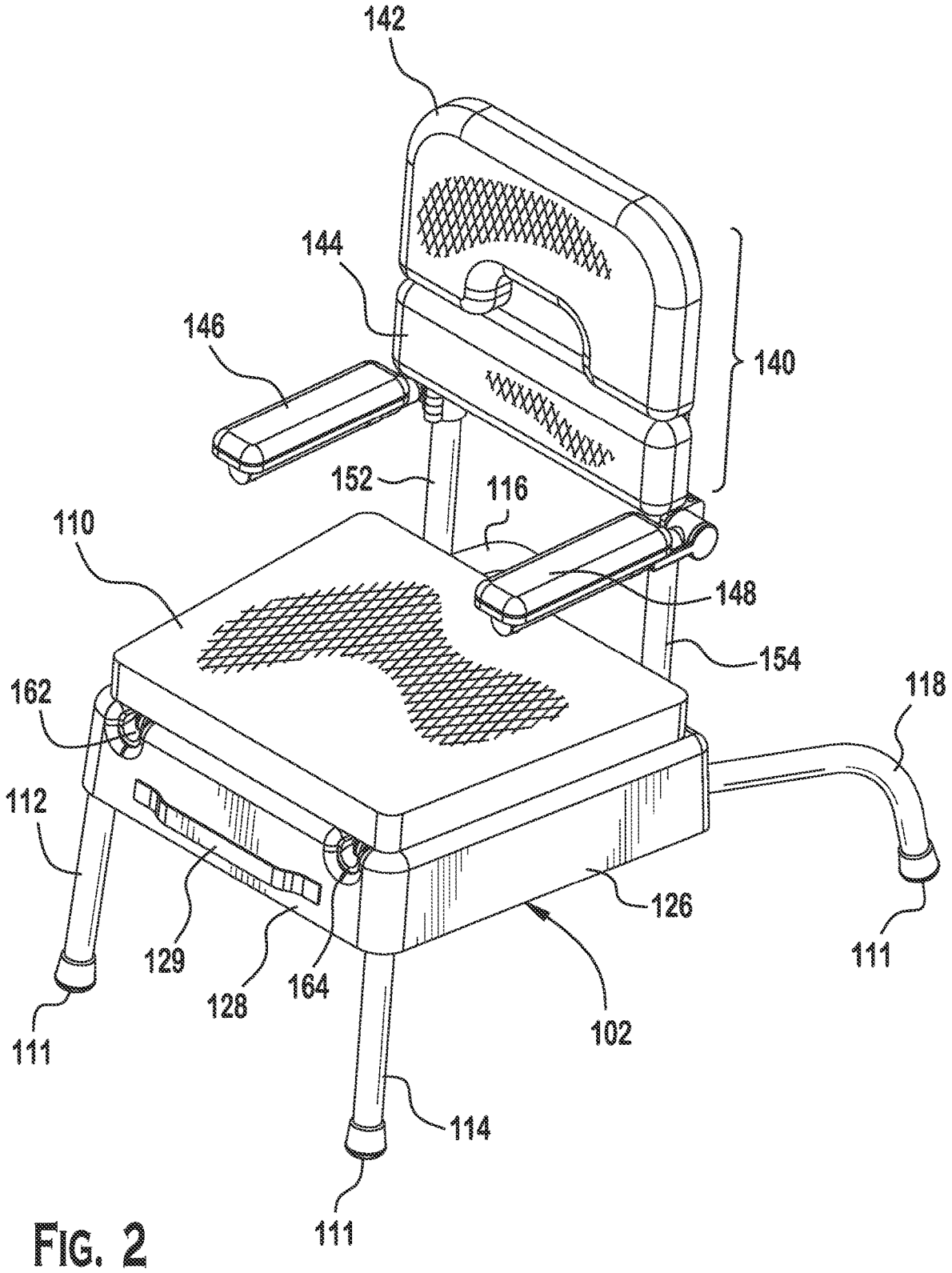
FIG. 2 is a front perspective view of the chair 110 of the first embodiment with the back support assembly 104 in its fully upright position. In this position the back support assembly 104 is preferably held between 90- and 100-degrees relative to the cushion support surface 108 of the seat support frame 102. The figure further shows that the back support assembly may include first and second posts 152, 154 attached to the seat support frame 102 on one axial end and a back rest cushion 140 on the opposite axial end. In some preferred embodiments, the back rest cushion 140 may be formed of separate cushions, preferably a head rest cushion 142 positioned at the top of the back support assembly 104, and a cushion bar 144 positioned below the head rest cushion 142. The distance between the head rest cushion 142 and cushion bar 144 may be adjustable. In some preferred embodiments, a first top post 156 and second top post 158 may be positioned between the head rest cushion 142 and cushion bar 144. A first arm rest 146 and a second arm rest 148 may be connected to the first post 152 or first top post 156 and second past 154 or second top post 158, respectively, by first and second pivoting brackets 147, 149. Some or all of the first post 152, second post 154, first top post 156, and second top post 158 may combine to form the back rest frame 150.
Figure 3:
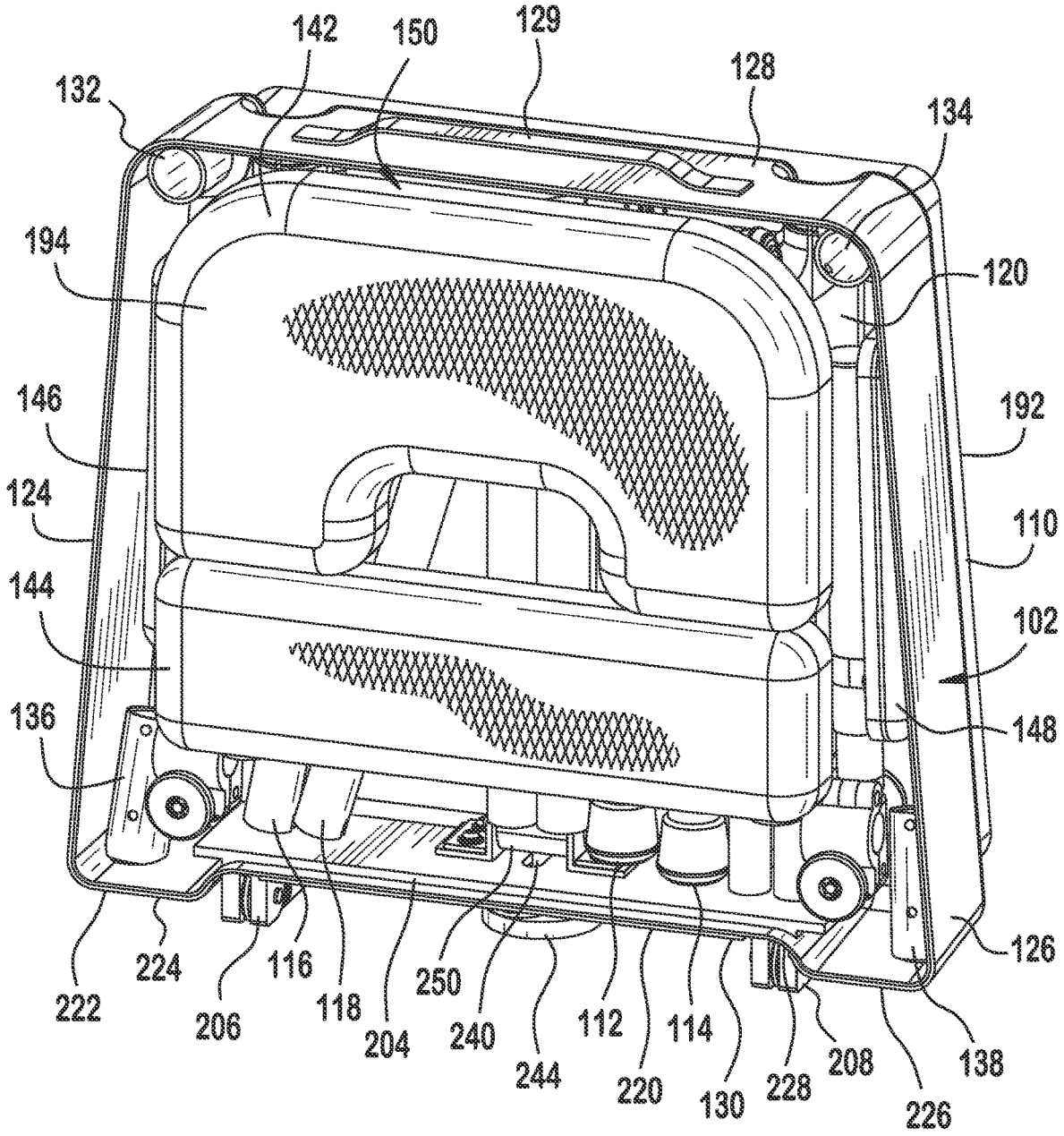
FIG. 3 is a rear perspective view of the chair 100 of a preferred embodiment wherein the chair 100 is in the first, storage configuration. The figure shows that the seat frame 102 is roughly rectilinear in shape, in that it has four sides—a front panel 128, a first side panel 124, a second side panel 126, and a rear panel 130. These form a roughly rectangular shape, although the rear panel 130 is preferably wider than the front panel 128 and thus the first and second side panels 124, 126 are angled rather than parallel to one another. The corners of the seat frame 102 are preferably rounded, to increase the comfort of users and the storability of the chair 100. The front panel 128, first side panel 124, second side panel 126, and rear panel 130 all meet the cushion support structure 108 on one side, and open on the other to define a bottom cavity 120. The entire back rest frame 150 may be stored in the bottom cavity 120, and the back rest cushion 140 may be partially inserted into the bottom cavity 120 to hold these elements therein. The foot support frame 106 may rotate back into an upper well 122 defined by the cushion support structure 108 and a seat cushion 110 may then be connected to the cushion support structure 108 to hold the foot support frame 106 within the upper well 122. In such a configuration, the seat cushion 110 may define a first major surface 102 of the chair 102 and the back rest cushion 140 may define a second major surface 194 of the chair 100 when the chair 100 is in the first, storage configuration. A handle 129 may be positioned on the front panel 128 to allow the chair 100 to be moved easily and placed on support surfaces 190 such that the rear panel 130 is positioned proximate to the support surfaces 190.
Figure 4:
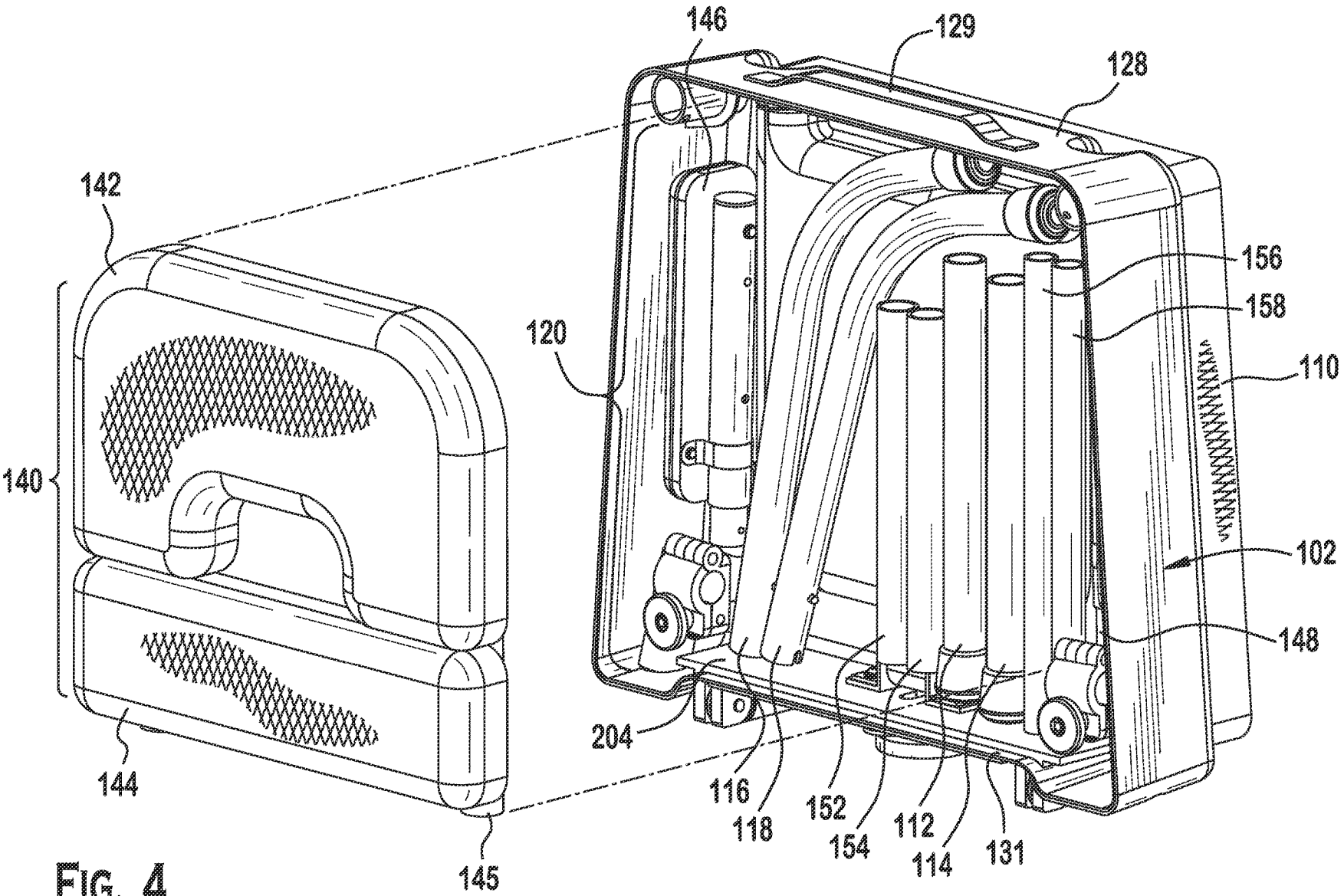
FIG. 4 is an alternate rear perspective view of the chair 100 of FIG. 3, showing how the elements of the back rest frame 150 and back support assembly 104 may be stored in bottom cavity 120 when the chair 100 is in the first, storage configuration. The first arm rest 146 is preferably positioned against the first side panel 124 with the first pivoting bracket 147 resting on the first lateral end 222 of the rear panel 130. The second arm rest 148 is preferably positioned against the second side panel 126 with the first pivoting bracket 149 resting on the second lateral end 224 of the rear panel 130. The first post 152, second post 154, first top post 156, second top post 158, first front leg 112, and second front leg 114 are all preferably positioned on the inner surface 202 of the rear panel 130 and/or the reinforcement plate 204, preferably proximate to the second side panel 126. Preferably, the caps 111 on the first front leg 112 and second front leg 114 contact the inner surface 202 and/or the reinforcement plate 204. The first rear leg 116 and second rear leg 118 are preferably positioned within the bottom cavity 112 proximate to the first side panel 124 with the caps 111 thereon positioned proximate to the front panel 128. The seat frame 102 is preferably configured such that chair 100 does not rest on the knob 244 when in the first, storage position and placed on a support surface 190. Instead, it is preferred that the chair 100 rests on any combination of the first lateral side 222 of the rear panel 130, the second lateral sides 226 of the rear panel 130, the first mounting boss 206, and/or the second mounting boss 208.
Figure 5:
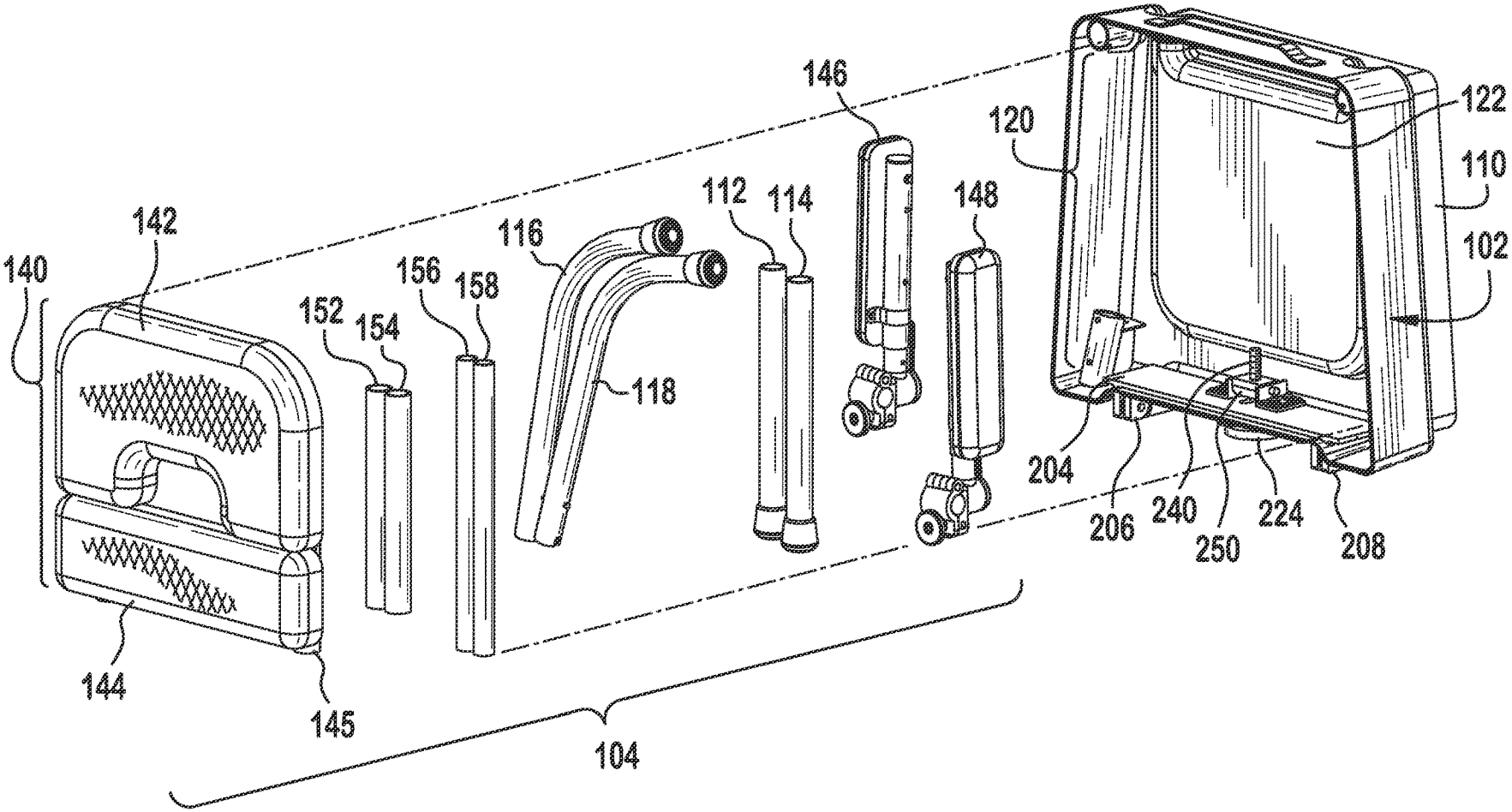
FIG. 5 is an exploded rear elevational view of the chair 100 shown in FIG. 3, further demonstrating how the elements of the back support assembly 104 may be positioned within the bottom cavity 120 when the chair 100 is in the first, storage configuration. More specifically, the figure shows that the elements of the back support assembly 104 must be placed in the bottom cavity 120 around the first rear leg receptacle 136 and second rear leg receptacle 138, and must be placed below or about the first front leg receptacle 132 and the second front leg receptacle 134. Critically, it is preferred that the elements of the back support assembly 104 within the bottom cavity 120 not be placed on or against the threaded rod 240 or rotation guide 250. This is to avoid unnecessary damage or wear on the threaded rod 240 and rotation guide 150, including damage to the first and second rotation guide pins 260, 270 and/or the cam surface 248, as this might negatively affect the movement of the threaded rod 240.
Figure 6:
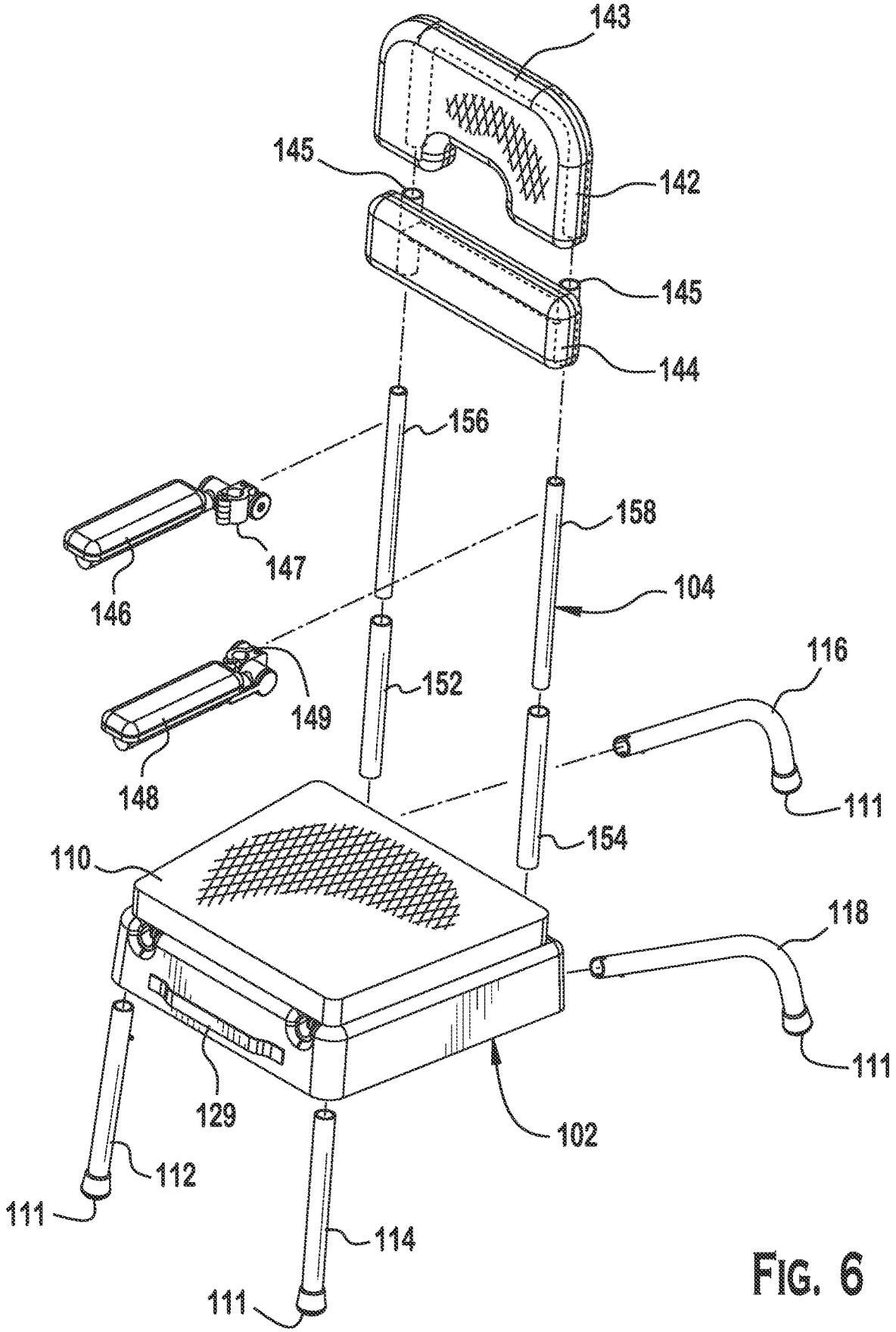
FIG. 6 is an exploded front left side elevational view of the chair 100 of a preferred embodiment, demonstrating the preferred configuration for assembling the chair 100. Preferably, the seat frame 102 may be provided with the foot support frame 106 attached thereto and stored within the upper well 122. The seat cushion 110 is preferably positioned on the cushion support surface 108 of the seat frame 102, covering the upper well 122 and the foot support frame 106 located therein. The seat cushion 110 may be held thereon by snaps, hook-and-loop fastener, or by any other suitable means. The first front leg 112, second front leg 114, first rear leg 116, and second rear leg 118 may be provided with caps 111 included on their lower ends. The first front leg 112 is preferably inserted into the first front leg receptacle 132 in the bottom cavity 120, the second front leg 114 is preferably inserted into the second front leg receptacle 134 in the bottom cavity 120, first rear leg 116 is preferably inserted into the first rear leg receptacle 136 in the bottom cavity 120 such that the first key element 137 engages the first rear guide slot 117, and the second rear leg 118 is preferably inserted into the second rear leg receptacle 138 in the bottom cavity 120 such that the second key element 139 engages the second rear guide slot 119. The seat frame 102 may then be stood on the legs 112, 114, 116, 118 such that it no longer rests directly on the support surface 190. The first post 152 may next be inserted into the first post receptacle 212 and the second post 154 into the second post receptacle 214. The first top post 156 may then engage the first post 152 and the second top post 158 may then engage the second post 154, creating two roughly vertical poles which may be slid through the cushion bar backing 145 until the cushion bar 144 rests at the desired position, preferably being positioned such that the cushion bar backing 145 covers the point where the first post 152 meets the first top post 156 and the point where the second post 154 meets the second top post 158. The first arm rest 146 may then be positioned on the first post 152 by wrapping the first pivoting bracket 147 around the first post 152 and locking it in place. Similarly, the second arm rest 148 may be positioned on the second post 154 by wrapping the second pivoting bracket 149 around the second post 154 and locking it in place. Last, the head rest cushion 142 may be positioned such that the first top post 156 and second top post 158 slide into the head rest backing 143, with the head rest backing 143 locking into the desired position, preferably via a locking pin 166.
Figure 7:
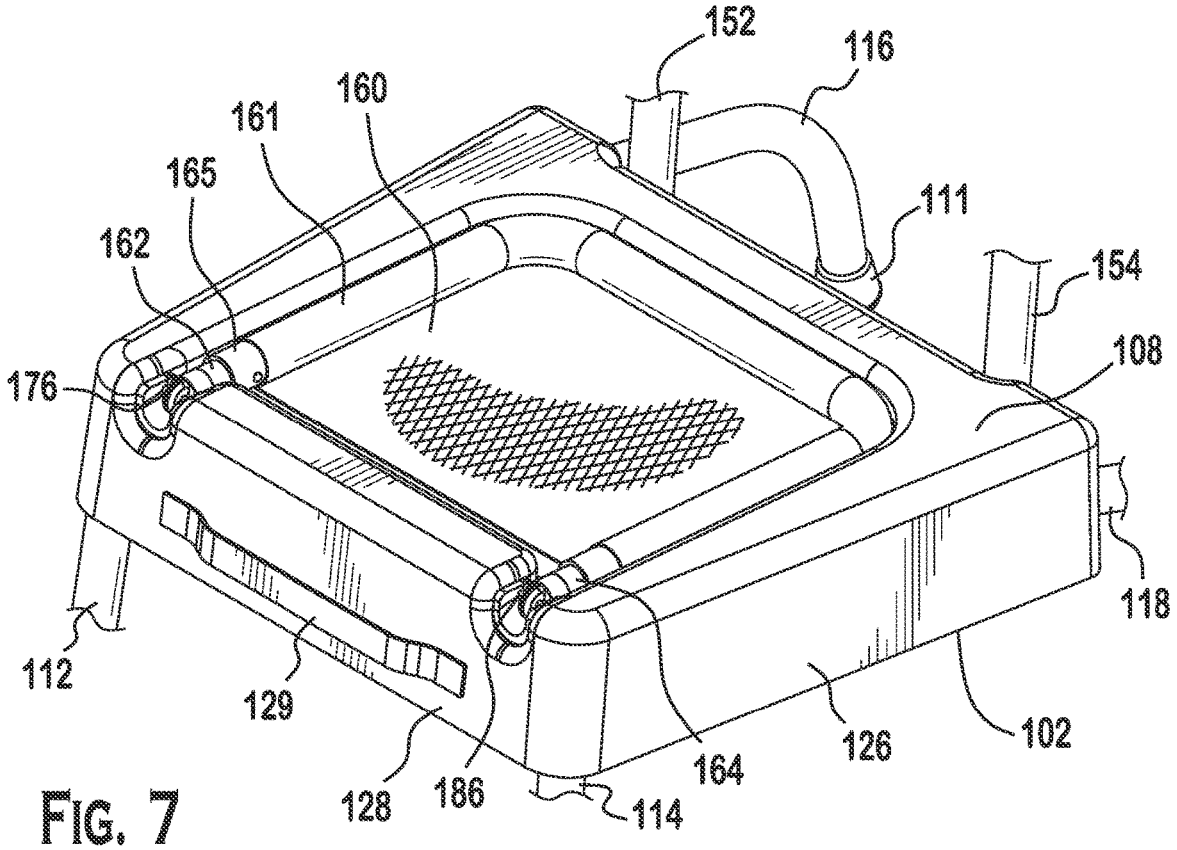
FIG. 7 is a partial front left perspective view of the chair 100 of a preferred embodiment, showing the preferred configuration of the seat frame 102 without a seat cushion 110 positioned thereon. The figure the seat frame 102 with the foot support frame 160 positioned within the upper well 122. The upper well 122 is preferably defined by the seat support surface 108, creating a depression or upper well 122 into which the elements of the foot support frame 106 may fit securely. The foot support frame 106 preferably includes a first foot support beam 162 connected to the seat frame 102 by a first hinge 176, and second foot support beam 164 connected to the seat frame 102 by a second hinge 186. The first foot support beam 162 and second support beam 164 are preferably connected by a U-shaped joining foot beam 165, which may slide over the first foot support beam 162 and second support beam 164 to adjust the length of the foot support frame 106. The joining foot beam 165 may be covered by material forming a foot rest sleeve 161, positioned tightly around the cylindrical joining foot beam 165, and a flat stretch of material forming the foot rest 160, covering the entire area between the ends of the U-shape.
Figure 8:
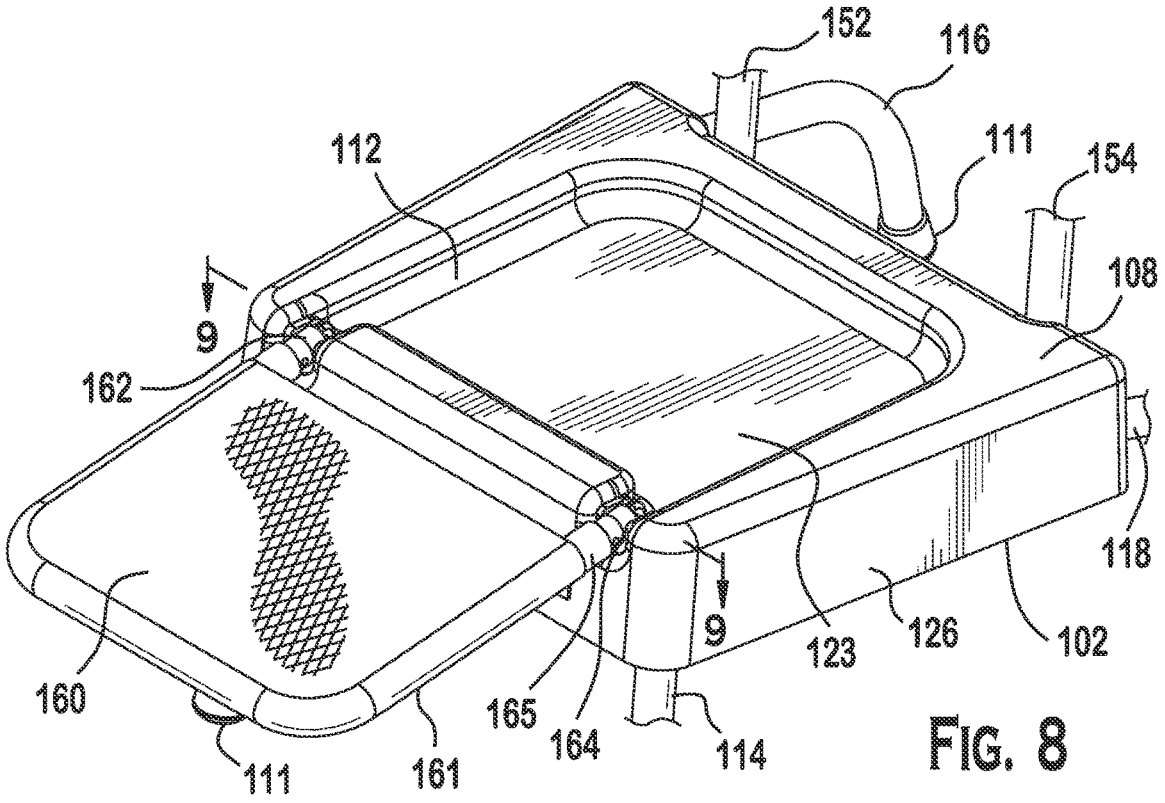
FIG. 8 is a partial front left perspective view of the chair 100 of a preferred embodiment, providing an alternate view to FIG. 7 with the foot support frame 106 in the second, foot support use configuration. The figure better shows the definition of the upper well 122 and the cushion support surface 108, as well as the platform 123 onto which the foot rest 160 may rest when the foot support frame 106 is in the storage position. This keeps pressure from being placed on the foot rest 160 and/or foot rest sleeve 161, which might result in the tearing of these elements due to pressure from a person sitting on the seat frame 102.
Figure 9:
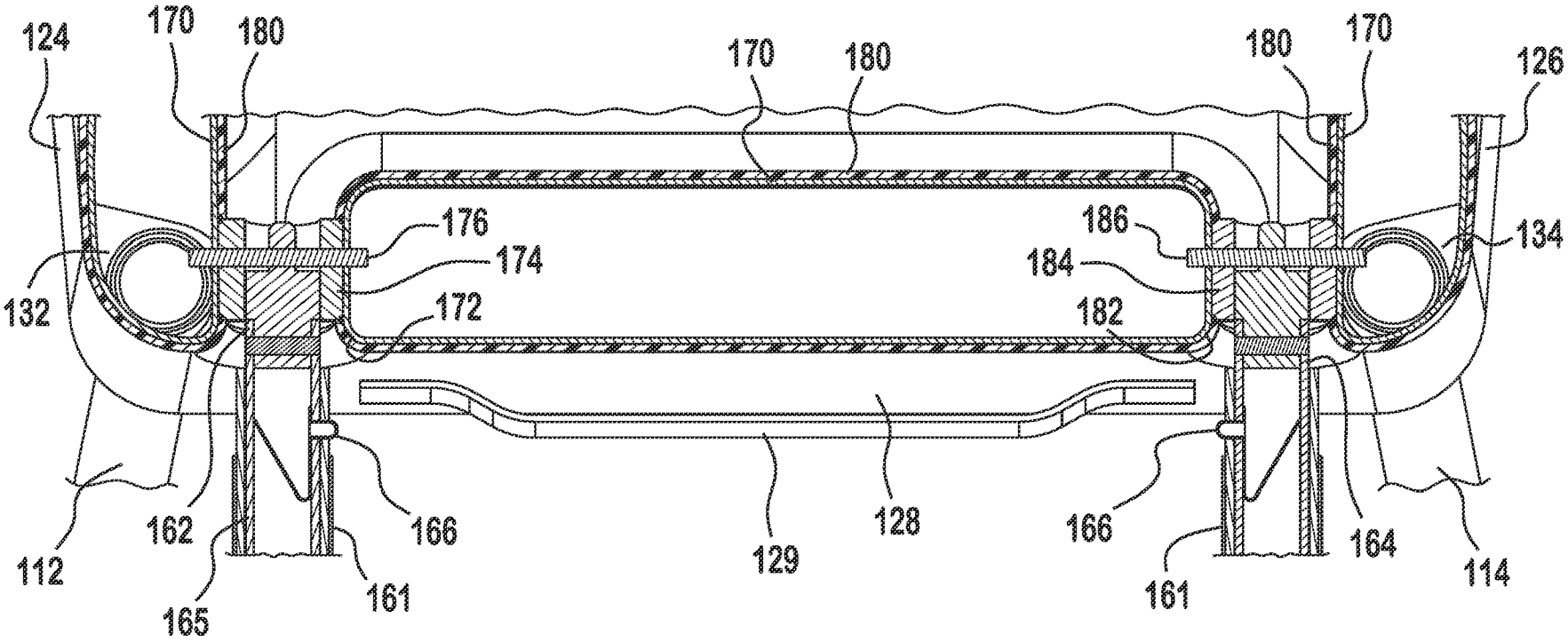
FIG. 9 is a partial cross-sectional view of the chair 100 of FIG. 8 as taken along lines 9-9 of FIG. 8. The figure shows the preferred configuration of the hinged connections between the seat frame 102 and the seat support frame 106. Preferably, the seat frame 102 is formed of two layers—a chair pan 170, preferably formed of metal, and a polymer layer 180, preferably formed of plastic, rubber, or the like. On one lateral side of the front panel 128, the chair pan 170 may form a first channel layer 172, with a first hinge insert 174 resting thereon. The first hinge 176 may pass through the first channel layer 172, first foot support beam 162, and first hinge insert 174 to create a hinged connection allowing the first foot support beam 162 to rotate upward and downward. The polymer layer 180 may be positioned over the chair pan 170 with the hinged connection being positioned within the first hinge opening 168 such that the first polymer shoulder 169 may hold the hinge insert 174 in place. A similar configuration is preferably provided on the opposite lateral side of the front panel 128, where the chair pan 170 may form a second channel layer 182, with a second hinge inert 184 positioned thereon. A second hinge 186 may pass through the second channel layer 182, the second foot support beam 164, and second hinge insert 184 to create a second hinged connection allowing the second foot support beam 164 to rotate upward and downward. When the polymer layer 180 is positioned over the chair pan 170, the second hinged connection may be positioned within the second hinge opening 188 such that the second polymer shoulder 189 may hold the second hinge insert 184 in place. A plurality of welds 178 may also be included to further retain the various elements in place. A portion of the cushion support surface 108 may be positioned between the hinged connections in the upper well 122, providing additional increased strength to the first and second hinges 176, 186.
Figure 10:
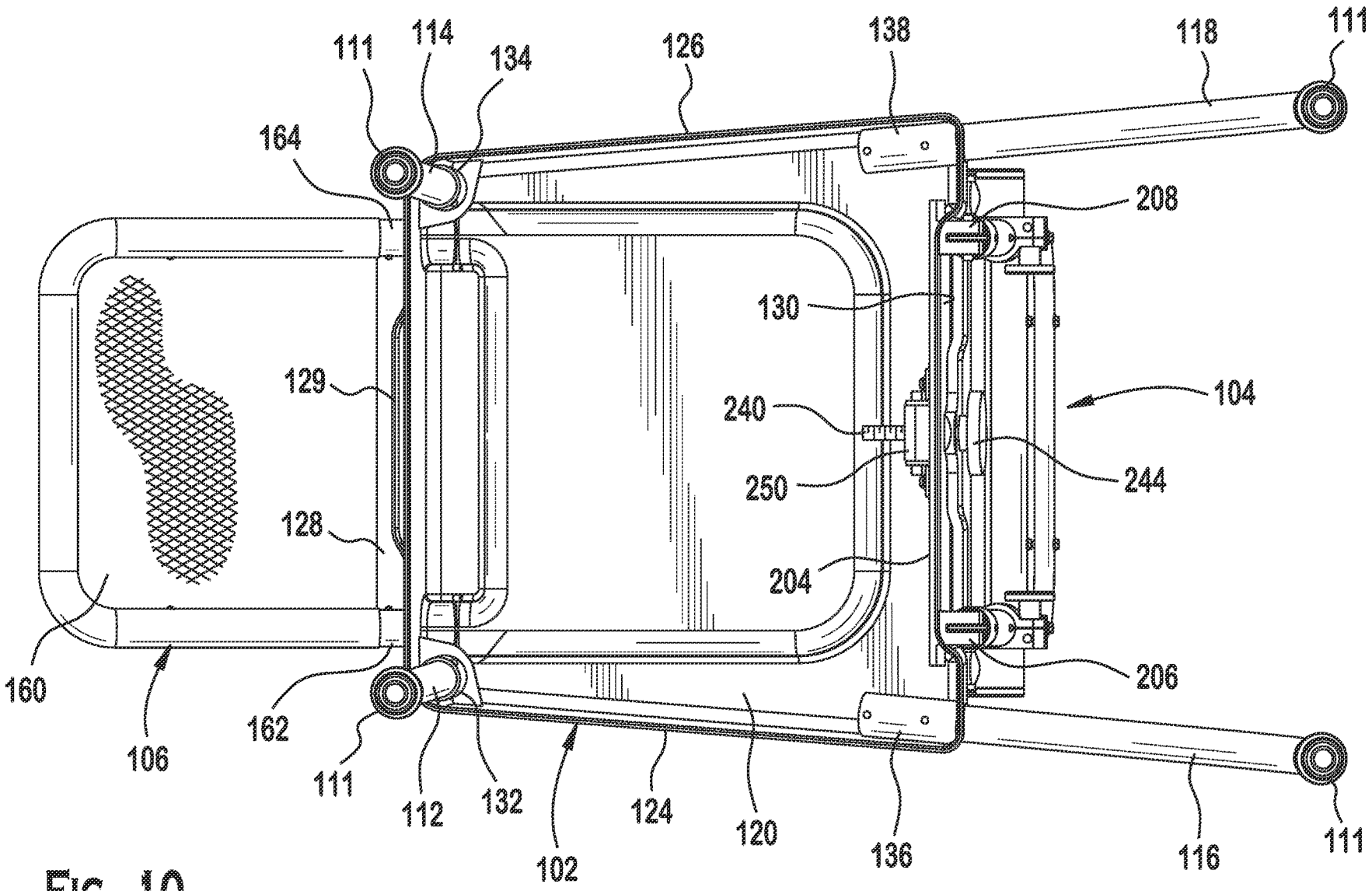
FIG. 10 is a bottom side elevational view of the chair 100 of a preferred embodiment, further demonstrating the preferred configuration of the seat frame 102. The figure shows the roughly rectangular shape of the seat frame 102 as formed by the front panel 128, first side panel 124, second side panel 126, and rear panel 130, and how these panels give the bottom cavity 120 a roughly rectangular shape. The rear panel 130 is shown to form a recess 230 between the first and second lateral ends 222, 226 of the rear panel 130 formed by first and second oblique walls 224, 228. The recliner mechanism 200 is preferably positioned within this recess 230. The figure further shows the preferred configuration of the leg receptacles within the bottom cavity 120. The first front leg receptacle 132 and second front leg receptacle 134 are preferably positioned in the front right and front left corners of the bottom cavity 120, respectively, with each being configured to receive legs 112, 114 from below. The first rear leg receptacle 136 and second rear leg receptacle 138 are preferably positioned in the rear right and rear left corners of the bottom cavity 120, respectively, with each being configured to receive legs 116, 118 from the rear axial side, preferably with said legs passing through the rear panel 130. The caps 111 are also shown to have a textured and grooved bottom side for placement on a support surface 190, and texturing may be included to avoid the chair 100 sliding. Specifically, the texture on the caps 111 is formed of concentric rings with a lip around the outer circumference.
Figure 11:
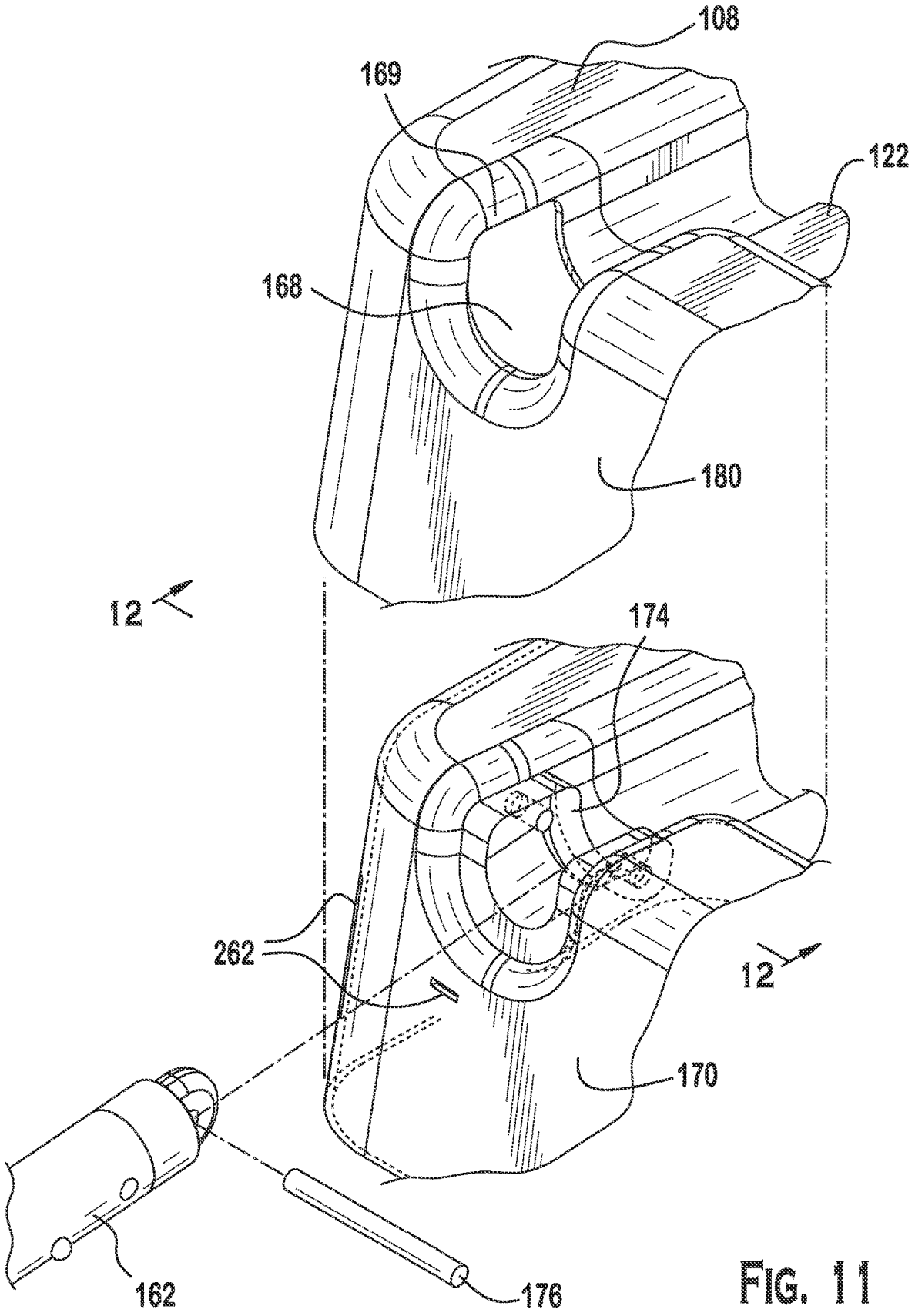
FIG. 11 is an exploded partial front left perspective view of the front right corner of the chair 100 of a preferred embodiment. The bottom portion of the figure shows the chair pan 170, including the first channel layer 172 with the first hinge insert 174 positioned thereon. The first hinge 176 is shown along with the first foot support beam 162 to show the preferred configuration of the first hinge 176 and the first foot support beam 162, as well as showing where the first hinge 176 is positioned in the first channel layer 172 and first hinge insert 174. The chair pan 170 may further be seen to form an underlying portion of the cushion support surface 108, and may include a plurality of first mounting slots 162 to receive the plurality of first front mounting flanges 252 that may hold the first front leg receptacle 132 in place. The top portion of the figure shows how the polymer layer 180 may include a first hinge opening 168 but generally covers all elements on or formed by the chair pan 170. This helps to show how the first polymer shoulder 169 may hold the first hinge insert 174 in place. Those of ordinary skill in the art will appreciate that a mirror image configuration may be provided for the hinge connection about the second hinge 186 on the opposite lateral side of the front panel 128.
Figure 12:
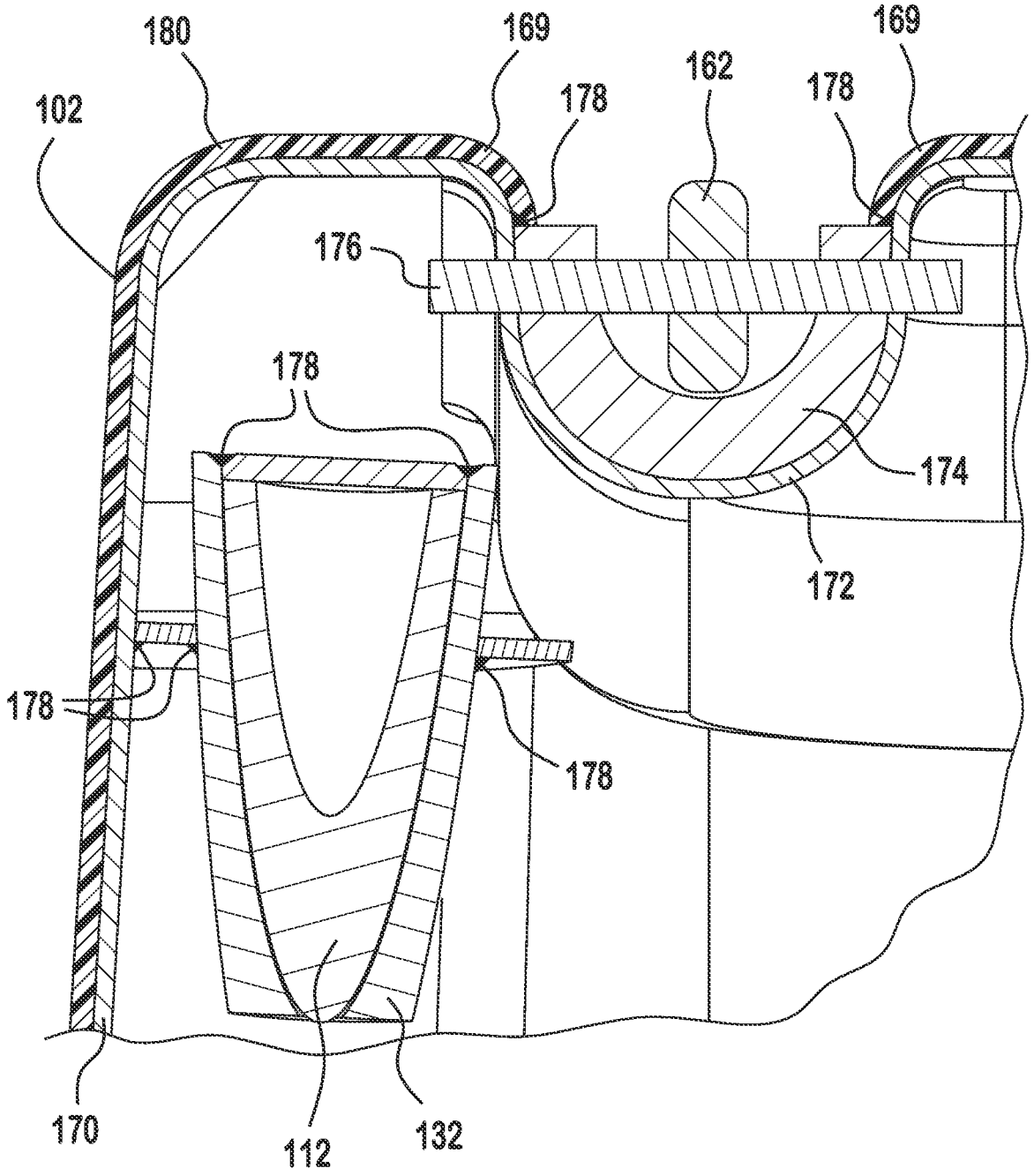
FIG. 12 is a partial cross-sectional view of the chair 110 of FIG. 11 taken along lines 12-12 of FIG. 11, better showing how the first hinge 176 is positioned. The first hinge 176 preferably passes through (running left to right as seen in this figure) the chair pan 170, the first channel layer 172, the first hinge insert 174, the first foot support beam 162, the first hinge insert 174 again, the first channel layer 172 again, and lastly passing again through the chair pan 170. The first polymer shoulder 169 is shown to overlap the first hinge insert 174 and preferably runs the entire perimeter of the first hinge opening 168. Each lateral end of the first hinge 176 may be positioned within the bottom cavity 120. Those of ordinary skill in the art will appreciate that a mirror image configuration may be provided for the hinge connection about the second hinge 186 on the opposite lateral side of the front panel 128.
Figure 13:
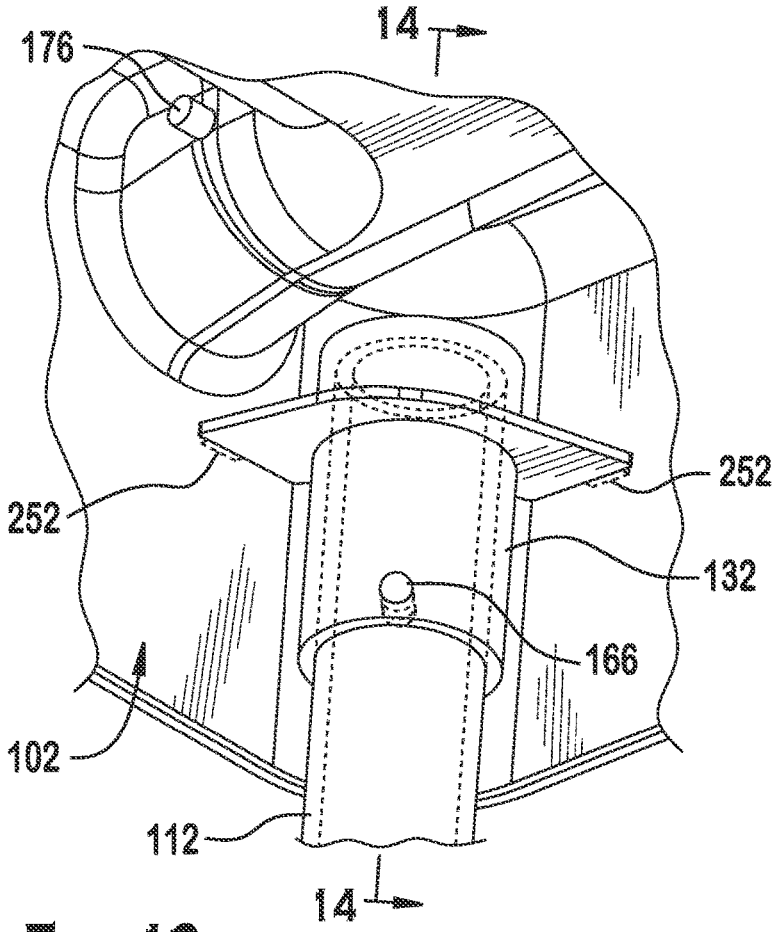
FIG. 13 is a partial cutaway perspective view of the front right corner of the bottom cavity 120 showing how the first hinge 176 (and, specifically, the ends of the first hinge 176) may extend into the bottom cavity 120. The figure also shows that there is preferably some distance between the first hinge 176 and the first front leg receptacle 132 to ensure that the first front leg receptacle 132 does not impede the rotation of the first hinge 176. Those of ordinary skill in the art will appreciate that a mirror image configuration may be provided for the front left corner of the inner cavity 120 and the second hinge 186 and second front leg receptacle 134 positioned therein.
Figure 14:
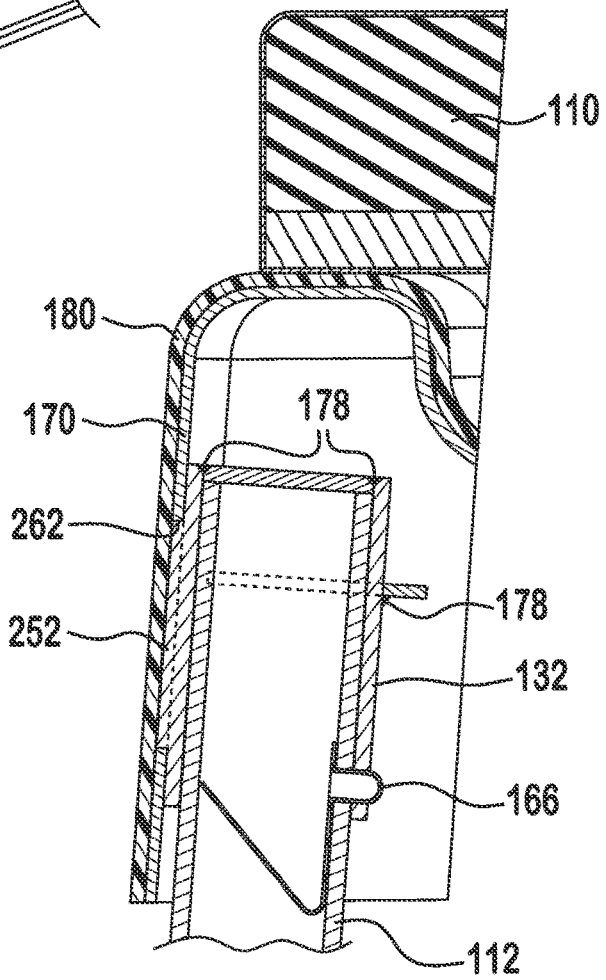
FIG. 14 is cross-sectional view of the chair 100 of FIG. 13 as taken along lines 14-14 of FIG. 13, better demonstrating the preferred configuration of the first front leg receptacle 132. Specifically, the figure shows the preferred positioning of the plurality of first front mounting flanges 252 and how these preferably engage the plurality of first front mounting slots 252 to hold the first front leg receptacle 132 in place in the front right corner of the bottom cavity 120. The figure also shows that the first front leg 112 may also include a locking pin 166 to lock the first front leg 112 within the first front leg receptacle 132. Those of ordinary skill in the art will appreciate that a mirror image configuration may be provided for the front left corner of the inner cavity 120, the second front leg 114, and the second front leg receptacle 134, including the second front mounting slots 264 and second front mounting flanges 254.
Figure 15:
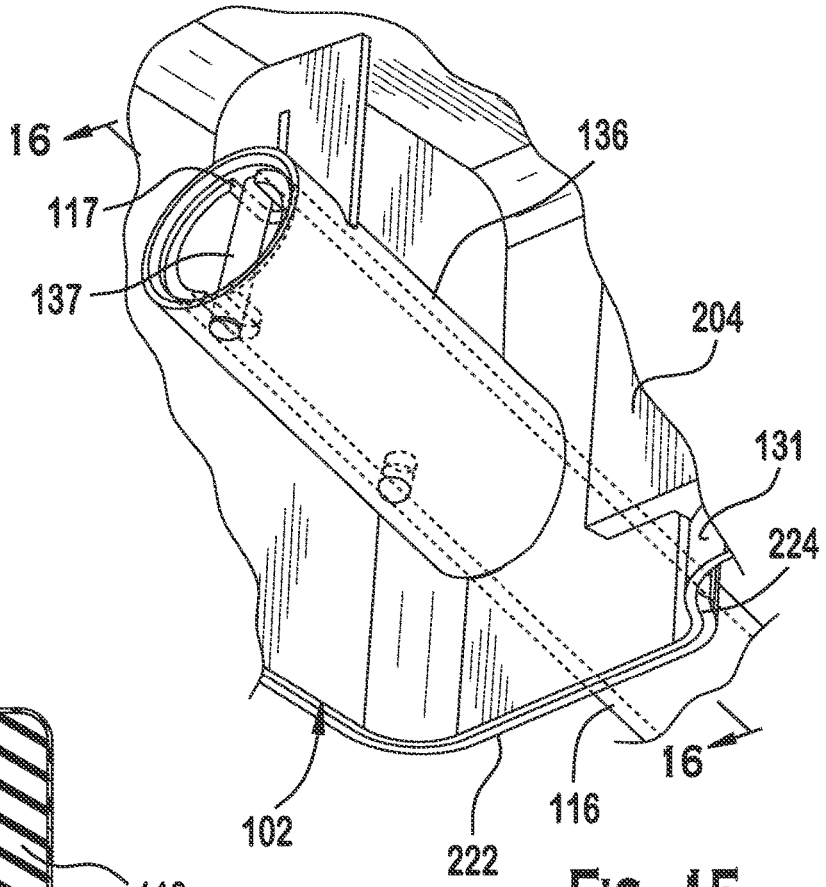
FIG. 15 is a partial front left perspective view of the rear right corner of the bottom cavity 120, showing the preferred configuration of the first rear leg receptacle 136 and the first rear leg 116, which may pass through the first lateral end 222 of the rear panel 130. Preferably, the first rear leg 116 includes first rear guide slots 117 which may engage a first key element 137 in the first rear leg receptacle 136 to prevent rotation of the first rear leg 116 within the first rear leg receptacle 136. Those of ordinary skill in the art will appreciate that a mirror image configuration may be provided for the rear left corner of the inner cavity 120, including the second rear leg 118 and the second rear leg receptacle 138 positioned therein.
Figure 16:
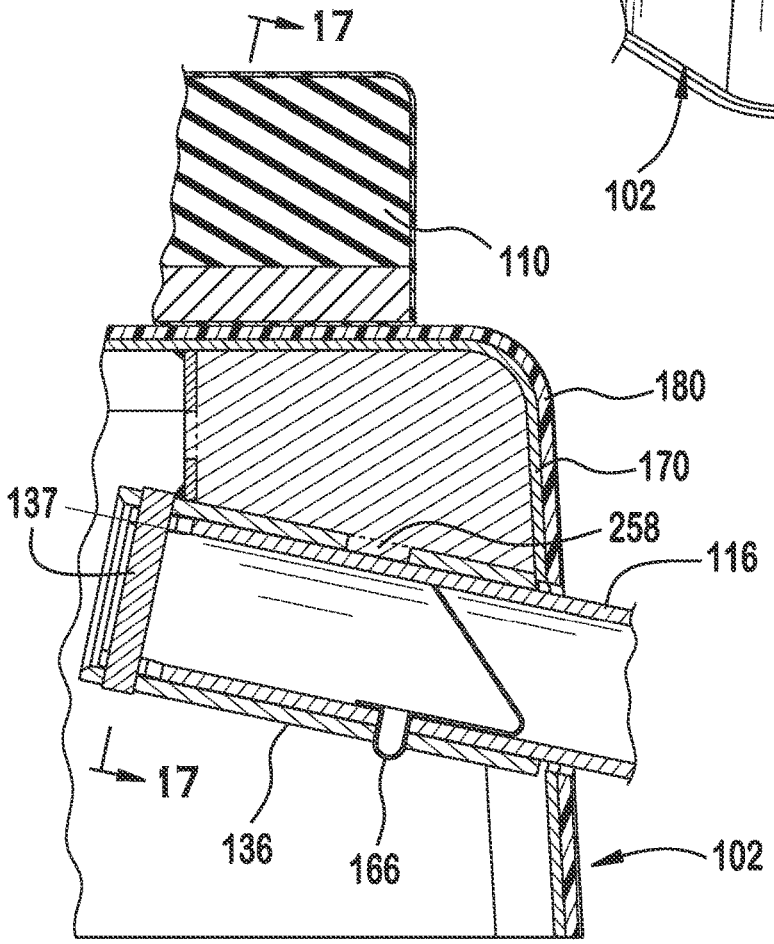
FIG. 16 is cross-sectional view of the chair 100 of FIG. 15 as taken along lines 16-16 of FIG. 15, better demonstrating the preferred configuration of the first rear leg receptacle 136. Specifically, the figure shows the preferred positioning of the plurality of first rear mounting flanges 256 and how these may engage the plurality of first rear mounting slots 266 to hold the first rear leg receptacle 136 in place in the rear right corner of the bottom cavity 120. The figure also shows that the first rear leg 116 may also include a locking pin 166 to lock the first rear leg 116 within the first rear leg receptacle 136. Those of ordinary skill in the art will appreciate that a mirror image configuration may be provided for the rear left corner of the inner cavity 120, the second rear leg 118, and the second rear leg receptacle 138, including the second rear mounting slots 268 and second rear mounting flanges 258.
Figure 17:
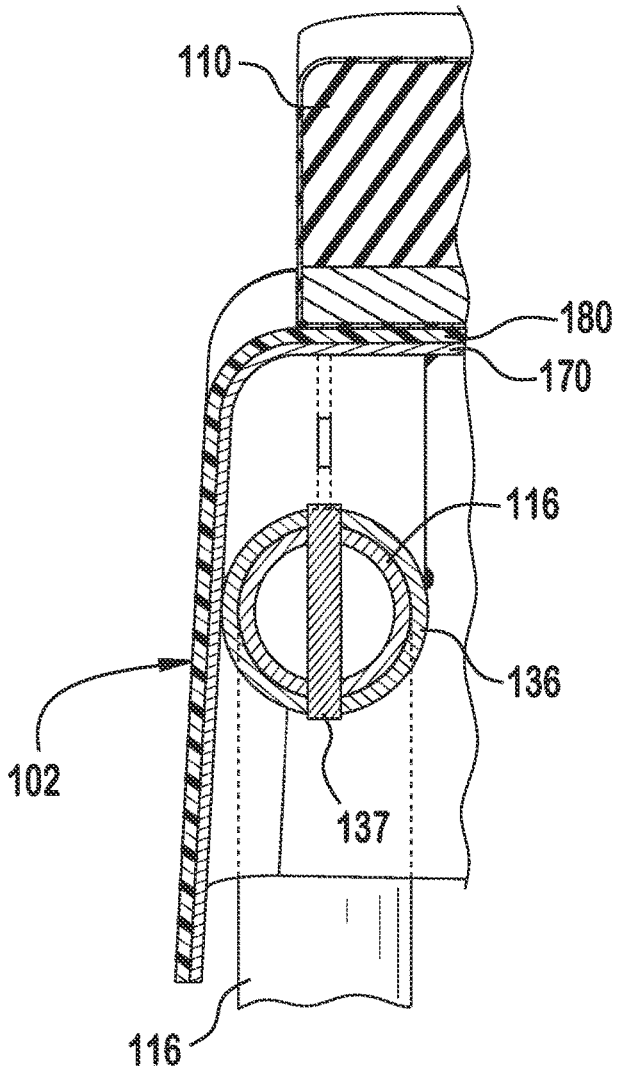
FIG. 17 is cross-sectional view of the chair 100 of FIG. 16 as taken along lines 17-17 of FIG. 16, showing additional angles of the preferred configurations of the first rear leg 116 and first rear guide slot 117, first rear leg receptacle 136 and first key element 137, and first rear mounting slots 266 and first rear mounting flanges 256. Those of ordinary skill in the art will appreciate that a mirror image configuration may be provided for the second rear leg 118 and second rear guide slot 119, the second rear leg receptacle 138 and the second key element 139, and the second rear mounting slots 268 and second rear mounting flanges 258.
Figure 18:
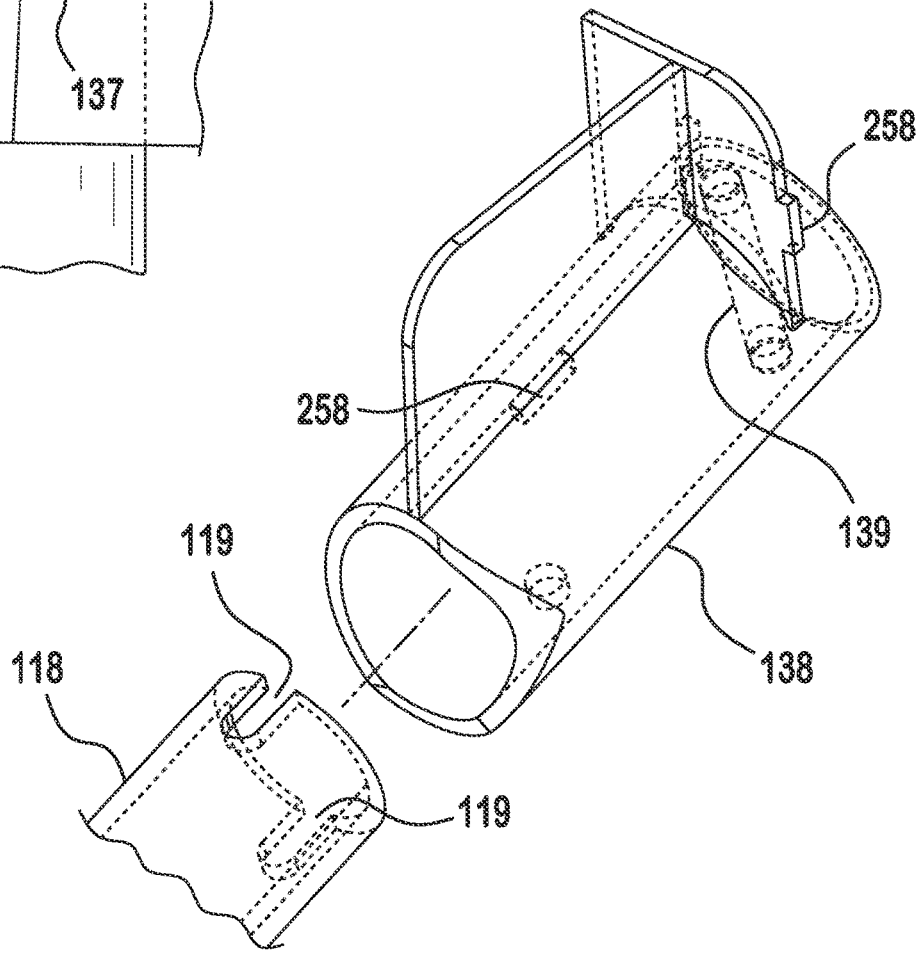
FIG. 18 is perspective view of the second rear leg receptacle 138 and a portion of the second rear leg 118 to better demonstrate the preferred configurations of the second rear guide slot 119 and the second key element 139, which are configured to prevent rotation of the second rear leg 118. The figure further shows the second rear mounting flanges 258 of the preferred embodiment, and how these are preferably positioned on the second rear leg receptacle 138.

Certain terminology is used in the following description for convenience only and is not limiting. The words "right," "left," "up," and "down" designate the directions as they would be understood by a person sitting in the chair in a second, use configuration unless specified otherwise. The words "outer" and "inner" refer to directions away from and toward, respectively, the geometric center of the bottom cavity of the chair. The term "lateral ends" refers to opposite ends of a component along a geometric horizontal axis of the part, while the term "axial ends" refers to opposite ends of a component along a geometric vertical axis of the part. The terms "touching," "abutting," "against," and "contacting" when used in connection with two surfaces is defined as meaning "being positioned anywhere between actual touching of two surfaces to being in facing orientation and within 1 inch (or 2.54 centimeters) apart." Additionally, the words "a" and "one" are defined as including one or more of the referenced items unless specifically stated otherwise. The terminology includes the words specifically mentioned above, derivatives thereof, and words of similar import.

Referring to FIGS. 1-37, wherein like numerals indicate like elements throughout, there are shown preferred embodiments of a chair 100, with the term "chair" being understood to mean an elevated platform for sitting, resting, or otherwise holding the bodies of humans or animals, or other objects. While the term "chair" is used herein, it is not meant to be limiting, as those of ordinary skill in the art will appreciate from this disclosure that the invention may be used to make furniture, such as tables, stools, couches, sofas, recliners, seat backs, car seats, and any other convertible or reclining objects. Additionally, those of ordinary skill in the art will appreciate from this disclosure that the invention may be used in combination with vehicles to create combination vehicles and removable and storable chairs or seats for use in said vehicles.

In some of the figures, preferred embodiments of the chair 100 are shown positioned on a flat surface, also referred to as a support surface 190, or shown as if they are positioned on a flat surface. This is to facilitate more clear and concise explanations of the preferred configurations, functions, and interrelations of the various parts of the chair 100. By viewing the preferred embodiments of the chair 100 as if they are positioned on a flat surface, the embodiments may be more easily compared and examined. For example, this may allow the preferred angular positioning of elements to be defined in relation to one another without considering the additional variable of support surface topography if the embodiments were not considered to be on a uniform, flat surface. The support surface 190 as discussed herein may be any hard, geometrically flat surface, such as a plastic, wood, metal, concrete, or cement flooring. However, those of ordinary skill in the art will appreciate from this disclosure that the support surface 190 is an imagined surface, and the chair 100 may be configured on any suitable surface for the placement of a chair 100.

Additionally, while the preferred embodiments discussed herein are shown as configured for placement on a flat support surface 190, those of ordinary skill in the art will appreciate from this disclosure that elements of the chair 100 may be configured for use on uneven surfaces. For example, the first and second front legs 112, 114, the caps 111 thereon, or the first and second front leg receptacles 132, 134 may be provided at different lengths from one another or may include spring elements or other adjustment mechanisms for assisting a user in comfortably using the chair 100 on an uneven surface.

Generally, the chair 100 preferably comprises three major elements—a seat frame 102, which may include a cushion support surface 108 and a seat cushion 110 on which a person might sit to support a user's posterior; a back support assembly 104, which may include a back rest frame 150 configured to support a back rest cushion 140, and a back rest cushion 140 for a user to lean against while seated on the seat frame 102 with the back rest cushion 140 supporting the user's back; a recliner mechanism 200 configured to allow the angular position of the back support assembly 104 relative to the seat frame 102 to be changed; and a foot support frame 106, preferably connected to a portion of the seat frame 102 proximate to the front panel 128 thereof and configured to hold the legs of a user at an elevated position relative to the support surface 190.

Referring to FIGS. 2-6 and 35-37, the chair 100 is preferably convertible between a first, storage configuration and a second, use configuration. In the first, storage configuration, the chair 100 is preferably optimized for easy storage. In the second, use configuration, the chair 100 is preferably configured to be sat upon by a user. These configurations are generally facilitated by the seat frame 102, which is configured to create a rectilinear container to store many of the other elements of the chair 100 when in the first, storage configuration, and to bear the majority of a user's weight when the chair 100 is in the second, use configuration.

The seat frame 102 is preferably roughly rectangular in shape, with this shape being provided by a first side panel 124 on one lateral side, a second side panel 126 on the opposite lateral side, the front panel 128 on one axial side, and the rear panel 130 on the opposite axial. The seat frame 102 preferably further includes a cushion support surface 108 on its top side such that the seat frame 102 defines a roughly rectangular bottom cavity 120 which is enclosed on five of its six sides. A seat cushion 110 may be position on the cushion support surface 108.

When the chair 100 is in the first, storage configuration, the rear panel 130 is preferably position downward toward the support surface 190 and the front panel 128 preferably faces upward such that a handle 129 position on the front panel 128 may be used to lift the chair 100 upward. In said configuration, a significant portion of the opening to the bottom cavity 120 (preferably more than 50% and more preferably more than 65% of the opening to the bottom cavity 120) is preferably covered by the back rest cushion 140. In some preferred embodiments, the back rest cushion 140 may be formed of a combination of a head rest cushion 142 and a cushion bar 144 rather than a single cushion. This preferred configuration may keep items stored within the bottom cavity 120, including the first and second front legs 112, 114, first and second rear legs 116, 118, and the elements of the back support assembly 104 contained therein. Snaps of fastening straps may be included to hold the back rest cushion 140 over the bottom cavity 120. The straps may include extensions of hook-and-loop fastener, lengths of vinyl material with snaps or zippers attached thereto, ties, or any other suitable materials. In the first, storage configuration, the chair 100 of the preferred embodiment this occupies a generally rectilinear volume defined on four sides by the rear panel 130, the front panel 128, the first side panel 124, and the second side panel 126. The generally rectilinear volume also preferably has two major surfaces, a first major surface 192 generally defined by the seat cushion 110, and a second major surface 194 generally defined by the back rest cushion 140.

Those of ordinary skill in the art will appreciate from this disclosure that the seat frame 102 is roughly rectilinear in shape, in that it has four sides when viewed in horizontal cross-section—a front panel 128, a first side panel 124, a second side panel 126, and a rear panel 130. Having four sides that meet at angles greater than 45-degrees, these form a roughly rectangular shape even though some preferred embodiment may include a front panel 128 that is preferably wider than the rear panel 130 and thus the first and second side panels 124, 126 are not specifically perpendicular to the front panel 128 and rear panel 130. The corners of the seat frame 102 are preferably rounded rather than sharp, to increase user comfort and avoid damaging other objects during storage.

The second, use configuration is preferably entered when the seat frame 102 is converted to allow a user to sit thereon, preferably on the seat cushion 110. In such a configuration, the first and second front legs 112, 114 and first and second rear legs 116, 118 may be attached to the bottom of the seat frame 102 to elevate it from a support surface 190, and the back support assembly 104 may be connected to the recliner mechanism 200 (the recliner mechanism 200 having been built into the rear panel 130). Preferably, in the second, use configuration the back support assembly 104 may be moved between different preferred angular positions. These preferred angular positions are preferably between 95-degrees and 170-degrees relative to the cushion support surface 108. In some preferred configurations, the chair 100 may also include a foot support frame 106 which may be moved into a second, foot support use position and fully extended when in the second, use configuration for elevating a user's feet from a support surface 190.

The first, storage configuration may facilitate storage of the chair 100 by reducing the area of a support surface 190 occupied by the chair 100. For example, the chair 100 defines a first footprint 196 when the chair 100 is in the first, storage configuration and positioned on a support surface 190. Conversely, the chair 100 may define a second footprint 198 when the chair 100 is the second, use configuration such that it is positioned on the support surface 190 with the foot support frame 106 in the second, foot support use position and the back support assembly 104 is angled at approximately thirty-five degrees from a vertical axis which is perpendicular to the supporting surface 190. In some preferred embodiments, the second footprint 198 is at least five times greater than the first footprint 196. In other preferred embodiments, the second footprint 198 is at least six times greater than the first footprint 196.

Figure 19:
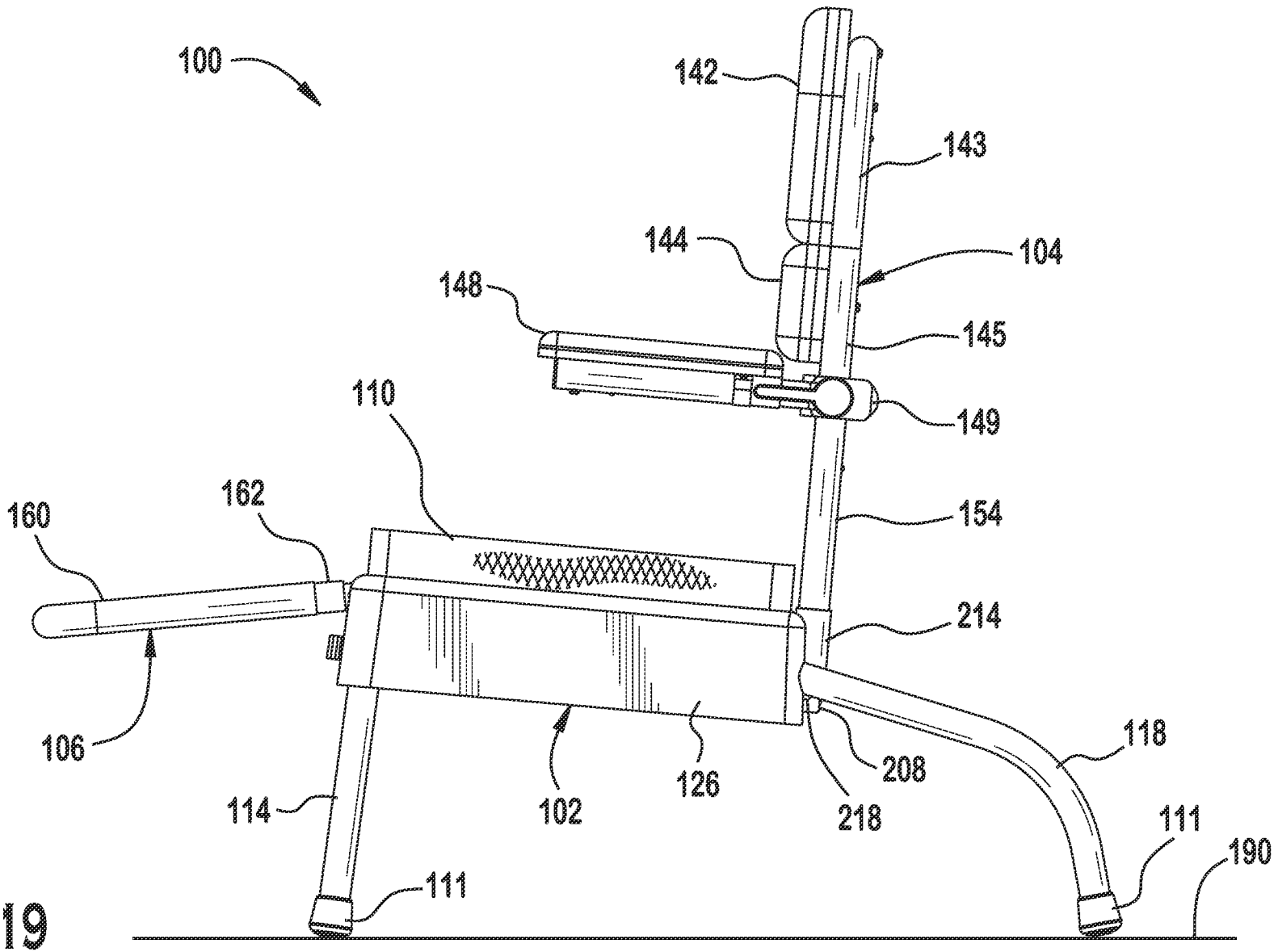
FIG. 19 is a left side elevational view of the chair 100 of a preferred embodiment, with the chair 100 in the second, use configuration positioned on a support surface 190. The figure shows that when the back support assembly 104 is fully upright, it is preferably held at between 85- and 105-degrees relative to the seat support surface 108.
Figure 20:
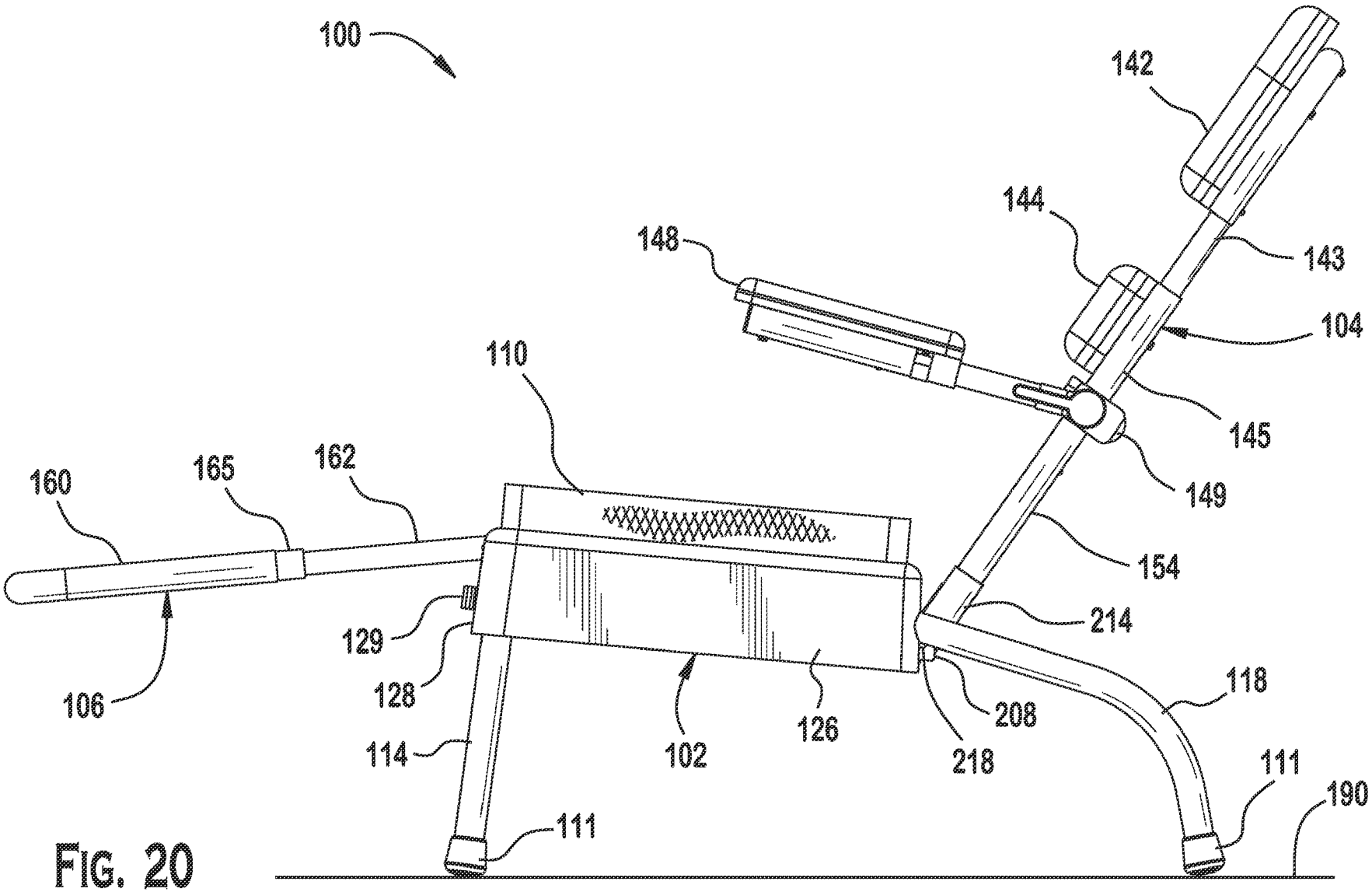
FIG. 20 is a left side elevational view of the chair 100 of a preferred embodiment, with the chair 100 in the second, use configuration positioned on a support surface 190. The figure shows that when the back support assembly 104 is fully reclined, it is preferably held at between 130- and 170-degrees relative to the seat support surface 108. The figure also shows that the foot support frame 106 is preferably extendable such that a foot rest distance (or the distance between the foot rest 160 and the front panel 128 of the seat frame 102) can be changed. This adjustment is preferably enabled by sliding the joining foot beam 165 along the first and/or second foot support beams 162. 164 away from the seat frame 102.
Figure 21:
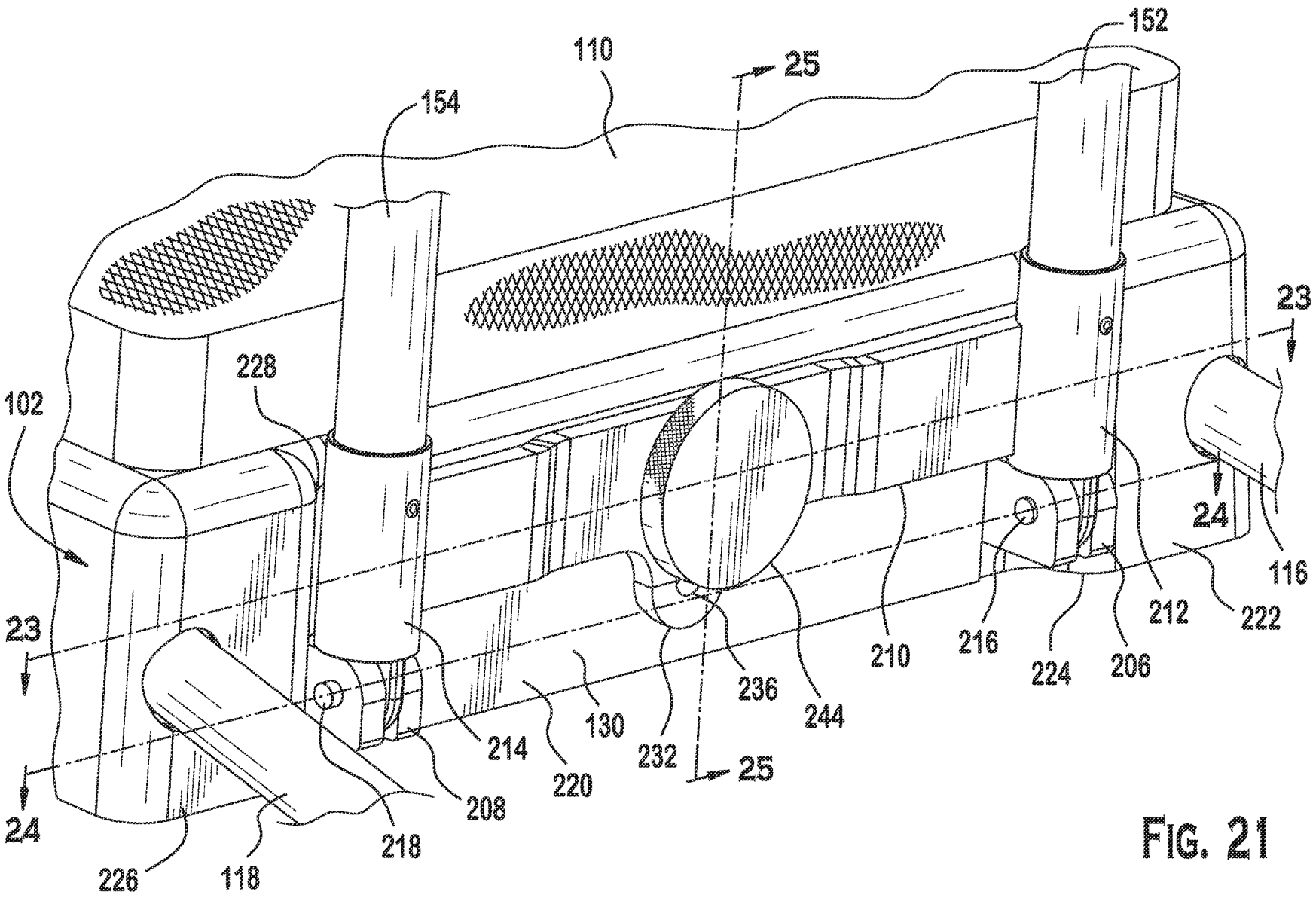
FIG. 21 is a partial rear left-side view of the chair 100 of a preferred embodiment, providing a detailed view of the position of the recliner mechanism 200 relative to the seat frame 102. The figure shows that the rear panel 130 includes first and second lateral ends 222, 226 and a central face 220 connected to the first and second lateral ends 222, 226 by first and second oblique walls 224, 228. The first and second rear legs 116, 118 preferably pass through the first and second lateral ends 222, 226 of the rear panel 130. The oblique walls 224, 228 preferably curve inward such that the rear panel 130 forms a recess 230 into which the recliner mechanism 220 may be set. On the central face 220, just inside of the first and second oblique walls 224, 228, the first and second mounting bosses 206, 208 preferably extend through the rear panel 130. The first and second mounting bosses 206, 208 are preferably strong metal extensions of the reinforcement plate 204. First and second post receptacles 212, 214 may be connected to the first and second mounting bosses 206, 208, respectively, and configured to rotate about a first post hinge 216 and a second post hinge 218 mounted therein. A cross-beam 210 preferably extends between the first post receptacle 212 and second post receptacle 214. The cross-beam 210 may be scalloped to bend gently inward toward the rear panel 130, allowing it to rest in the recess 230, defined by the lateral ends 222, 226 and oblique walls 224, 228. The cross-beam 210 is preferably configured such that a knob 244 may be positioned roughly in the center of the cross-beam 210 to facilitate reclining the back support assembly 104 as further shown in the following figures.
Figure 22:
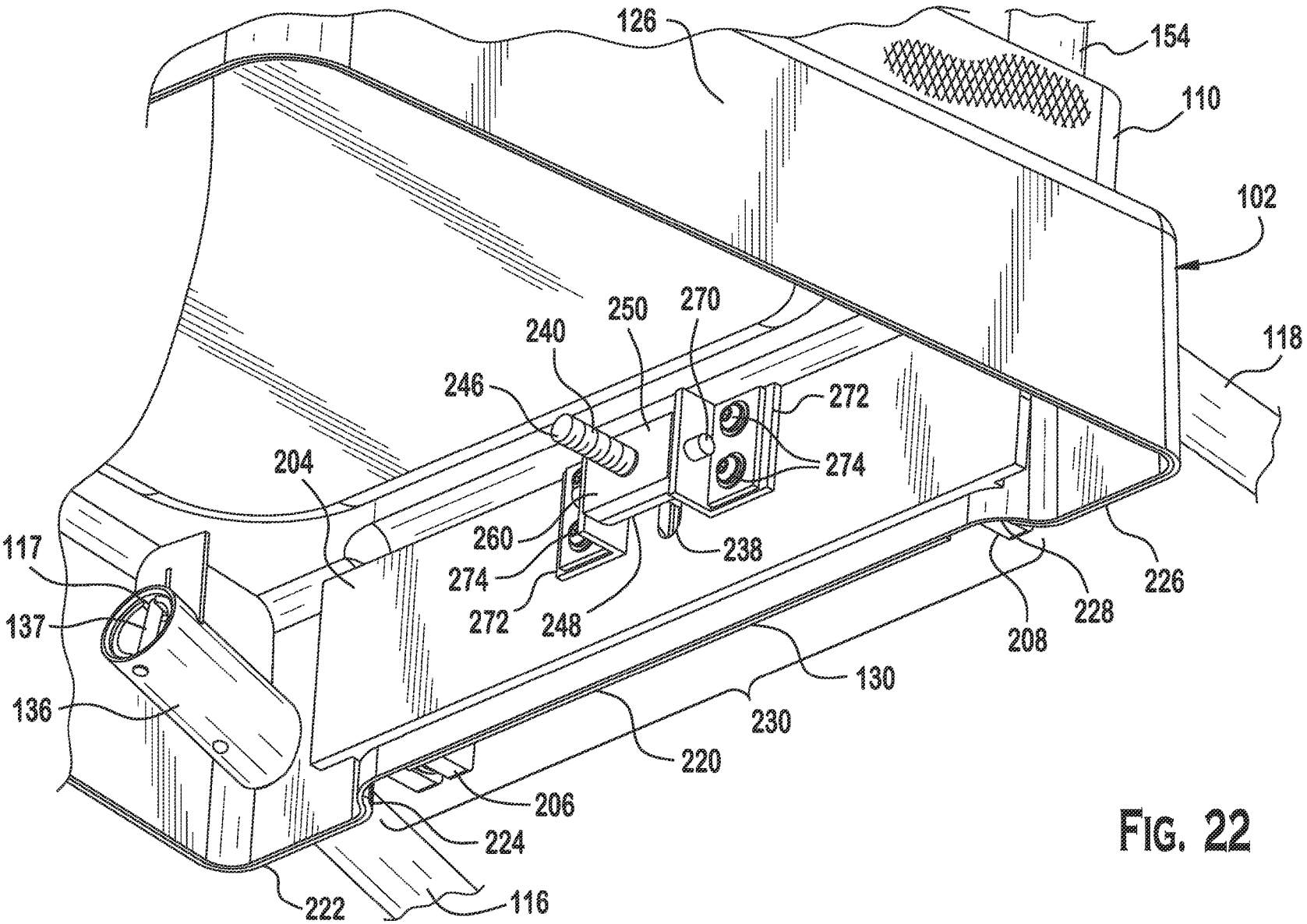
FIG. 22 is a partial bottom left-side perspective view of the chair 100 of a preferred embodiment, and specifically of the seat frame 102. The figure shows the preferred configuration of the recliner mechanism 200 and demonstrates how the recliner mechanism 200 preferably functions. A reinforcement place 204 is preferably connected to an inner surface 202 of the rear panel 130, with holes through each aligning to define a second elongated cut-out 238, and the second elongated cut-out 238 roughly corresponding to a hole in the cross-beam 210 that defines a first elongated cut-out 236. Mounting brackets 272 may be positioned on both lateral sides of the second elongated cut-out 238 and may be secured in place by mounting screws 274. The mounting brackets 272 each include one of a first rotation guide pin 260 and a second rotation guide pin 270, with one of the rotation guide pins 260, 207 located in each mounting bracket 272 and configured to rotate therein. The first rotation guide pin 260 and second rotation guide pin 270 are configured to engage a rotation guide 250 to allow it rotate. Those of ordinary skill in the art will appreciate from this disclosure that two rotation guide pins 260, 270 must be provided, as the rotation guide 250 must have a threaded hole therethrough to engage the threaded rod 240, and this would be blocked if a single pin were included that would pass fully through the rotation guide 350. The rotation guide 250 preferably has a cam surface 248, a curved face which generally faces the reinforcement plate 204 to allow the rotation guide 250 to move and rotate within a limited range until its edges abut the reinforcement plate 204. A threaded rod 240 preferably passes through the first elongated cut-out 236, the second elongated cut-out 238, and the rotation guide 250, with a first axial end 242 of the threaded rod 240 being positioned on the side of the cross-beam 210 opposite the rear panel 130 and connected to a knob 244. The second axial end 246 of the threaded rod 240 is preferably positioned on the inner side of the rotation guide 250, opposite the reinforcement plate 204. When the knob 244 and the threaded rod 240 it is attached to are rotated clockwise, the position of the rotation guide 250 on the threaded rod 240 progressively changes. Such movement moves the rotation guide 250 toward the first axial end 242 of the threaded rod 240. This pulls the cross-beam 210 toward the rear panel 130, decreasing the angle between the back support assembly 104 and the cushion support structure 108 of the seat frame 102. When the knob 244, and the threaded rod 240 it is attached to, are rotated in the opposite direction, counterclockwise, the location of the rotation guide 250 on the threaded rod 240 again changes, moving toward the second axial end 246 of the threaded rod 240. This causes the distance between the upper edge of the cross-beam 210 and the rear panel 130 to increase and the distance between the lower edge of the cross-beam 210 and the rear panel 130 to decrease. In other words, the angle of the cross-beam 210 relative to the rear panel 130 changes as the angle between the back support assembly 104 and the cushion support surface 108 changes. Thus, the turning of the threaded rod 240 changes the angular position of back support assembly 104 relative to the cushion support structure 108 of the seat frame 102. This also causes the angle of the threaded rod 140 within the first and second elongated cut-outs 236, 238 to change, a motion made possible by the rotation of the rotation guide 250 and the curvature of its cam surface 248, which keeps it from abutting the reinforcement plate 204 as the rotation guide 250 turns. As additional weight is placed on the back support assembly 104, weight may then be transferred onto the rotation guide 250 and/or the threaded rod 240. To prevent this transfer of weight, the cross-beam 210 may include a guard 232 extending downward therefrom, preferably with a beveled edge 234 proximate to the rear panel 130, configured to abut the rear panel 130 to receive the weight of a user prior to any weight being placed on the rotation guide 250 and/or threaded rod 240.
Figure 23:
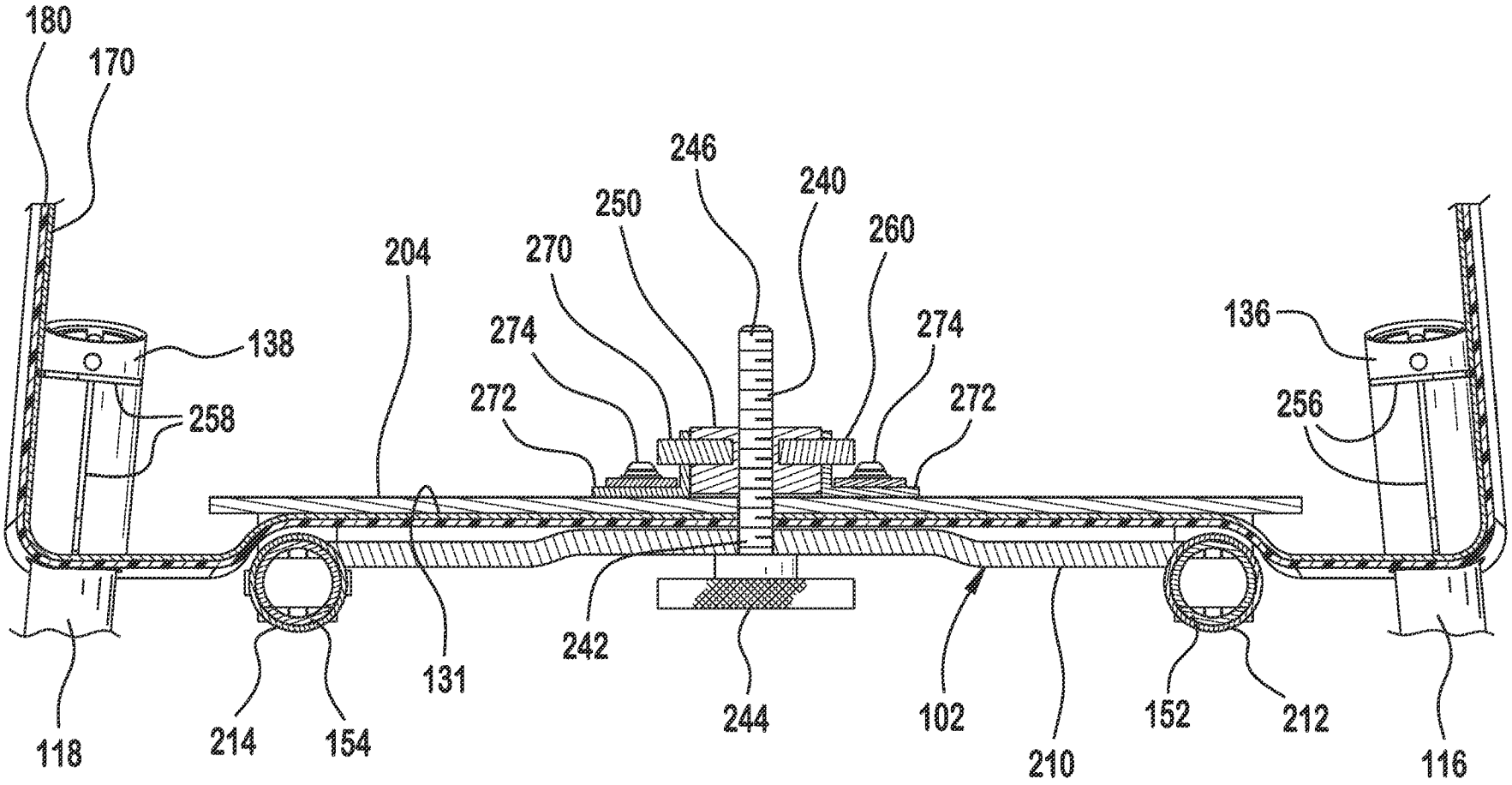
FIG. 23 is a partial cross-sectional view of chair 100, specifically the rear panel 130 and the recliner mechanism 200, of FIG. 21 as taken along lines 23-23 of FIG. 21, demonstrating the preferred configuration of the rear panel 130 and the recliner mechanism 200. Preferably, the seat frame 102, including the rear panel 130, is formed of a chair pan 170 covered in a polymer layer 180. The chair pan 170 may therefore form the inner surface 202 of the rear panel 130. The rear panel 130 preferably has a central face 220 and first and second lateral ends 222, 226. The rear panel 130 is preferably separated from the first and second lateral ends 222, 226 by first and second oblique walls 224, 228, respectively. The first and second oblique walls 224, 228 may form a recess 230 in the rear panel 130. A reinforcement plate 204 is preferably positioned against the inner surface 202 of the rear panel 130, with a first mounting boss 206 passing though the central face 220 proximate to the first oblique wall 224 and a second mounting boss 208 passing through the central face 220 proximate to the second oblique wall 228. The first and second mounting bosses 206, 208 are configured to connect to first and second post receptacles 212, 214 ensuring that the weight of a user reclining on the chair 100 is placed on the first and second mounting bosses 206, 208. The first and second oblique walls 224, 228 are preferably configured such that they improve the ability of the rear panel 130 to withstand torque generated by weight or pressure (including turning or horizontal pressure) on the first and second post receptacles 212, 214, first and second mounting bosses 206, 208, or in some preferred embodiments, the first and second rear legs 116, 118. A cross-beam 210 preferably connects the first and second post receptacles 212, 214 and fits within the recess 230 formed by the rear panel 130. The cross-beam 210 may be scalloped to ensure that a central portion of the cross-beam 210 abuts the central face 220 of the rear panel 130 prior to the lateral sides of the cross-beam 210. The central portion of the cross-beam 210 preferably defines a first elongated cut-out 236 roughly similar in size and shape to a second elongated cut-out 238 defined by both the rear panel 130 and the reinforcement plate 204. When the back support assembly 104 is in the fully upright position, the first elongated cut-out 236 and second elongated cut-out 238 preferably align within 1 inch (or 2.54 centimeters) of true alignment. Those of ordinary skill in the art will appreciate from this disclosure that the first and second elongated cut-outs 236, 238 need not align. Mounting brackets 272 are preferably positioned on the inner side of the reinforcement plate 204 and configured to hold a rotation guide 250 such that the center of the rotation guide 250 may be roughly aligned with the center of the first and second elongated cut-outs 236, 238 when the back rest assembly 104 is fully upright. The mounting brackets 272 preferably include a first rotation guide pin 260 on one lateral side of the rotation guide 250 and a second rotation guide pin 270 on the opposite lateral side of the rotation guide 250. Such a configuration may allow the rotation guide 250 to rotate which the threaded rod 240 is positioned within the rotation guide 250. The rotation guide 250 preferably has a cam surface 248 on one axial end, closest the rear panel 130, to allow the rotation guide 250 to rotate vertically along a preferred path, but being stopped by the right angles at the edges of the rotation guide 250 when the end of the desired path of rotation is reached. The threaded rod 240 preferably has a knob on its first axial end 242 while the second axial end 246 is preferably free. The threaded surface of the threaded rod 240 preferably allows it to be screwed into threaded openings. Preferably the rotation guide 250 has a threaded bore are configured to receive the threaded rod 240 therethrough. The threaded rod 240 is preferably configured such that when the back rest assembly 104 is fully upright the second axial end 246 may be placed into the first elongated cut-out 236 and the knob 244 may be turned to pull the second axial end 246 inward, through the first elongated cut-out 236, second elongated cut-out 238, and rotation guide 250 until the knob 244 abuts the cross-beam 210. At that point, the first axial end 242 should be positioned within the bottom cavity 120 and the back support assembly 104 will be secured in its fully upright position.
Figure 24:
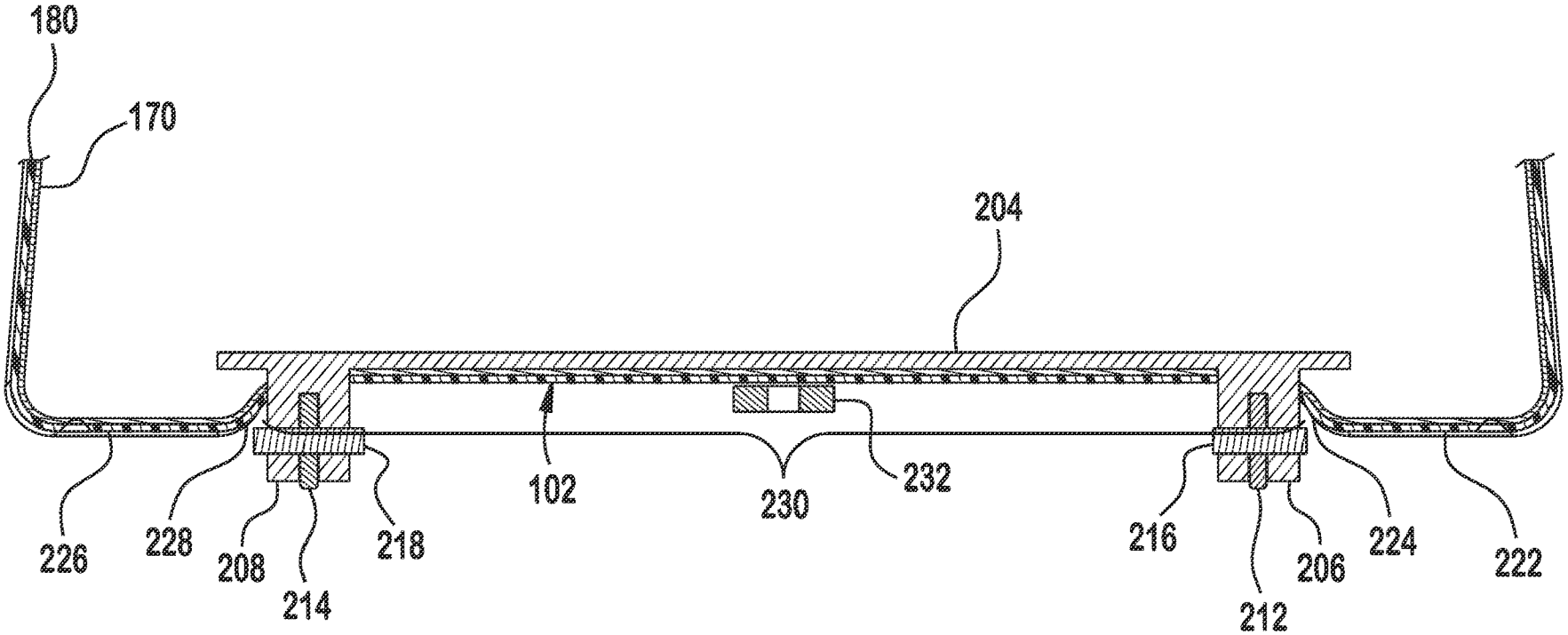
FIG. 24 is a partial cross-sectional view of the recliner mechanism 200 of FIG. 21 as taken along lines 24-24 of FIG. 21, demonstrating that the guard 232 is preferably configured to abut the central face 210 of the rear panel 130 within the recess 230 with back support assembly 104 reaches a preferred angular position, to avoid damage to the threaded rod 240 if it were to contact the top of the first or second elongated cut-outs 236, 238. As can be seen in the figure, the guard 232 preferably abuts the polymer layer 180 of the seat frame 102. This preferred angular position is preferably the maximum reclined position of the back support assembly, preferably between 130- and 170-degrees relative to the cushion support surface 108. In some preferred configurations, the preferred angle of the back support assembly 104 relative to the cushion support surface 108 for causing the guard 232 to abut the rear panel is preferably slightly (within 10-degrees) more than the maximum angle of reclination of the back support assembly 104, to avoid damaging the guard 232 due to overuse.
Figure 25:
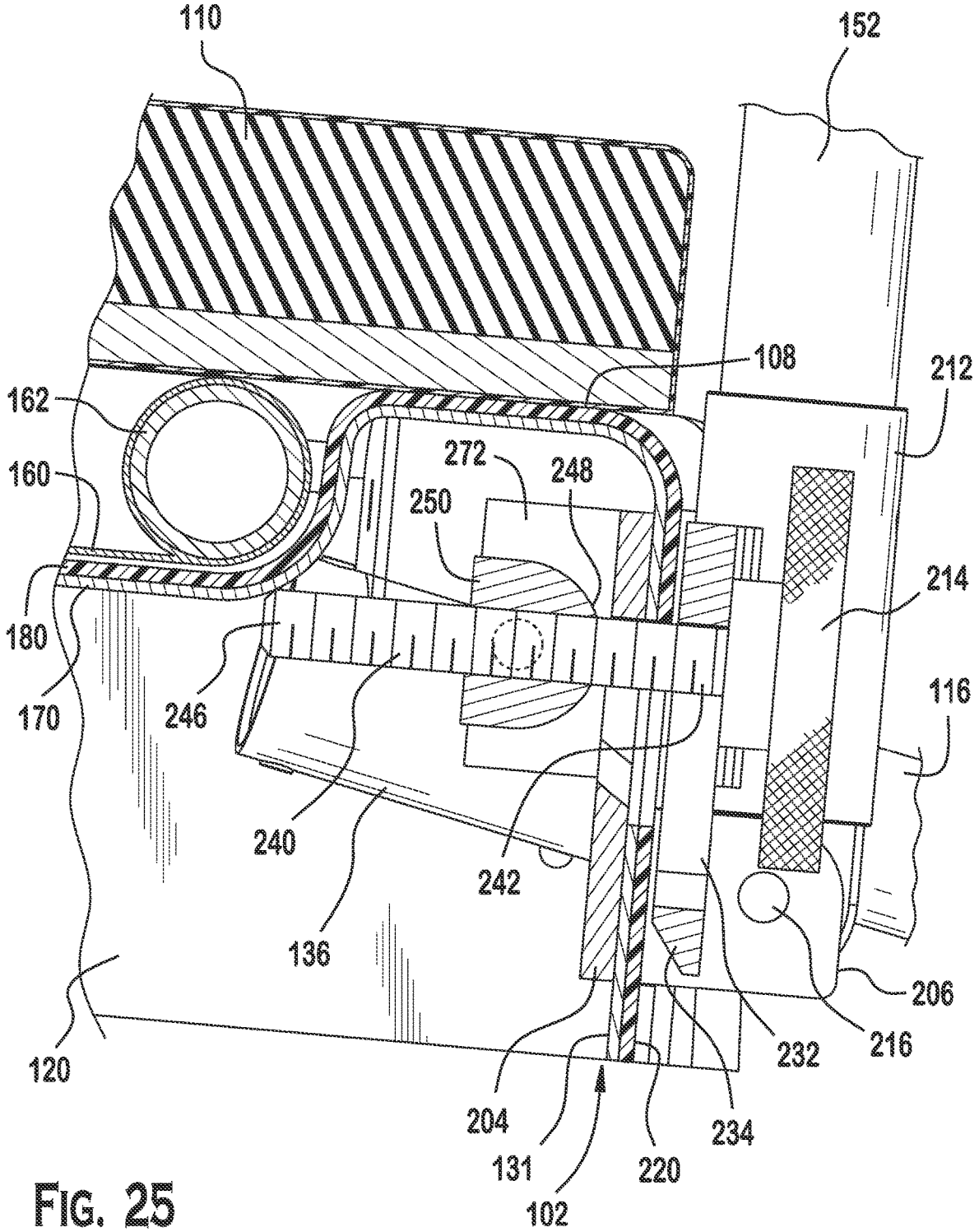
FIG. 25 is a partial cross-sectional view of the chair 100 of FIG. 21 as taken along lines 25-25 of FIG. 21, demonstrating the preferred position of the second axial end 246 of the threaded rod 240 in the bottom cavity 120 when the back support assembly 104 is in the fully upright position. In some preferred embodiments, the second axial end 246 of the threaded rod 240 is positioned near, or may even abut, the inner side of the upper well 122 when the threaded rod 240 is fully inserted into the bottom cavity 120. In this position, it is preferred that the beveled edge 234 of the guard 232 does not abut the rear panel 130.
Figure 26:
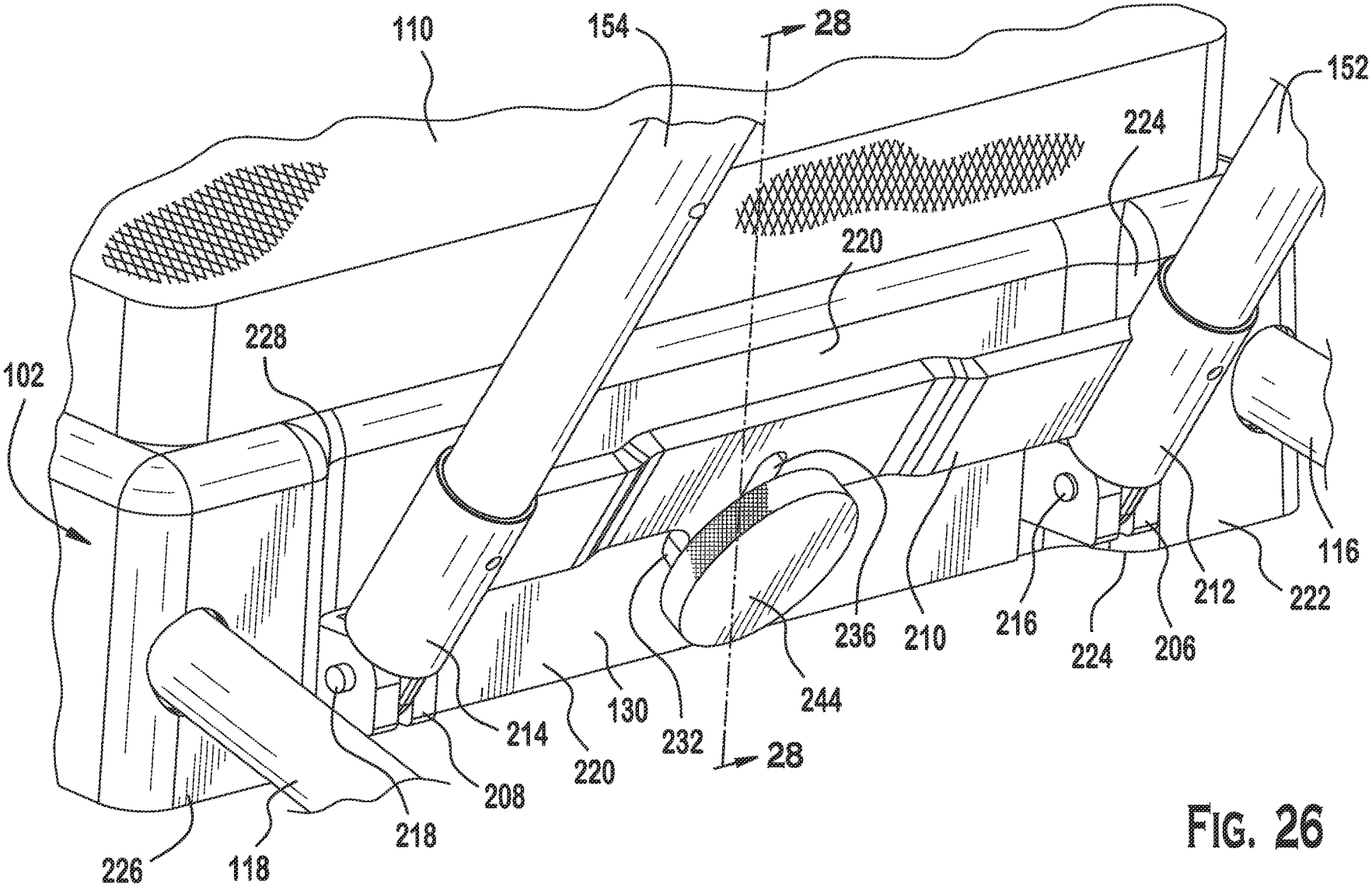
FIG. 26 is a left side elevational view of the chair 100 of a preferred embodiment, with the chair 100 in the second, use configuration with the back support assembly 104 fully reclined. It is preferred that at this fully reclined position, the back support assembly 104 is held at between 130- and 170-degrees relative to the cushion support surface 108. The figure shows that, in this position, the first and second post receptacles 212, 214 have pivoted about the first and second post hinges 216, 218, now holding the first and second post 152, 154 (and the cross-beam 210) at the preferred angle. The figure further shows, as will be shown more clearly in later figures, that the angle of the threaded rod 240 within the first and second elongated cut-outs 236, 238 changes, as the knob 244 is not positioned at the bottom of the first elongated cut-out 236. The guard 232 may abut the central face 220 when the back support assembly 104 is held at this angle.
Figure 27:
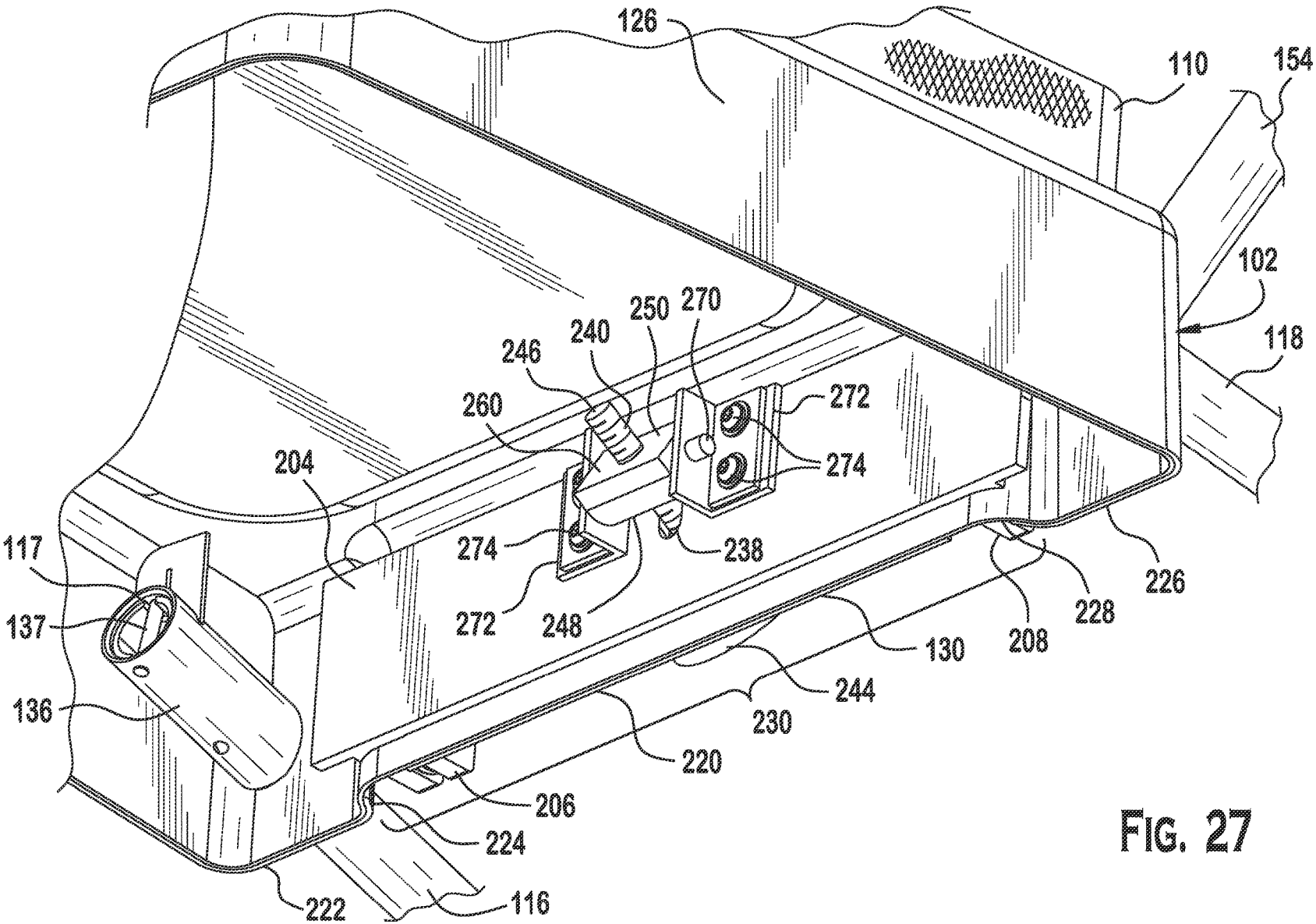
FIG. 27 is a partial bottom left-side perspective view of the chair 100 of a preferred embodiment, and specifically of the bottom cavity 120 of the chair 100, when the back support assembly 104 is in the fully reclined position. The figure shows that the threaded rod 240 is preferably held at an angle within the second elongated cut-out 238, being held closer to the bottom of the second elongated cut-out 238 than the top. This rotation is facilitated by the preferred configurations of two elements. First, the rotation guide rotating about the first and second rotation guide pins 260, 270 in the mounting brackets 272 allows the threaded rod 240 to be steadily held within the first and second elongated cut-outs 236, 238. Second, the threaded surface of the threaded rod 240 and the threaded bore in the rotation guide 250 allow the threaded rod 240 to gradually retract from the rotation guide 250. The location of the rotation guide 250 and the second elongated cut-out 238 along the threaded rod 240 changes as the back support assembly 104 is reclined. The location of the first elongated cut-out 236 along the threaded rod 240, however, does has not. Instead, the distance between the first and second posts 152, 154 and the seat frame 102 increases, but at an angle. The distance between the guard 232 and the central face 220 has decreased such that the beveled edge 234 of the guard 232 may even abut the central face 220. Thus, the back support assembly 220 is held at a preferred angle relative to the cushion support surface 102.
Figure 28:
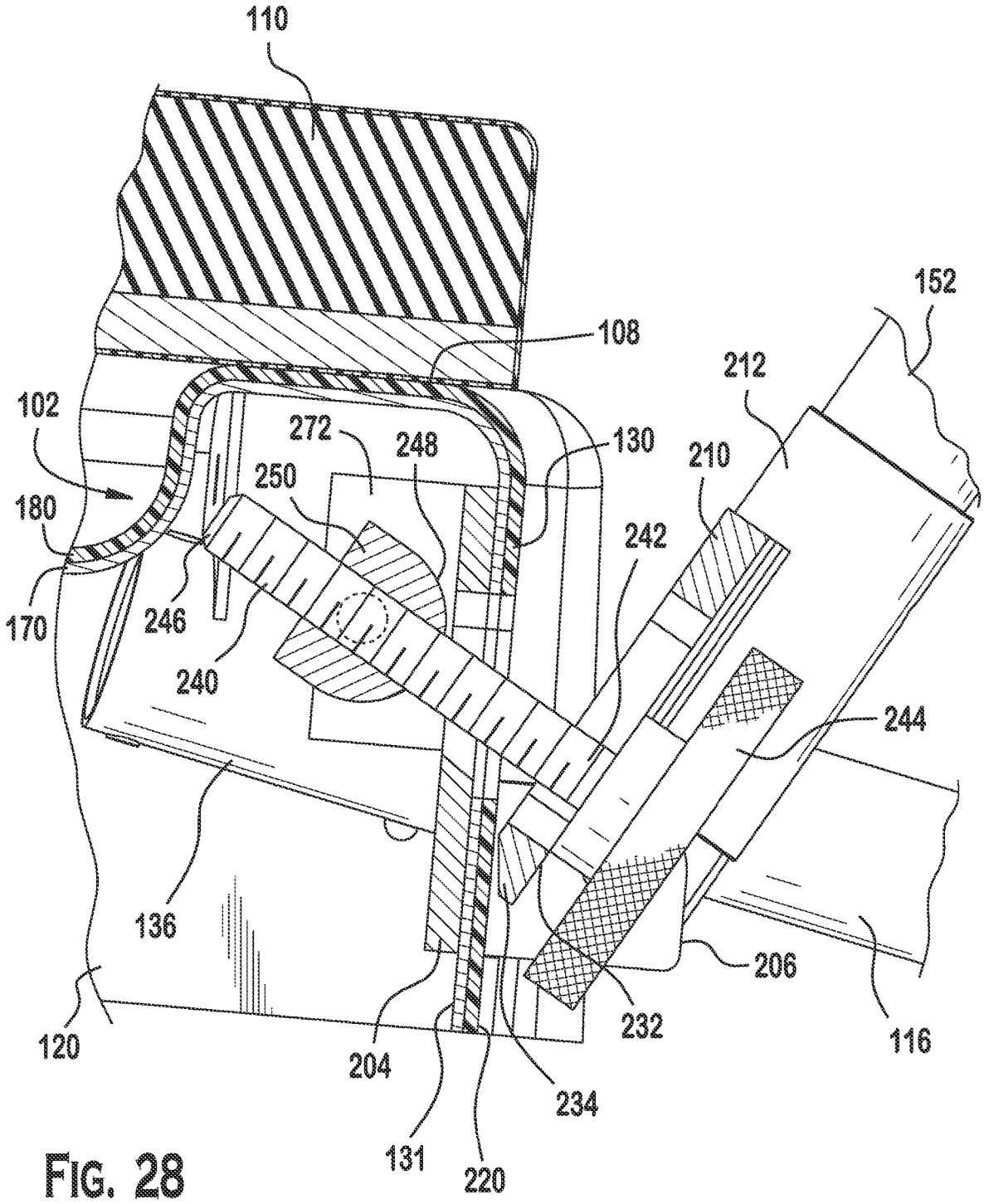
FIG. 28 is a partial cross-sectional view of the recliner mechanism 200 of FIG. 26 as taken along lines 28-28 of FIG. 26, demonstrating that the threaded rod 240 is preferably held at an angle relative to the seat frame 102 when the back support assembly 104 is reclined, rather than parallel to the cushion support surface 108 as when the back support assembly 104 is fully upright. The second axial end 246 of the threaded rod 240 is preferably closer to the rotation guide 250 when the back support assembly 104 is reclined such that less of the threaded rod 240 is now in the bottom cavity 120 and can no longer abut the inner side of the upper well 122. The figure further shows that the beveled edge 234 of the guard 232 and the cam surface 248 of the rotation guide 250 may not abut the rear panel 130 or the reinforcement plate 204, respectively, when the back support assembly 104 is fully reclined but no user is placing his or her weight on the back support assembly 104. This may help to preserve the lifespan of these elements, as they are meant to receive weight when necessary to prevent damage to the threaded rod 040, but need not receive weight in situations where such safety measures are unnecessary.
Figure 29:
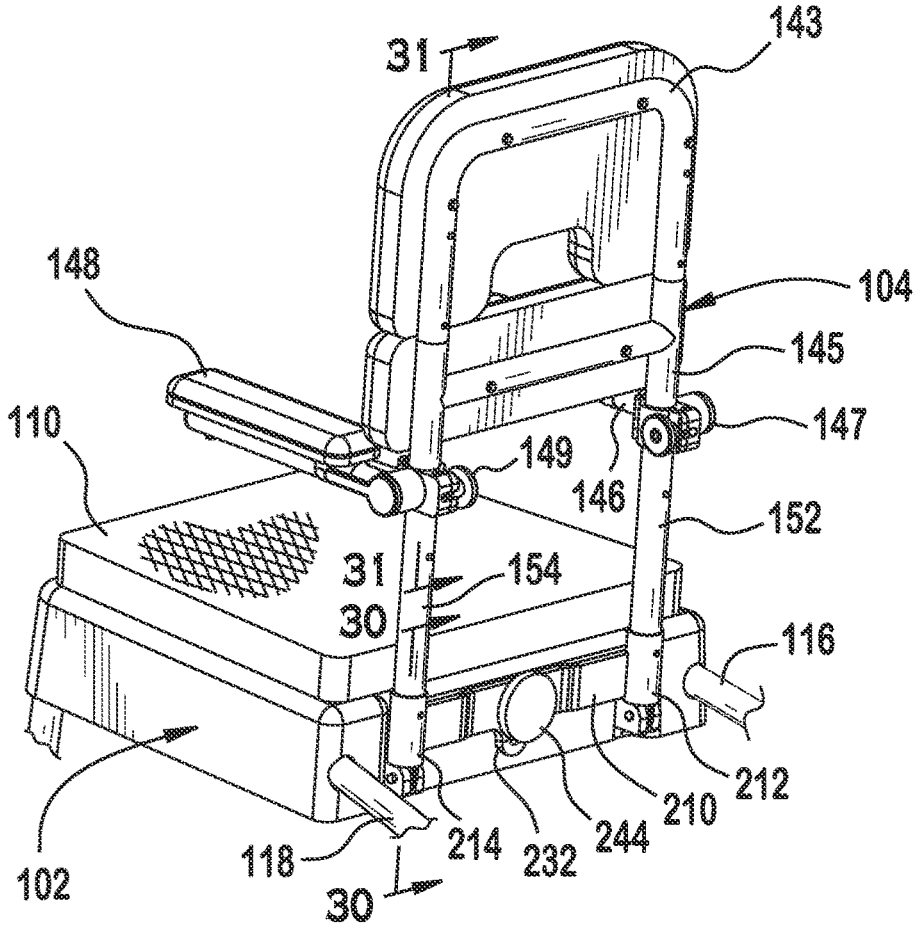
FIG. 29 is a rear left perspective view of the chair 100 of a preferred embodiment, with the back support assembly 104 in the fully upright position, preferably 85-degrees relative to the cushion support structure 108. The figure shows how the first and second rear legs 116, 118 preferably pass through the first and second lateral ends 222, 226 of the rear panel 130. The figure further demonstrates that the knob 244 is preferably positioned roughly between the first and second post receptacles 212, 214 and under the center of the back rest cushion 140, including the head rest 142 and the cushion bar 144.
Figure 30:
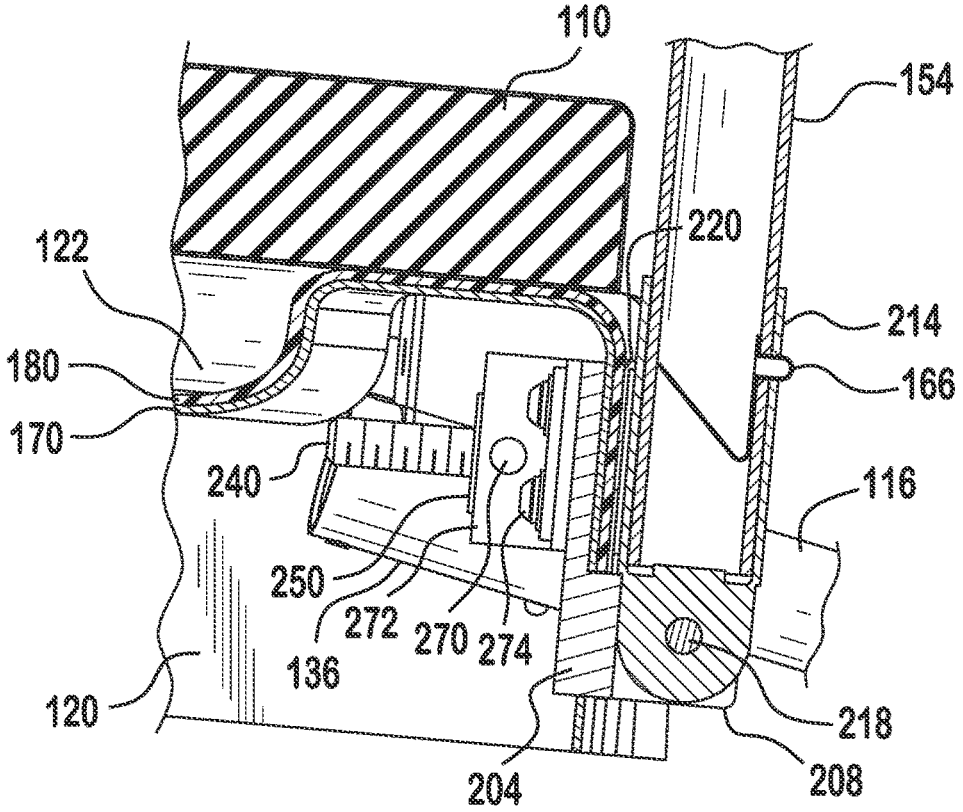
FIG. 30 is partial cross-sectional view of the seat frame 102 and back support assembly 104 of a preferred embodiment as taken along lines 30-30 of FIG. 29. The figure shows that the second post receptacle 214 can receive the second post 154 therein and is configured to rotate about a second post hinge 218 in the second mounting boss 208. The second post 154 may include a locking pin 166 to retain it within the second post receptacle 214. Those of ordinary skill in the art will appreciate from this disclosure that the first post receptacle 212 and first post 152 may be configured in a similar manner, with the first post 152 being held in the first post receptacle 212 (and preferably retained therein by a locking pin 166), and the first post receptacle 212 may rotate about a first post hinge 216 positioned through the first mounting boss 206.
Figure 31:
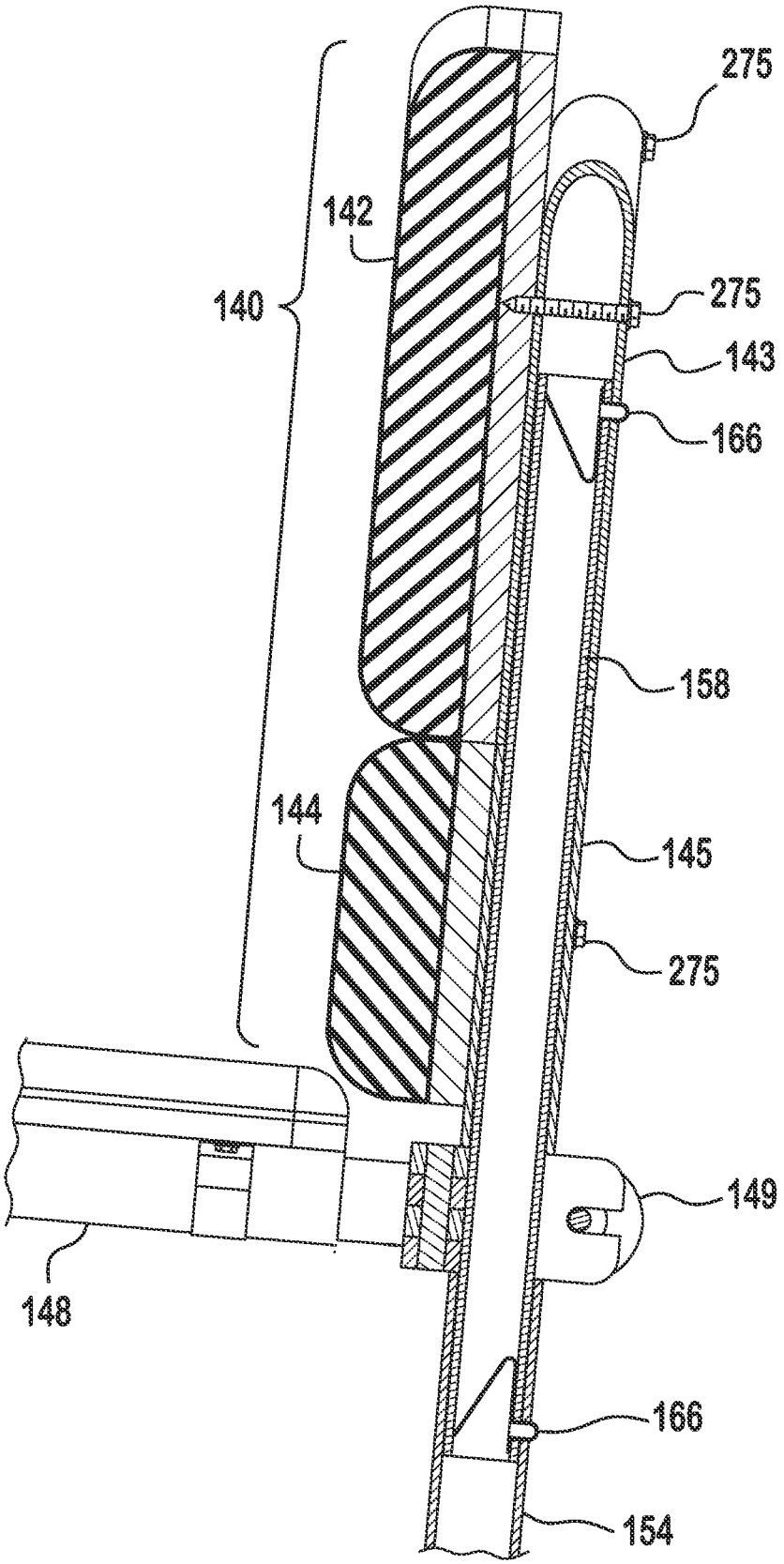
FIG. 31 is partial cross-sectional view of the back support assembly 104 of a preferred embodiment as taken along lines 31-31 of FIG. 29. The figure shows that fasteners 275 may connect the head rest cushion 142 to a head rest backing 143, a configuration of tubes which may be slid over the first and second top posts 156, 158. Fasteners 275 may also hold the cushion bar 144 to a cushion bar backing 145, a configuration of tubes which maybe slid over the first and second top posts 156, 158 and/or the first and second posts 152, 154. Locking pins 166 contained within the first post 152, second post 154, first top post 156, and/or second top post 158 may be used to lock the head rest backing 143 and the cushion bar backing 145 at a desired location upon said posts 152, 154, 156, 158.
Figure 32:
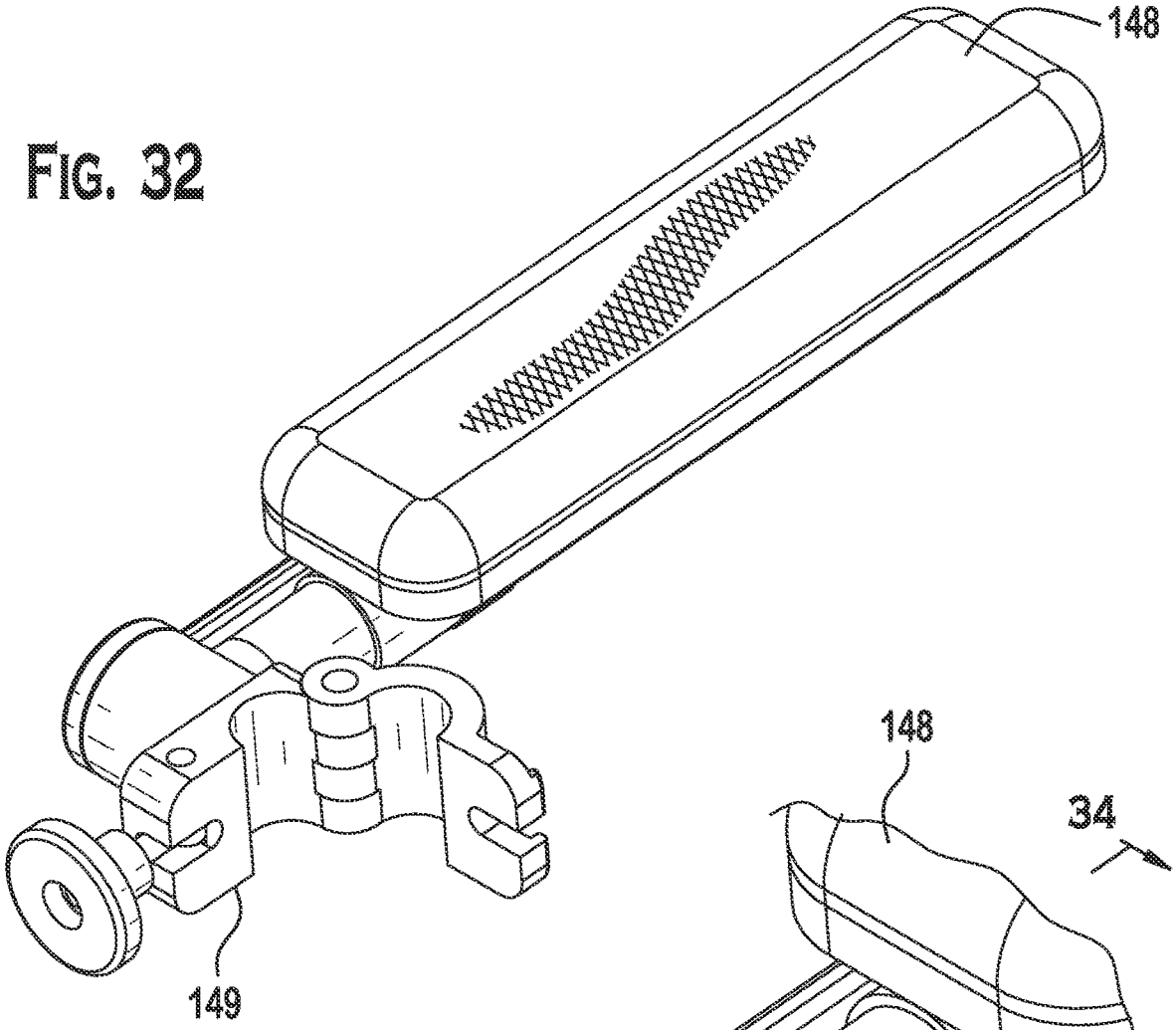
FIG. 32 is a rear right perspective view of the second arm rest 148 and second pivoting bracket 149 of a preferred embodiment, demonstrating that the second arm rest 148 may include an arm bar and an arm rest cushion. The arm rest cushion may be connected to the arm bar, which in turn may be connected to the second pivoting bracket 149 via a pivot socket. The second pivoting bracket 149 may include a wrapping segment and a lock, to allow it to detachably connect to any portion of the second post 154. Those of ordinary skill in the art will appreciate from this disclosure that the first arm rest 146 and first pivoting bracket 147 may be provided in a mirror image configuration to connect to the first post 152. Alternatively, the first arm rest 146 and second arm rest 148 may be identical, interchangeable pieces, capable of connecting to either of the first or second post 152, 154 and use, provided that the arm rest cushion can be connected to face upward on either the left or right side of the first or second pivoting bracket 147, 149.
Figure 33:
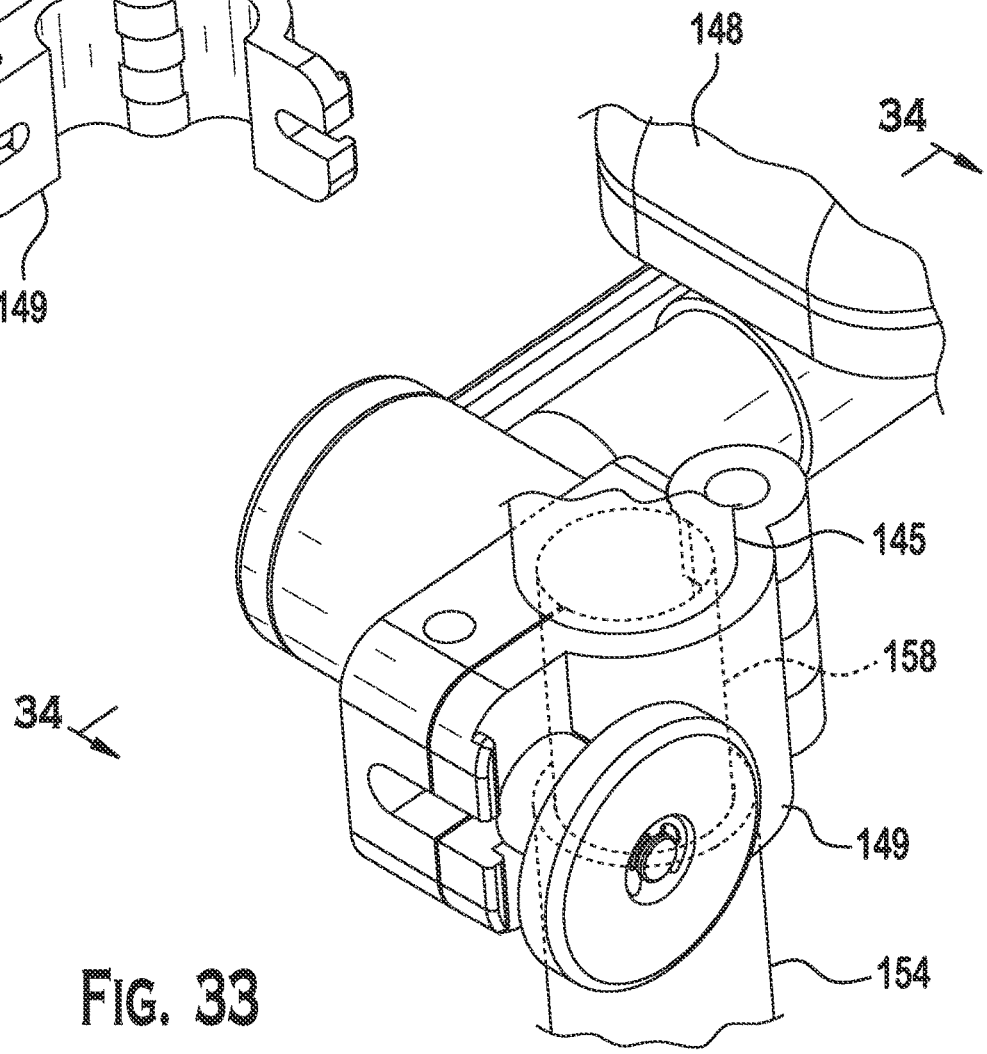
FIG. 33 is a partial, enhanced view of the second arm rest 148 and second pivoting bracket 149 of FIG. 32, showing how the second pivoting bracket 149 may connect to the second post 154. Those of ordinary skill in the art will appreciate from this disclosure that the first pivoting bracket 157 may connect to the first post 152 in a similar manner.
Figure 34:
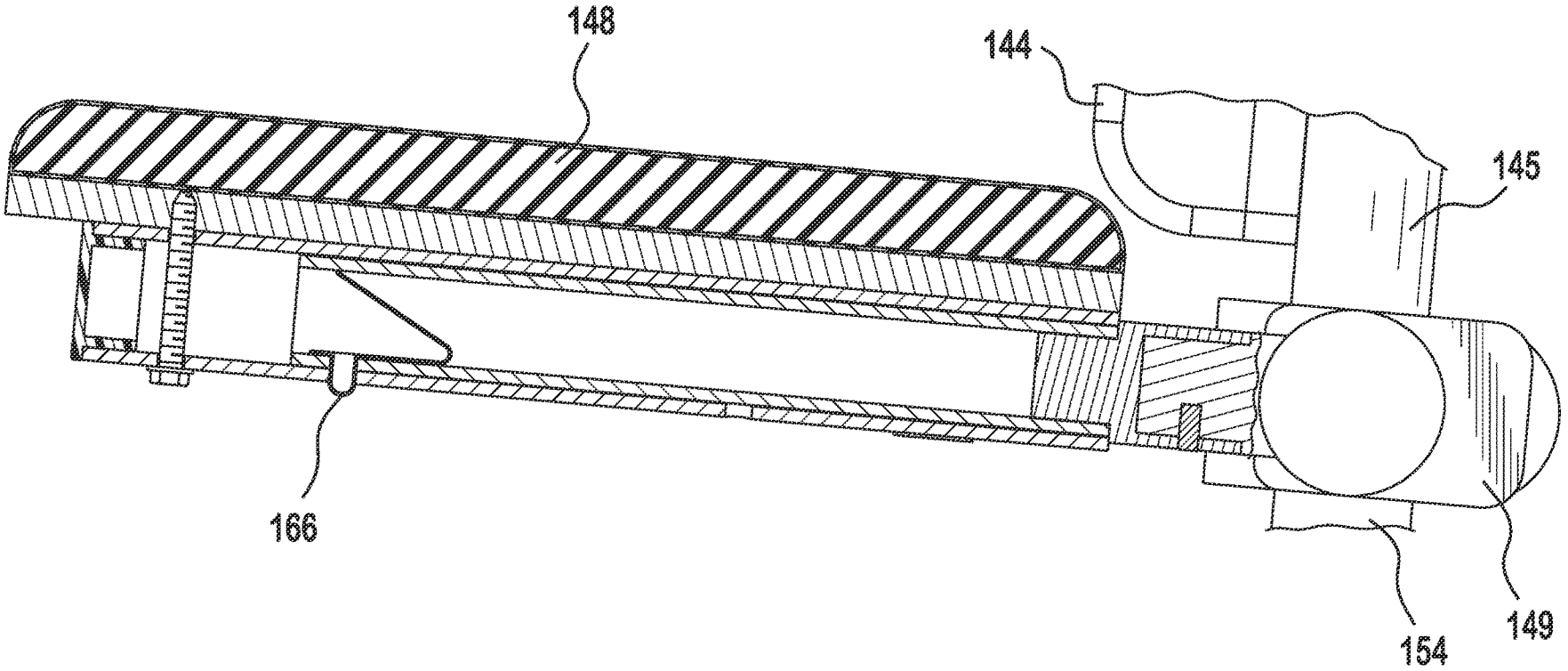
FIG. 34 is partial cross-sectional view of the second arm rest 148 and second pivoting bracket 149 of FIG. 33 as taken along lines 34-34 of FIG. 33. The figure shows that, in some preferred embodiments, the arm rest cushion may have a sleeve that slides over the arm Fbar and may be held in place by a locking pin 166. In other preferred embodiments, the arm rest cushion may be permanently connected to the arm bar such that that second arm rest 148 and second pivoting bracket 149 are one fully connected member. Those of ordinary skill in the art will appreciate from this disclosure that the first arm rest 156 and first pivoting bracket 157 may be configured in a mirror image manner to the second arm rest 158 and second pivoting bracket 159.
Figure 35:
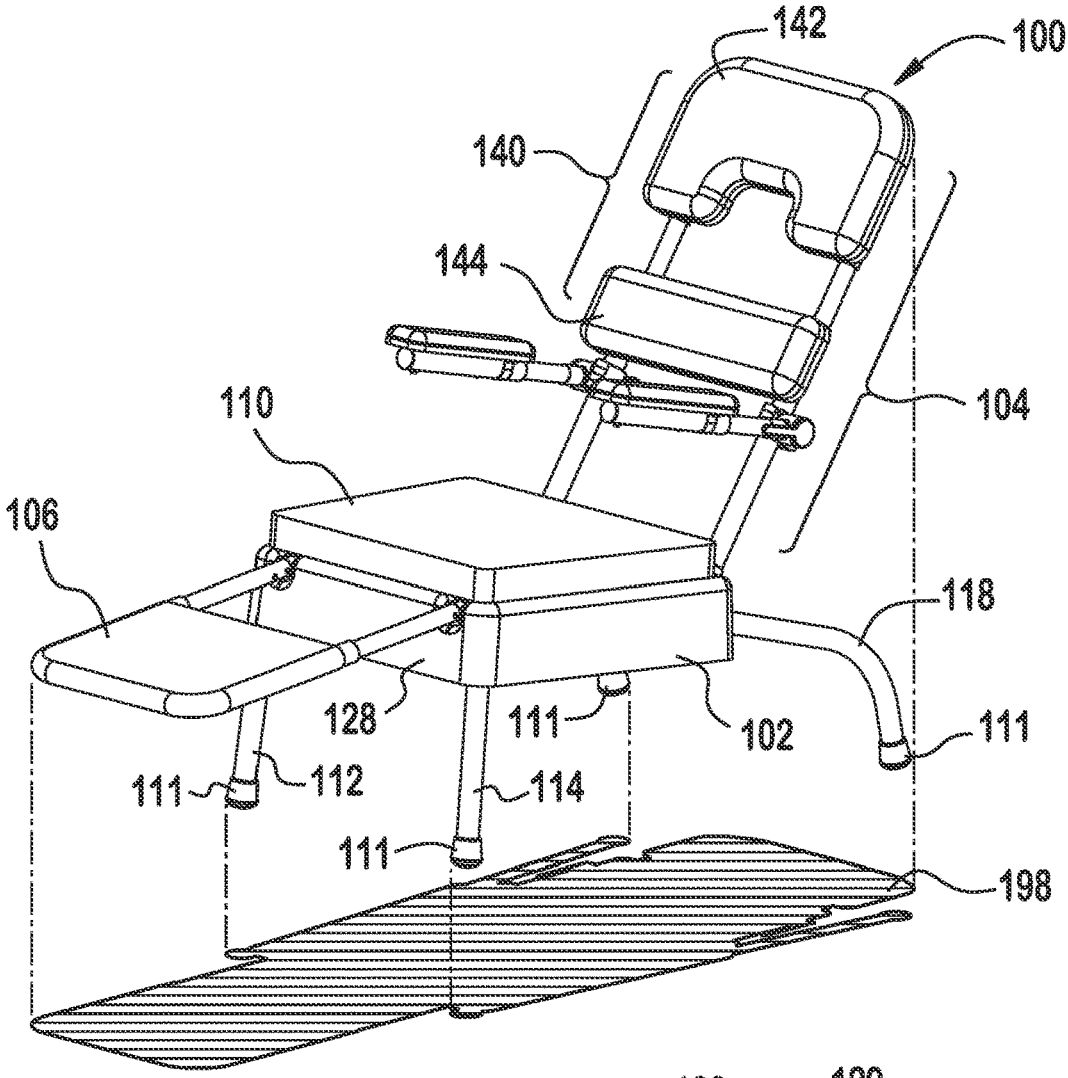
FIG. 35 is a front left perspective view of the chair 100 of a preferred embodiment in the second, use configuration with the back support assembly 104 fully reclined and the foot support frame 106 in the second, foot support use position and fully extended. The chair 100 in such a configuration may form a second footprint 198, the overall area on a support surface 190 occupied by the chair 100.
Figure 36:
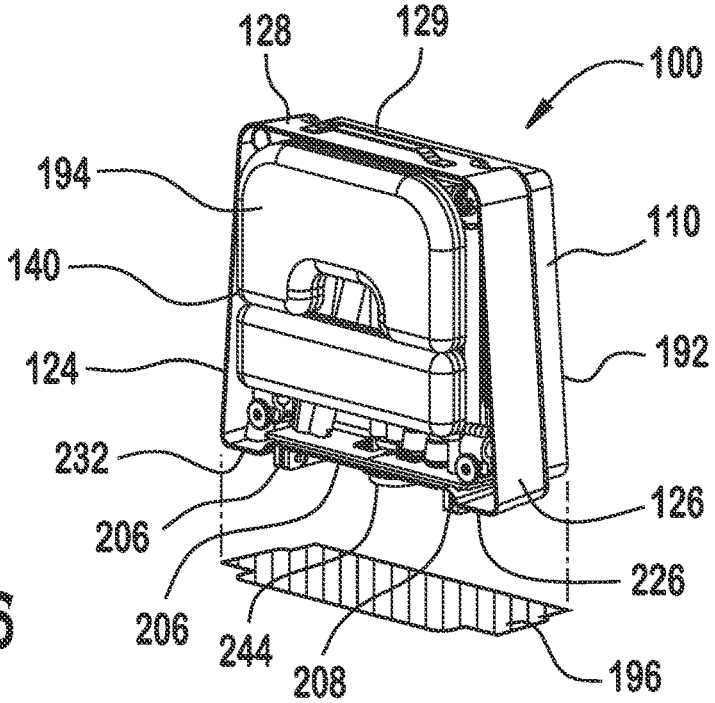
FIG. 36 is a rear left perspective view of the chair 100 of a preferred embodiment in the first, storage configuration. The back support assembly 104 is partially contained within the bottom cavity 120 and the foot support frame 106 is in the first, foot support storage position within the upper well 122 and under the seat cushion 110. When in the first, storage configuration and positioned with the front panel 128 (and thus the handle 129) facing upward and positioned farthest from the support surface 190 compared to any other portion of the seat frame 102, the chair 100 forms a first footprint 196. The first footprint 196 is preferably the overall area on the support surface 190 the chair 100 may occupy when in the first, storage configuration.
Figure 37:
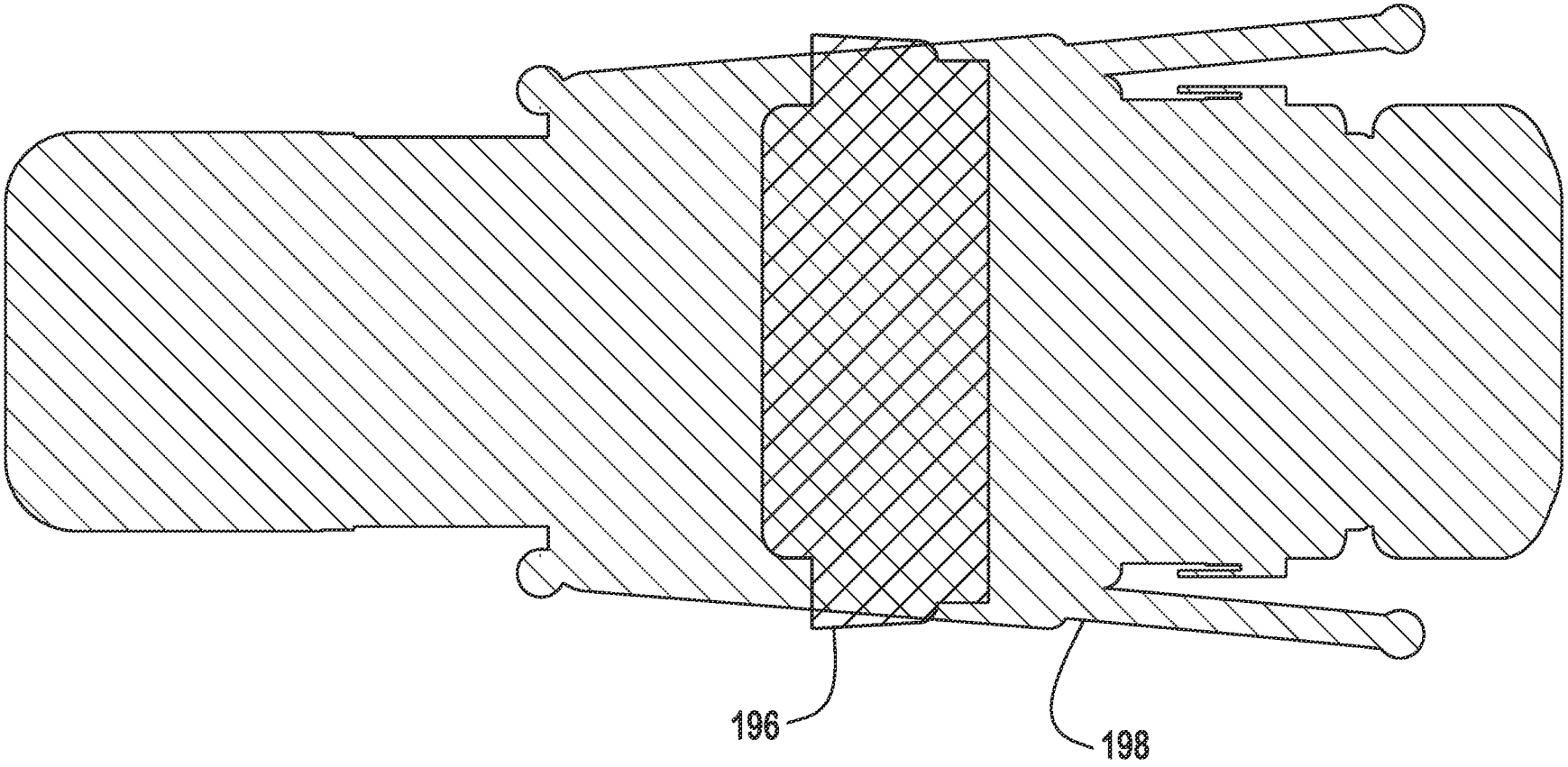
FIG. 37 is a top plan view of the first footprint 196 and second footprint 198 showing that, in some preferred embodiments, the area of the second footprint 198 may be at least five times greater than the area of the first footprint 196. In other preferred embodiments, the area of the second footprint 198 may be at least six times greater than the area of the first footprint 196. In another preferred embodiments, the area of the first footprint 196 may be approximately 184.507 square inches (or 468.648 square centimeters), and the area of the second footprint 198 may be approximately 1125.168 square inches (or 2,857.927 square centimeters). In this embodiment the area of the second footprint 198 is a little more than six times greater than the area of the first footprint 196. Those of ordinary skill in the art will appreciate that the chair 100 and the first and second footprints 196, 198 need not conform to these ratios or measurements, and may include elements which may make the determination of the first and second footprints 196, 198 and/or the measurements of their respective areas impossible. This may include additional cushions, detachable umbrellas, and more.

Referring to FIGS. 19 and 20, the seat frame 102 preferably defines a cushion support surface 108 configured to detachably secure a seat cushion 110 thereon. Preferably, the cushion support surface 108 and the seat cushion 110 may include snaps, zippers, or hook-an-loop fastener configured to allow the seat cushion 110 to be detachably affixed to the cushion support surface 108. When the chair 100 is in the first, storage configuration, the seat cushion 110 may form a first major surface 192 (or one of the two faces with the largest area) of the roughly rectangular prismatic chair 100. When the chair is in the second, use configuration, the chair 100 is preferably configured such that the seat cushion 110 is positioned at an angle relative to the support surface 192. In other words, it is preferred that the seat cushion 110 is not parallel to the support surface 190. Instead, it is preferred that the seat cushion 110 is held at an angle because the rear panel 130 of the seat frame 102 is held lower (or closer to the support surface 190) than the front panel 128. In this preferred configuration, it is preferred that the angle of the seat cushion 110 is within 30-degrees within true parallel to the support surface 190. More preferably, it is preferred that the angle of the seat cushion 110 is within 15-degrees within true parallel to the support surface 190.

When the chair 100 is in the first, storage configuration, the rear panel 130 preferably faces the support surface 190, the front panel 128 is positioned farthest from the support surface 190, the first side panel 124 and second side panel 126 form the minor (or smaller) side surfaces of the chair 100, and the seat cushion 110 and back rest cushion 140 form the first major surface 192 and second major surface 194, respectively, (the two faces with the largest area) of the roughly rectangular prismatic chair 100.

Referring to FIGS. 1-6 and 35-37, the chair 100 in the second, use configuration preferably has multiple sub-configurations within the second, use configuration. The sub-configurations are preferably differentiated by the angular position of the back support assembly 104 relative to the seat frame 102, and in some preferred embodiments, specifically relative to the cushion support surface 108. Other preferred sub-configurations may be differentiated by the positioning of the foot support frame 106, which will be discussed in greater detail below.

In the preferred configurations, the seat frame 102 is preferably elevated from the support surface 190 by four legs connected to the seat frame 102 via four receptacles positioned within the bottom cavity 120. The first front leg 112 is preferably detachably positionable in a first front leg receptacle 132 located in the front right corner of the bottom cavity. 120. The second front leg 114 is preferably detachably positionable in a second front leg receptacle 134 located in the front left corner of the bottom cavity 120. The first and second front legs 112, 114 are preferable straight, plastic or metal cylinders configured to be held at an angle, rather than perpendicular to, the support surface 190. Rubber or plastic caps 111 may positioned on the ends of the first and second front legs 112, 114 to facilitate this angular configuration.

Referring to FIGS. 6 and 13-18, the first rear leg 116 is preferably detachably positionable in a first rear leg receptacle 136 preferably positioned in the rear right corner of the bottom cavity 120, with the first rear leg 116 preferably passing through the first lateral end 222 rear panel 130 to enter the first rear leg receptacle 136. The second rear leg 118 is preferably detachably positionable in a second rear leg receptacle 138 preferably positioned in the left right corner of the bottom cavity 120, with the second rear leg 118 preferably passing through the second lateral end 226 of the rear panel 130 to enter the second rear leg receptacle 138. The first and second rear legs 116, 118 are preferably cylindrical metal or plastic members. Unlike the first and second front legs 112, 114, the first and second rear legs 116, 118 preferably extend in a curvilinear fashion such that each extends through the rear panel 130 to connect to a first rear leg receptacle 136 and a second rear leg receptacle 138, respectively. The first rear leg 116 and second rear leg 118 are therefore preferably curved members and are generally splayed outward. This preferred configuration places a majority of the weight of the chair 100 on the first and second rear legs 116, 118 by positioning the seat frame 102 at an angle relative to the support surface 190. The seat frame 102 is preferably slanted generally downward toward the first and second rear legs 116, 118 to enhance the stability of the chair 100 by placing the center of gravity of the chair 100 along a portion of the first and second rear legs 116, 118. Like the first and second front legs 112, 114, the first and second rear legs 116, 118 preferably have caps 111 on their ends, to keep the chair 100 from sliding on the support surface 190.

The first rear leg 116 preferably defines a first rear guide slot 117 on an opposite end of the cap 111, an opening configured to engage a first key element 137 in the first rear leg receptacle 136 to keep the first rear leg 116 from spinning when positioned therein. The second rear leg 118 preferably defines a second rear guide slot 119 on an opposite end of the cap 111, an opening configured to engage a second key element 139 in the second rear leg receptacle 138 to keep the second rear leg 118 from spinning when positioned therein. The first rear leg receptacle 136 and the second rear leg receptacle 138 each include a key element 137, 139 to prevent rotation of the first rear leg 116 and the second rear leg 118 therein. This preferred configuration ensured that the first and second rear legs 116, 118 are retained in the preferred splayed position.

Referring to FIGS. 3-6 and 11-17, while the four legs 112, 114, 116, and 118 are preferably positionable in the four receptacles 132, 134, 136, and 138, respectively, when the chair is in the second, use configuration, the four legs 112, 114, 116, and 118 are preferably configured to be removable from the four receptacles 132, 134, 136, and 138, respectively, such that the legs 112, 114, 116, and 118 can be stored wholly within the bottom cavity 120 when the chair 100 is in the first, storage configuration.

The seat frame is preferably generally formed of two layers—a chair pan 170 and a polymer layer 180. The chair pan 170 is preferably formed of metal and provides stability and shape to the chair 100, with the chair pan 170 further defining the bottom cavity 120. The polymer layer 180 is preferably a plastic or rubber layer that covers the top of the chair pan 170, defining the cushion support surface 108 onto which the seat cushion 110 may be detachably affixed, preferably via snaps or hook-and-loop fastener. The polymer layer may further define an upper well 122 and a platform 123 for storing the foot support frame 106. The chair pan 170 preferably defines a plurality of mounting slots to retain the receptacles within the bottom chamber 120, preferably configured, along with welds, to hold the receptacles in place. In other words, the chair pan 170 preferably defines at least one first front mounting slot 262 proximate to the front right corner of the bottom cavity 120, at least one second front mounting slot 264 proximate to the front left corner of the bottom cavity 120, at least one first rear mounting slot 266 proximate to the rear right corner of the bottom cavity 120, and at least one second rear mounting slot 268 proximate to the rear left corner of the bottom cavity 120. The first front leg receptacle 132 preferably forms at least one first front mounting flange 252 configured to be positioned within a corresponding first front mounting slot 262 to secure the position of the first front leg receptacle 132 within the bottom cavity 120. The second front leg receptacle 134 preferably forms at least one second front mounting flange 254 configured to be positioned within a corresponding second front mounting slot 264 to secure the position of the second front leg receptacle 134 within the bottom cavity 120. The first rear leg receptacle 136 preferably forms at least one first rear mounting flange 256 configured to be positioned within a corresponding first rear mounting slot 266 to secure the position of the first rear leg receptacle 136 within the bottom cavity 120. The second rear leg receptacle 138 preferably forms at least one second rear mounting flange 258 configured to be positioned within a corresponding second rear mounting slot 268 to secure the position of the second rear leg receptacle 138 within the bottom cavity 120. Those of ordinary skill in the art will appreciate from this disclosure that the chair pan 170 and four leg receptacles 132, 134, 136, 138 may be connected by any suitable means, including any number of flanges, joints, welds, or other fasteners.

As discussed above, the sub-configurations of the second, use configuration are generally differentiated by the angular positions of the back support assembly 104 relative to the cushion support surface 108 of the seat frame 102. The back support assembly 104 is preferably modular, such that it can be disassembled and positioned at least partially within the bottom cavity 120 of the seat frame 102 when the chair 100 is in the first, storage configuration. When the chair 100 is in the first, use configuration, the back support assembly 104 is preferably positioned outside of the seat frame 102, being connected thereto along a recliner mechanism 200.

Referring to FIGS. 19-30, the back support assembly 104 preferably has multiple possible positions when the chair 100 is in the second, use configuration. On one end of this spectrum, the back support assembly 104 preferably has a fully upright position, wherein the back support assembly 104 is in its least reclined angular position. In such a position, the back support assembly 104 is preferably held between 90-degrees and 100-degrees relative to the cushion support structure 108. Most preferably, when the back support assembly 104 is in the fully upright position, the back support assembly 104 is preferably held at 95-degrees relative to the cushion support structure 108. On the other end of the spectrum, the back support assembly 104 preferably has a fully reclined position, wherein the back support assembly 104 is reclined as far as the recliner mechanism 200 will allow. In such a position, the back support assembly 104 is preferably held between 120-degrees and 175-degrees relative to the cushion support structure 108. Most preferably, when the back support assembly 104 is in the fully upright position, the back support assembly 104 is preferably held at 135-degrees relative to the cushion support structure 108. The back support assembly 104 is preferably positionable at any angular position between the fully upright and fully reclined positions. This progressive reclining is preferably provided by the preferred embodiments of the recliner mechanism 200.

As discussed above, preferred embodiments of the chair 100 preferably include a seat frame 102 having a rear panel 130 on its rear side. Rather than being generally flat, like the first and second side panels 124, 126 or front panel 128, the rear panel 130 preferably defines a recess 230 between the first and second lateral ends 222, 226 of the rear panel 230. The recess 230 is preferably formed by first and second oblique walls 224, 228 positioned between respective first and second lateral ends 222, 226 and a central face 220. The central face 220 is preferably configured such that it occupies a vertical plane closer to the geometric center of the seat frame 102 than a vertical plane occupied by the first and second lateral ends 222, 226. The recess 230 may be configured to allow the recliner mechanism 200 to be positioned partially or fully within the recess 230 to reduce the amount of the second footprint 198 the recliner mechanism 200 might define.

The first and second lateral ends 222, 226 preferably define the farthest rearward projection of the seat frame 102, and are preferably positioned on the same vertical place as one another. This may allow the chair 100 to be position on the first and second lateral ends 222, 226 when placed on a support surface 190 when the chair is in the first, storage position, The first and second lateral ends 222, 226 may include additional elements to help the chair 100 to rest on the first and second lateral ends 222, 226 when in the first, storage position, including weights positioned in or on the first and/or second lateral ends 222, 226. Additionally, rubber bumpers or footers may be positioned on the outer faces of the first and second lateral ends 222, 226 to provide enhanced cushioning or slip resistance to the first and second lateral ends 222, 226. The first and second lateral ends 222, 226 preferably further include end openings to allow the first and second rear legs 116, 118 respectively to pass therethrough to engage the respective first and second rear leg receptacles 136, 138 within the bottom cavity 120.

The first lateral end 222 is preferably spaced apart from the central face 220 by a first oblique wall 224, and the second lateral end 226 is preferably spaced apart from the central face 220 by a second oblique wall 228. The first and second oblique walls 224, 228 are preferably curved portions of the rear panel 130 which separate the first and second lateral ends 222, 226 from the central face 220 to allow the central face 220 to be held closer to the geometric center of the seat frame 102 than the first and second lateral ends 222, 226. When viewed in cross section and planar parallel to the cushion support surface 108, the oblique walls 224, 228 preferably form an angle of between approximately 30-degrees and approximately 60-degrees relative to the lateral ends 222, 226. More preferably, when viewed in cross section and planar parallel to the cushion support surface 108, the oblique walls 224, 228 may form an angle of approximately 45-degrees.

The preferred configurations of the first and second oblique walls 224, 228 and the recliner mechanism 200 are preferably designed to enhance the ability of the seat frame 102 to resist deformation caused by a torque resulting from pressure on the back support assembly 108. Specifically, the angular configuration of the first and second oblique walls 224, 228 may allow the seat frame 102 to better withstand pressure which has been transferred onto first and second mounting bosses 206, 208 of the recliner mechanism 200. The rear panel 130 preferably has an inner surface 202 proximate to the bottom cavity 120. A reinforcement plate 204 is preferably disposed on the inner surface 202 of the rear panel 130. Preferably being formed of a suitably strong, rigid, and rust or corrosion resistant metal such as stainless steel, the reinforcement plate 204 is preferably configured to receive the entire weight of the back support assembly 104 and the weight of a user of the chair 100. Those of ordinary skill in the art will appreciate from this disclosure that the reinforcement plate 204 may be formed any suitably strong material without exceeding the scope of this disclosure. In some preferred embodiments, the thickness of the reinforcement plate 204 may be dictated as much by the weight of the reinforcement plate 204 rather than merely by considerations of its strength. This is because heavier metal may increase the ability of the chair 100 to stand with the front panel 124 facing upward when the chair 100 is in the first, storage position and placed on a support surface 190. The reinforcement plate 204 preferably includes a first mounting boss 206 and a second mounting boss 208, each of which extend through the rear panel 130 and each of which are configured to pivotally connect to a post receptacle 212, 214 of the back support assembly 108. The first mounting boss 206 preferably passes through a portion of the central face 220 near the first oblique wall 224 (which may be referred to as the first boss housing) and the second mounting boss 208 preferably passes through a portion of the central face 220 near the second oblique wall 228 (which may be referred to as the second boss housing). This configuration ensures that laterally outward pressure on either of the first mounting boss 206 or second mounting boss 208 is transferred to either of the first oblique wall 224 or second oblique wall 228. This can help prevent such pressure from deforming, bending, cracking, or otherwise breaking the rear panel 130, the first or second mounting bosses 206, 208, and/or the mounting screws 274, which may connect the reinforcement plate 204 to the inner surface 202 of the rear panel 130.

The reinforcement plate 204 is preferably secured in place along the inner surface 202 of the rear panel 130 by one or more connective features. First, along its inner side, the reinforcement plate 130 preferably has two mounting brackets 272 positioned thereon and secured thereto by mounting screws 274. These mounting screws 274 may pass through the reinforcement plate 130 and the chair pan 170 but not the polymer layer, securing the reinforcement panel 204 to chair pan 170 without passing fully through the seat frame 102. Second, the first boss housing and the second boss housing may be configured such that the first mounting boss 206 and second mounting boss 208 can barely fit through the respective boss housings in the rear panel 130, and thus are retained therein by friction. The first and second mounting bosses 206, 208 may also have retention pins which may be inserted therethrough once they have passed through the rear panel 130, to detachably secure them in place. Third, a plurality of welds 178 may be used to secure the reinforcement panel 204 to the chair pan 170. Those of ordinary skill in the art will appreciate from this disclosure that any suitable means for connecting the reinforcement plate 204 to the rear panel 130 may be used without exceeding the scope of this disclosure.

In some preferred embodiments, when the chair 100 is in the first, storage configuration and positioned on a support surface 190, the chair 100 may rest directly on the first and second lateral ends 222, 226 of the rear panel 130. In other preferred embodiments, the chair 100 may rest on the first mounting boss 206 and the second mounting boss 208. One or more rubber bumpers or footers may be positioned on the rear sides of the first mounting boss 206 and second mounting boss 208 such that the footers may be positioned between the support surface 190 and the first and second mounting bosses 206, 208. This may make the chair 100 more slip resistance and may help to keep the chair 100 from damaging the support surface 190 or other objects during storage.

The first post receptacle 212 is preferably configured to receive the first post 152 and may include a hole for a locking pin 166 within the first post 152 to detachably secure the first post 152 within the first post receptacle 212. The second post receptacle 214 is preferably configured to receive the second post 154 and may include a hole for a locking pin 166 within the second post 154 to detachably secure the second post 154 within the second post receptacle 214. The first post receptacle 212 is preferably configured to rotate about a first post hinge 216 in the first mounting boss 206, and the second post receptacle 214 is preferably configured to rotate about a second post hinge 218 in the second mounting boss 208. The first post receptacle 212 and the second post receptacle 241 are preferably connected by a cross-beam 210, a beam which is preferably configured to ensure that the first post receptacle 212 and second post receptacle 214 rotate roughly in unison. The rotation of the first post receptacle 212 and second post receptacle 214 may define a first rotation axis for the recliner mechanism 200. The cross-beam 210 is preferably positioned generally behind the central face 220 and may scalloped in a manner complementary to the recess 230 such that the cross-beam 210 may fully or partially nest within the recess 230 in the outer surface of the rear panel 130 created by the first and second oblique walls 222, 226. To phrase it another way, it is preferred that a central portion of the cross-beam 210 is closer to the rear panel 130 than the portions of the cross-beam 210 closest to the first post receptacle 212 and second post receptacle 214. In some preferred embodiments, the cross-beam 210 may be formed such that the central portion of the cross-beam 210 is also higher (relative to the support surface 190 when the chair 100 is in the second, use configuration) than the portions closest to the first post receptacle 212 and second post receptacle 214.

The cross-beam 210 preferably further includes a guard 232 extending downward from the geometric center thereof. The guard 232 is preferably an oblong extension configured to abut the rear panel 130 when the cross-beam 210 rotates (or tilts) to a predetermined position along the first rotation axis. The lower edge of the guard 232 is preferably beveled, with this beveled edge 234 being configured to abut the rear panel 130 while holding the cross-beam 210 in an angular position. The beveled edge 234 may be formed of, or covered by, rubber or soft plastic to prevent damage to either of the guard 232 or rear panel 130 caused by contact between these elements.

The cross-beam 210 preferably defines a first elongated cut-out 236, an oval-shape hole running vertically along a central portion of the cross-beam 210 and a portion of the guard 232. When the back support assembly 104 is in the fully upright position, the first elongated cut-out 236 preferably aligns with a second elongated cut-out 238, an opening of similar size and shape defined by a combination of the rear panel 130 and the reinforcement panel 204. Those of ordinary skill in the art will appreciate from this disclosure that the first elongated cut-out 236 and second elongated cut-out 238 need not be of identical shapes or sizes, but preferably roughly align. When the back support assembly is fully upright, the first elongated cut-out and second elongated cut-out preferably align within 1 inch (or 2.54 centimeters) of true alignment.

The first and second-elongated cut-outs 236, 238 are preferably sufficient wide such that a threaded rod 240 of the preferred embodiment may pass therethrough. The threaded rod 240 is preferably a metal or steel screw having threads along its surface. The threaded rod 240 preferably has a first axial end 242 and a second axial end 246, with the first axial end 242 being connected to a knob 244 and positioned on the outside of the cross-beam 210 (that is, on a side of the cross-beam 210 opposite from the seat frame 102) and the second axial end 246 being located within the bottom cavity 120. The knob 244 is preferably positioned on the first axial end 242 of the threaded rod 240 and is preferably configured to facilitate the rotation of the threaded rod 240 to adjust the angle of the back support assembly 104 relative to the seat frame 102 by a user. The threaded rod 240 is preferably positioned through the first elongated cut-out 236 and the second elongated cut-out 238 and engaged with a rotation guide 250 as it passes therethrough into the bottom cavity 120 such that the second axial end 246 is located within the seat frame 102. The threaded rod is preferably between 2 and 10 inches (between 5.08 and 25.40 centimeters) in length, depending on the preferred configurations of the rear panel 130, reinforcement plate 204, and cross-beam 210. Those of ordinary skill in the art will appreciate from this disclosure that the threaded rod 240 may be of any suitable length without exceeding the scope of this disclosure.

The rotation guide 250 is preferably positioned on the reinforcement plate 204 and may be secured thereto by mounting brackets 272. The mounting brackets 272 may themselves be secured to the reinforcement plate by a plurality of mounting screws 274 and/or welds 178. The rotation guide 250 preferably has two rotation guide lateral sides proximate to the mounting brackets 272, a flat inner face, and a cam surface 248 facing generally toward the reinforcement plate 204. The rotation guide 250 preferably further has a threaded bore through its center, passing through both the cam surface 248 and the flat inner face. This threaded bore is preferably positioned proximate to the geometric center of the rotation guide 250, and the rotation guide 250 is preferably positioned within the mounting brackets 272 such that the threaded bore is roughly aligned with the center of both the first and second elongated cut-outs 236, 238 when the back rest assembly 106 is in the fully upright position. The mounting brackets preferably include a first rotation guide pin 260 on one lateral side of the rotation guide 250 and a second rotation guide pin 270 on the opposite lateral side of the rotation guide 250. Such a configuration may allow the rotation guide 250 to rotate upward and downward while the threaded rod 250 is positioned within the rotation guide 150. This configuration ensures that the rotation guide 250 is rotatably supported about a second rotation axis which is spaced from the reinforcement plate 204, with this second rotation axis being parallel to the first rotation axis. The rotation guide 250 preferably has a cam surface 248 on one axial end, toward the rear panel 130 and opposite the flat inner face of the rotation guide 250, to allow the rotation guide 250 to rotate vertically along a preferred path, but being stopped by the right angles where the cam surface 248 meets the flat inner face abutting the reinforcement plate 204 when the end of the desired path of rotation is reached. The cam surface 248 preferably has a curved face, as this configuration may support smooth angular adjustments of the threaded rod 240 relative to the reinforcement plate 204, as the curves both avoid contact between the rotation guide 250 and the reinforcement plate 204 when possible and can provide for less friction (which might impede movement) if contact does occur.

The recliner mechanism 200 generally relies on the rotation of the threaded rod 240 to achieve progressive adjustment of the angular position of the back support assembly 104 relative to the cushion support surface 108 of the seat frame 102. In order to secure the back support assembly 104 is in the fully upright position, preferably 95-degrees relative to the cushion support structure 108, the threaded rod 240 must be fed through the first and second elongated cut-outs 236, 238 and then must engage the threaded bore of the rotation guide 250. Preferably, by turning the knob 244 clockwise, the threads of the threaded rod 240 will pull the second axial end 270 of the threaded rod 240 fully through the rotation guide 250 until either the second axial end 270 abuts a portion of the seat frame 102 and/or the first and second post receptacles 212, 214 abut the rear panel 130. To recline the back support assembly 106, the knob 244 may be turned counterclockwise (although those of ordinary skill in the art will appreciate from this disclosure that configuration of the threads on the threaded rod 240 and the threaded bore of the rotation guide 250 may alternately be configured to allow reclining when the the knob 244 is turned clockwise instead, and reversed in the opposite manner). As the knob 244 is turned, the locations of the rotation guide 250 and rear panel 130 along the threaded rod 240 will change, while the location of the cross-beam 210 along the threaded rod 240 does not. Rather, the cross-beam 210 moves away from the rear panel 130 and the threaded rod 240 rotates (with its rotation guided by the rotation guide 250) such that the first axial end 242 moves downward. In other words, when the back support assembly 106 is fully upright, the threaded rod 240 is held roughly parallel to the cushion support surface 108. However, when the back support assembly 106 is fully reclined, the threaded rod 240 is preferably positioned between 35- and 75-degrees relative to the cushion support surface 108.

When the back support assembly 104 is fully reclined, the back support assembly 104 is preferably held at an angle relative to the cushion support surface 108, preferably between 130- and 170-degrees relative to the seat support surface 108. The rotation guide 250 is preferably configured such that, when the threaded rod 240 is at a predetermined angle relative to the rear panel 230 and/or cushion support surface 108 to define maximum reclination, the rotation guide 250 abuts the reinforcement panel 204 to prevent further rotation of the back support assembly 104 away from the seat frame 102. Similarly, when the fully reclined position is reached, the guard 232, and specifically, the beveled edge 234 of the guard 232, may abut the rear panel 230 prior to the knob 244 contacting the rear panel 130. This is to prevent contact between the knob 244 and the rear panel 130, which might damage the knob 244 and/or the threaded rod 240. The angle of maximum reclination is preferably configured to avoid contact between any portion of the threaded rod 240 with the bottom of the first elongated cut-out 236 or top of the second elongated cut-out 238, as this might cause damage to these elements or hinder additional rotation.

In other preferred embodiments, the beveled edge 234 of the guard 232 may not abut the rear panel 130 when the preferred angle is reached. Rather, in these preferred embodiments the guard 232 and beveled edge 234 may only halt rotation at slightly more than (or within 10-degrees of) the maximum angle of reclination of the back support assembly 104, to avoid damaging the guard 232 due to overuse. Jostling the back support assembly 104 or placing excessive weight thereon may cause the guard 232 and beveled edge 234 to abut the rear panel 130, but regular use of the chair 100 would not.

Referring to FIGS. 19-20 and 29-31, in some preferred embodiments, the back support assembly 104 may include first 152 and second posts 154, generally hollow cylindrical bars configured to connect to the first and second post receptacles 212, 214, connecting the back support assembly 104 to the recliner mechanism 200. The back support assembly 104 may further include a first top post 156 and a second top post 158 configured to engage the first and second posts 152, 154, respectively, to extend the height of the first and second posts 152, 154. In some preferred embodiments, the first and second top posts 156, 158 may directly engage the first post 152 and second post 154. In other preferred embodiments, the first post 152 and second post 154 may be connected to the first top post 156 and second top post 158 by being positioned above the first and second posts 152, 154, respectively, within the back rest cushion 140, the cushion bar backing 145, or the head rest backing 143.

In some preferred embodiments, the back rest cushion 140 is formed of a single piece cushion which may directly engage the first post 152 and/or second post 154. In other preferred embodiments, the back rest cushion 140 may be formed of both a head rest cushion 142 and a cushion bar 144. Those of ordinary skill in the art may appreciate from this disclosure that the back rest cushion 140 may be formed of any number of cushions without exceeding the scope of this disclosure. The head rest cushion 142 may include a head rest backing 143 on its rear side, a configuration of tubes which may be slid over the first and second top posts 156, 158 to connect thereto. The cushion bar 144 may include on its rear side a cushion bar backing 145, a configuration of tubes which may be slid over the first and second top posts 156, 158 and/or the first and second posts 152, 154. The head rest backing 143 and cushion bar backing 144 may be connected to the head rest cushion 142 and cushion bar 144, respectively, via a plurality of fasteners 275, such as screws or rivets. Locking pins 166 contained within the first post 152, second post 154, first top post 156, and/or second top post 158 may be used to lock the head rest backing 143 and the cushion bar backing 145 at desired locations on the posts.

In some other preferred embodiments, the location of the cushion bar 144 on the first and second posts 152, 154 and/or first and second upper posts 156, 158 may be adjustable. In such embodiments, it is preferred that the distance between the cushion bar 144 and the head rest cushion 142 is adjustable. In other words, the back support assembly 104 may be adjustable to vary a cushion bar distance between the head rest cushion 142 and the cushion bar 144.

Referring to FIGS. 6 and 32-34, the back rest assembly 104 may also include a first arm rest 146 that is detachably positionable on the first post 152 or first top post 156 when the chair 100 is in the second, use configuration, and a second arm rest 148 that is detachably positionable on the second post 154 or second top post 158 when the chair 100 is in the first, use configuration. When the chair 100 is in the first, storage configuration, the first arm rest 146 and second arm rest 148 may be detached from any of the posts 152, 154, 156, 158 and stored within the bottom cavity 120. Thus, the first and second arm rests 146, 148 are each separately detachably positionable in each of two locations—within the bottom cavity 120 of the seat frame 102, and outside of the seat frame 102 and attached to the back support assembly 104.

The first and second arm rests 146, 148 may each include an arm bar and an arm rest cushion. The arm rest cushions are preferably configured to connect to each arm bar, either by connecting to the top of the arm bar or by sliding over the arm bar. Preferably, such configurations may position the arm rest cushions between a user's arm and the hard arm bar. In some preferred embodiments, the position of the arm rest cushions on or along the arm bars may be adjustable, to change a first arm rest length and/or a second arm rest length (relative to whichever of the posts 152, 154, 156, 158 that the arm rest 246, 248 is connected to) to increase the comfort of a user sitting on the seat. Those of ordinary skill in the art will appreciate from this disclosure that the first arm rest 146 and second arm rest 148 may each be formed of a single member, or may include various configurations of cushions and/or solid members, without exceeding the scope of this disclosure.

The first arm rest 146 may be connected to a first pivoting bracket 147 via pivot socket. The first pivoting bracket 147 is preferably configured to connect to the first post 152 and/or first top post 156 while allowing the first arm rest 146 to pivot upward and downward. In some preferred embodiments, the arm bar of the first arm rest 146 may be directly connected to the first pivoting bracket 147. The first pivoting bracket 147 may include a wrapping segment, which allows it to securely squeeze the first post 152 or first top post 156, and a bracket lock, to detachably hold the first arm rest 146 in place. Similarly, the second arm rest 148 may be connected to a second pivoting bracket 149 via a pivot socket. The second pivoting bracket 149 is preferably configured to connect to the second post 154 and/or second top post 158 while allowing the second arm rest 148 to pivot upward and downward. In some preferred embodiments, the arm bar of the second arm rest 148 may be connected directly to the second pivoting bracket 149. The second pivoting bracket 149 may include a wrapping segment, which allows it to securely squeeze the second post 154 or second top post 158, and a bracket lock, to detachably hold the second arm rest 148 in place. Those of ordinary skill in the art will appreciate from this disclosure that the first arm rest 146 and first pivoting bracket 147 may be provided in a mirror image configuration to the second arm rest 148 and second pivoting bracket 149. Alternatively, the first arm rest 146 and second arm rest 148 may be identical, interchangeable pieces, capable of connecting to, and use when connected to, the first post 152, the second post 154, the first top post 156, and/or the second top post 158, provided that the arm rest cushion can be positioned to face upward on either the left or right side of the first or second pivoting bracket 147, 149.

Referring to FIGS. 7-13, some preferred embodiments of the seat frame 102 define an upper well 122 on the opposite side of the bottom cavity 120 and which opens in the opposite direction from the bottom cavity 120. Thus, when the chair 100 is in the second, use configuration, the bottom cavity 120 opens generally downward and the upper well 122 opens upward. When the chair 100 is in the first, storage configuration, the bottom cavity 120 preferably opens to the rear, and the upper well 122 preferably opens to the front. The upper well 122 is preferably positioned closer to an imagined two dimensional geometric center of the seat frame 102 than the cushion support surface 108 such that the cushion support surface 108 preferably forms a perimeter of the upper well 122 and is positioned between the upper well 122 and the outside of the seat frame 102. When the chair 100 is in the second, use configuration, the upper well 122 preferably defines a face that is closer to the support surface 190 than a face a formed by the cushion support surface 108. This is to ensure that there is a space between the upper well 122 and a seat cushion 110 positioned on the cushion support surface 108. The seat frame may further include a platform 123 roughly positioned closer to an imagined two dimensional geometric center of the seat frame 102 than the rest of the upper well 122 and which forms a face that would be positioned between the bottom of the upper well 122 and the cushion support surface 108 when the chair 100 is in the second, use position. The upper well 122, therefore, appears as a depression in the top of the seat frame 102, the top of which forms the cushion support surface 108 for a cushion 100 to be placed on. The platform 123 is roughly positioned in the middle of the upper well 122, with the outer edges of the upper well 122 essentially forming a U-shaped channel about the perimeter of the platform 123. This configuration may allow the foot support frame 106 to be stored within the upper well 122 when in the first, foot support storage position. The first foot support beam 162, the second foot support beam 164, the joining foot beam 165, and foot rest sleeve 161 are all preferably configured to fit within the channel of the upper well 122, and the foot rest 160 on the platform 123, when the foot support frame 106 is in the first, foot rest storage position, such as when the chair 100 is in the first, storage configuration. At the front of the prongs of the U-shaped channel, a first hinge 176 and a second hinge 186 are preferably positioned to connect the foot support frame 106 to the seat frame 102 to allow the foot support frame 106 to pivot about the first and second hinges 176, 186 such that the foot support frame 106 may be positioned within the upper well 122. When the seat cushion 110 is positioned on the cushion support surface 108, the seat cushion 110 preferably fully encloses the upper well 122, and may enclose all portions of the foot support frame 106 contained within the upper well 122. The platform 123 is preferably configured to allow the foot rest to be positioned at an elevated position within the upper well 122 to decrease the weight placed on the foot rest 160 by a user sitting on the chair 100.

The foot support frame 106 is preferably pivotally connected to the seat frame 102 to allow the foot support frame 106 to be transitioned between a first, foot support storage position, in which the foot support frame 106 is located within the upper well 122, and a second, foot support use position, in which the foot support frame 106 extends from the seat frame 102 past the front panel 130 and is configured for use. When the foot support frame 106 is used, a user preferably places one or more of his or her feet and/or legs on the foot support frame 106 to elevate them from the support surface 190. Preferably, the foot support frame 106 is in the first, foot support storage position when the seat 100 is in the first, storage position. However, when the chair 100 is in the second, use position, the foot support frame 106 may be in either of the first, foot support storage position or the second, foot support use position.

The foot support frame 106 is preferably formed by at least one foot support beam 162 and a foot rest 160 connected thereto configured to hold a user's feet in an elevated position relative to the support surface 190. Preferably, the foot rest is therefore roughly flat and sufficiently wide so as to support both of a user's feet. It may further be preferably for the foot rest 160 to be somewhat flexible and/or soft, to increase a user's comfort.

In a preferred embodiment, the foot support frame is formed of a first foot support beam 162 and second support beam 164, each pivotally connected on one axial end thereof to the first and second hinges 176, 186, respectively. In some preferred embodiments, a fabric foot rest 160 may be positioned between the first and second foot support beams 162, 164 by sliding a portion of the foot rest 160, the foot rest sleeve 161, over the first foot support beam 162 and/or the second foot support beam 164. In other preferred embodiments, the axial ends of the first and second foot support beams 162, 164 (opposite the axial ends connected to the first and second hinges 176, 186) may be inserted into a U-shaped joining foot beam 165. The joining foot beam 165 preferably holds the foot rest 160 between the bends of the U-shape. A foot rest sleeve 161 may be slid over the ends of the U-shape to hold the foot rest 160 therebetween. The joining foot beam 165 may be slid to preferred positions along the first and second foot support beams 162, 164 to vary a distance of the foot rest 160 from the seat frame 102 when the foot support frame 106 is in the second, foot support use position.

The foot rest 160 and the foot rest sleeve 161 are preferably formed of a fabric material, with the foot rest sleeve 161 being a portion of the foot rest 160 formed into a tight cylindrical shape configured to fit over the joining foot beam 165. The fabric material is meant to be somewhat flexible and durable, to resist wear and tear but to provide comfort to a user. Preferably, a synthetic material may be provided, including woven polyester, vinyl, or the like. However, those of ordinary skill in the art will appreciate from this disclosure that any suitable material may be used without exceeding the scope of this disclosure.

In some preferred embodiments, the hinged connections connecting the first and second foot support beams 162, 164 to the seat frame 102 may be formed of the first and second hinges 176, 186 passing through the seat frame 102 and the first or second foot support beams respectively. However, in other preferred embodiments, the hinged connections include additional supportive elements. Specifically, on one lateral side of the front panel 128, the chair pan 170 may form a first channel layer 172, with a first hinge insert 174 positioned thereon. The first hinge 176 may pass through the first channel layer 172, first foot support beam 162, and first hinge insert 174 to create a hinged connection that allows the first foot support beam 162 to rotate upward and downward. The polymer layer 180 may be positioned over the chair pan 170 with the hinged connection being positioned within the first hinge opening 168 such that the first polymer shoulder 169 may hold the hinge insert 174 in place and not allow it to be displaced upward. A similar configuration is preferably provided on the opposite lateral side of the front panel 128, where the chair pan 170 may form a second channel layer 182, with a second hinge inert 184 positioned thereon. A second hinge 186 may pass through the second channel layer 182, the second foot support beam 164, and second hinge insert 184 to create a second hinged connection allowing the second foot support beam 164 to rotate upward and downward. When the polymer layer 180 is positioned over the chair pan 170, the second hinged connection may be positioned within the second hinge opening 188 such that the second polymer shoulder 189 may hold the second hinge insert 184 in place and not allow it to be displaced upward. A plurality of welds 178 may be included to further retain the various elements of the hinged connections in place. The first hinge 176 preferably passes through (running right to left) the chair pan 170, the first channel layer 172, the first hinge insert 174, the first foot support beam 162, the first hinge insert 174 again, the first channel layer 172 again, and lastly passing again through the chair pan 170. The first polymer shoulder 169 is shown to overlap the first hinge insert 174 and preferably runs the entire perimeter of the first hinge opening 168. Each lateral end of the first hinge 176 may be positioned within the bottom cavity 120. The second hinge 186 preferably passes through (running right to left) the chair pan 170, the second channel layer 182, the second hinge insert 184, the second foot support beam 164, the second hinge insert 184 again, the second channel layer 182 again, and lastly passing again through the chair pan 170. The second polymer shoulder 179 is shown to overlap the second hinge insert 184 and preferably runs the entire perimeter of the second hinge opening 178. Each lateral end of the second hinge 186 may be positioned within the bottom cavity 120. Those of ordinary skill in the art will appreciate from this disclosure that any of these additional reinforcement elements may be provided or omitted without exceeding the scope of this disclosure.

A preferred embodiment of the present invention operates as follows. A user may first provide a chair 100 in the first, storage configuration, with the back rest frame 150 contained within the bottom cavity 120, the back rest cushion 140 covering the bottom cavity 120, and the foot support frame 106 in the upper well 122 and under the seat cushion 110 connected to the cushion support surface 108 of the seat frame 102. The straps, or other connecting elements, may extend from the seat frame 102 to retain the back rest cushion 140 in place over the bottom cavity 120. To transition the chair 100 into second, use configuration, the user preferably removes the back rest cushion 140 from the bottom cavity 120 (by disconnecting the straps), and subsequently moves the additional elements retained therein by the back rest cushion 140 to the support surface 190. These elements include: the first front leg 112, the second front leg 114, the first rear leg 116, the second rear leg 118, the first post 152, the second post 154, the first top post 156, the second top post 158, the first arm rest 146, and second arm rest 148. The user may then insert the first front leg 112 into the first front leg receptacle 132 and the second front leg 114 into the second front leg receptacle 134. The user preferably next inserts the first rear leg 116 through the rear panel 130 and into the first rear leg receptacle 136 and gently rotates the first rear leg 116 until the first key element 137 enters and fully engages the first rear guide slot 117, and inserts the second rear leg 118 through the rear panel 130 and into the second rear leg receptacle 138 and gently rotates the second rear leg 118 until the second key element 139 enters and fully engages the second rear guide slot 119. This allows the user to the stand the seat frame 102 on the legs 112, 114, 116, 118 such that said legs 112, 114, 116, 118 are positioned on the support surface 190 and the seat frame 102 is elevated from and no longer in contact with the support surface 190.

The user preferably then assembles the back support assembly 104 using the following steps. First, the user preferably inserts the first post 152 into the first post receptacle 212 and the second post 154 into the second post receptacle 214. In some preferred embodiments, the user may rotate the first post 152 and second post 154 until locking pins 166 engage slots in the first post receptacle 212 and second post receptacle 214, respectively, locking the first post 152 and second post 154 into place. The user may then slide the cushion bar backing 145 over the first and second posts 152, 154 until a locking pin 166 may lock the cushion bar 144 in place. The user may then slide the first top post 156 over a portion of the first post 152 and/or into a portion of the cushion bar backing 144, with a locking pin 166 locking the first top post 152 in place. The user may next slide the second top post 158 over a portion of the second post 154 and/or into a portion of the cushion bar backing 144, with a locking pin 166 locking the second top post 154 in place. The user may then slide the head rest cushion 140 into place by sliding the first top post 156 and second top post 158 into the head rest backing 143. Locking pins 166 in the first and second top posts 156, 158 may engage slots in the head rest backing 143, securing the head rest 142 in place. The user may then connect the first arm rest 146 to the back support assembly 106 by connecting the first pivoting bracket 147 to either of the first post 152 or first top post 156. The user may then complete the assembly of the back support assembly 106 by connecting the second arm rest 148 to the back support assembly 106 by connecting the second pivoting bracket 149 to either of the second post 154 or second top post 158.

The back support assembly 104 is preferably assembled in the fully upright position, as the recliner mechanism 200 is preferably configured to hold the back support assembly 104 in the fully upright when the chair 100 is in the first, storage configuration. When the chair 100 is in the second, use configuration the back support assembly 106 may be reclined and raised by turning the knob 244 on the first axial end 242 of a threaded rod 240. Preferably, by turning the threaded rod 240 in a counterclockwise direction, the threaded rod 240 is pulled outward from the rotation guide 250 such that the positions of the rotation guide 250 and rear panel 130 on the threaded rod 240 is changed, moving closer toward the second axial end 246. As the position changes, the threaded rod 240 angles downward relative to the seat support surface 108 such that the knob 244 moves closer to the support surface 190 as the back support assembly 106 is reclined. The user may turn the knob 244 counterclockwise until the beveled edge 234 of the guard 232 abuts the rear panel 130 and/or a portion of the rotation guide 250 abuts the reinforcement plate 208, indicating that the back support assembly 104 has been fully reclined.

When the chair 100 is in the second, use configuration the foot support frame 106 may be transitioned into a second, foot support use configuration. To transition the foot support frame 106 into the second, foot support use configuration, the user preferably first removes the seat cushion 110 from the cushion support surface 108, exposing the upper well 122 with the foot support frame 106 positioned therein. The user may then grasp the foot support frame 106 and rotate it upward and outward about the first and second hinge 176, 186. The user may then slide the joining foot beam 165 along the first and second foot support beams 162 and 164 until the foot rest 160 is in the desired position, at a preferred distance from the front panel 128 of the seat frame 102. The seat cushion 110 may then be returned to its position on the cushion support structure 108, covering the upper well 122.

The user may use the chair 100 when it is in the second, use configuration by placing his or her posterior onto the seat cushion 110. The user may then rest his or her back on the cushion bar 144 and his or her head on the head rest cushion 142. The user may place his or her right arm onto the first arm rest 146 and his or her left arm on the second arm rest 148. Finally, the user may also place his or her feet onto the foot rest 140, thus the user is fully positioned on the chair 100 and elevated from the support surfaced 190.

To transition the chair 100 from the second, use configuration back into the first, storage configuration, the user preferably operates the invention as follows. Preferably, the user, having fully removed himself or herself from the chair 100, first removes the seat cushion 110 from the cushion support surface 108. The user may then slide the joining foot beam 165 on the first and second foot beams 162, 164 toward the seat frame 102 as far as possible. The user may then rotate the foot support frame 106 about the first and second hinges 176, 186 upward and toward the seat frame 102 until the foot support frame 106 is positioned in the upper well 122 with the foot rest 160 on the platform 123. The user may next place the seat cushion 110 back on the cushion support frame 108 and connect it thereto. Preferably the user next turns knob 244 clockwise until the back rest assembly 104 is in the fully upright position. The user then may remove, and set aside on the support surface 190, the head rest cushion 142 from the first and second top posts 156, 158, the first and second top posts 156, 158 from the first and second posts 152, 154, the cushion bar 144 from the first and second posts 152, 154, and the first and second posts 152, 154 from the first and second post receptacles 212, 214, respectively. In some preferred embodiment, the user may need to depress any and all locking pins 166 in these elements prior to removal to allow them to be removed. Preferably, the seat frame 102 is then lifted and turned such that the rear panel 130 is positioned against the support surface 190 and the front panel 128 is positioned farthest from the support surface 190. The user may then remove the first front leg 112 from the first front leg receptacle 132, the second front leg 114 from the second front leg receptacle 134, the first rear leg 116 from the first rear leg receptacle 136, and the second rear leg 118 from the second rear leg receptacle 138. The removed elements are then preferably inserted into the bottom cavity 120 such that they rest on the inner surface 202 of the rear panel 130 and/or on the reinforcement place 208. Moving from proximity to the first side panel 124 to proximity to the second side panel 126, the user preferably first inserts into the bottom cavity 120 the first arm rest 146, then the first rear leg 116, then the second rear leg 118, then the first post 152, then the second post 154, then the first front leg 112, then the second front leg 114, then the first top post 156, then the second top post 158, and finally the second arm rest 148 positioned closest to the second side panel 126. The user may then position the back rest cushion 140, which may include the cushion bar 144 and headrest cushion 142, over the bottom cavity 120 to retain the elements contained therein in place. Preferably, straps or snap may be fastened by the user to secure the back rest cushion 140 in place. Finally, the user may then lift the chair 100 by the handle 129 on the front panel 128 to easily transport the chair 100.

In an alternative preferred embodiment of the present invention, the present invention operates as follows. A user may first provide a chair 100 in the first, storage configuration, with the back support assembly 104 contained within the bottom cavity 120. Straps or other suitable connecting elements may extend from the seat frame 102 to retain the back rest cushion 140 over the bottom cavity 120. To transition the chair 100 into second, use configuration, the user preferably removes the back rest cushion 140 from the bottom cavity 120, and subsequently moves the additional elements retained therein by the back rest cushion 140. These elements include: the first front leg 112, the second front leg 114, the first rear leg 116, the second rear leg 118, the first post 152, and the second post 154. The user then preferably inserts the first front leg 112 into the first front leg receptacle 132 and the second front leg 114 into the second front leg receptacle 134. The user preferably next inserts the first rear leg 116 into the first rear leg receptacle 136 and inserts the second rear leg 118 into the second rear leg receptacle 138. The user may then stand the seat frame 102 on the legs 112, 114, 116, 118 such that said legs are positioned on the support surface 190 and the seat frame 102 is elevated from and no longer in contact with the support surface 190. The user preferably then inserts the first post 152 into the first post receptacle 212 and the second post 154 into the second post receptacle 214. The user may then connect the back rest cushion 140 to the first post 152 and second post 154 by lowering the back rest cushion 140 over the top of each post 152, 154. The back support assembly 104 is preferably initially positioned in the fully upright position, as the recliner mechanism 200 is preferably configured to hold the back support assembly 104 in the fully upright position when the chair 100 is in the first, storage configuration. When the chair 100 is in the second, use configuration the back support assembly 106 may be reclined and raised by turning the knob 244 on the first axial end 242 of a threaded rod 240. Preferably, by turning the threaded rod 240 in a counterclockwise direction, the threaded rod 240 is pulled outward such that the positions of the rotation guide 250 and rear panel 130 on the threaded rod 240 is changed, moving closer toward the second axial end 246. As the position changes, the threaded rod 240 turns at an angle relative to the seat support surface 108 such that the knob 244 moves closer to the support surface 190 as the back support assembly 106 is reclined. The user may use the chair 100 when it is in the second, use configuration by placing his or her posterior onto the seat cushion 110 and rest his or her back on the back rest cushion 140.

To transition the chair 100 from the second, use configuration back into the first, storage configuration, the user preferably operates the invention as follows. Preferably, the user, having fully removed himself or herself from the chair 100, turns the knob 244 clockwise until the back rest assembly 104 is in the fully upright position. The user then may remove, and set aside on the support surface 190, the back rest cushion 140 from the first and second posts 152, 154 and the first and second posts 152, 154 from the first and second post receptacles 212, 214, respectively. Next, the user preferably turns the seat frame 102 such that the rear panel 130 is positioned against the support surface 190 and the front panel 128 is positioned farthest from the support surface 190. The user may then remove the first front leg 112 from the first front leg receptacle 132, the second front leg 114 from the second front leg receptacle 134, the first rear leg 116 from the first rear leg receptacle 136, and the second rear leg 118 from the second rear leg receptacle 138. The may be placed on the support surface 190. The removed elements are then preferably inserted into the bottom cavity 120 such that they rest on the inner surface 202 of the rear panel 130 and/or on the reinforcement place 208. The user may then position the back rest cushion 140 over the bottom cavity 120 to retain the elements contained therein in place. Preferably, straps or snap may be fastened by the user to secure the back rest cushion 140 in place. Finally, the user may lift the chair 100 by the handle 129 on the front panel 128 to easily transport the chair 100.

It is recognized by those skilled in the art that changes may be made to the above described methods and structures without departing from the broad inventive concept thereof. It is understood, therefore, that this invention is not limited to the particular embodiments disclosed, but is intended to cover all modifications which are within the spirit and scope of the invention as defined by the above specification, the appended claims and/or shown in the attached drawings.

What is claimed is:

1. A chair, comprising:

a seat frame defining a bottom cavity, comprising:

a rear panel, a front panel, and a cushion support surface defining an upper well, the bottom cavity and the upper well each opening in an opposite direction;

a back support assembly comprising a back rest frame and a back rest cushion;

the back support assembly is separately detachably positionable in each of the following two locations: (1) at least partially within the bottom cavity of the seat frame; and (2) outside of the seat frame with the back support assembly connected to the seat frame;

a foot support frame that is pivotally connected to the seat frame for movement between a first, foot support storage position, in which the foot support frame is located within the upper well, and a second, foot support use position, in which the foot support frame extends from the seat frame past the front panel and is configured for use; and wherein the chair is moveable between a first, storage configuration and a second, use configuration, the back support being at least partially within the bottom cavity while in the first storage configuration such that the chair can be stored on a support surface with the rear panel facing the support surface, the back support assembly being connected to the seat frame while the chair is in the second, use configuration.

2. The chair of claim 1, further comprising a seat cushion detachably positionable on the cushion support surface, the seat cushion covering the foot support frame and the upper well when the foot support frame is located in the upper well and the seat cushion is located on the cushion support surface.

3. The chair of claim 2, wherein a first front leg, a second front leg, a first rear leg, and a second rear leg are each separately detachably positionable in each of the following two locations: (1) within the bottom cavity of the seat frame; and (2) outside of the seat frame and attached thereto and configured to support the seat frame on the support surface, the first front leg, the second front leg, the first rear leg, and the second rear leg being stored within the bottom cavity while the chair is in the first storage configuration, the first front leg, the second front leg, the first rear leg, and the second rear leg being connected to the seat frame while the chair is in the second, use configuration.

4. The chair of claim 3, further comprising a first arm rest and a second arm rest each separately detachably positionable in each of the following two locations: (1) within the bottom cavity of the seat frame; and (2) outside of the seat frame and attached to the seat frame, the first arm rest and the second arm rest being stored within the bottom cavity while the chair is in the first storage configuration, the first arm rest and the second arm rest being connected to the back rest frame while the chair is in the second, use configuration.

5. The chair of claim 4, wherein the seat frame further comprises a first side panel and a second side panel, when the chair is in the first, storage configuration, the chair occupies a generally rectilinear volume defined on four sides by the rear panel, the front panel, the first side panel, the second side, the generally rectilinear volume having two major surfaces generally defined by the seat cushion and the back rest cushion.

6. The chair of claim 4, wherein when the chair is in the first, storage position, the chair locates the seat cushion along a first major surface and the back support cushion along a second major surface.

7. The chair of claim 4, wherein the chair defines a first footprint when the chair is in the first, storage configuration and positioned on the support surface;

wherein the chair defines a second footprint when the chair is the second, use configuration such it is positioned on the support surface, with the foot support frame in the second, foot support use position and the back support assembly angled at approximately thirty-five degrees from a vertical axis which is perpendicular to the supporting surface;

and wherein the second footprint is at least five times greater than the first footprint.

8. The chair of claim 7, wherein the chair is configured such that the seat cushion is positioned along an angle relative to the support surface when the chair is in the second, use configuration.

9. The chair of claim 4, wherein the chair defines a first footprint when the chair is in the first, storage configuration and positioned on the support surface;

wherein the chair defines a second footprint when the chair is the second, use configuration such it is positioned on the support surface, with the foot support frame in the second, foot support use position and the back support assembly angled at approximately thirty-five degrees from a vertical axis which is perpendicular to the supporting surface;

and wherein the second footprint is at least six times greater than the first footprint.

10. The chair of claim 9, wherein the chair is configured such that the seat cushion is positioned along an angle relative to the support surface when the chair is in the second, use configuration.

11. The chair of claim 10, wherein the first rear leg and the second rear leg extend in a curvilinear fashion such that each extends through the rear panel to connect to a first rear leg receptacle and a second rear leg receptacle, respectively.

12. The chair of claim 11, wherein the first rear leg receptacle and the second rear leg receptacle each include a key element to prevent rotation of the first rear leg and the second rear leg therein, respectively.

13. The chair of claim 12, wherein the first arm rest and the second arm rest are each configured to mount to the back rest frame via a pivoting bracket allowing for angular adjustment thereof, the first arm rest and the second arm rest each being extendable to vary an arm rest length thereof.

14. The chair of claim 13, wherein the foot support frame comprises a foot support beam and a foot rest, the foot support frame being configured such that when the foot support frame is in the second, foot support use position the foot support frame is extendable to vary a distance of the foot rest from the seat frame.

15. The chair of claim 14, wherein the back rest cushion comprises a head rest cushion and a cushion bar, the back support assembly being adjustable to vary a head support distance between the head rest cushion and the seat frame.

16. The chair of claim 15, wherein the back support assembly is adjustable to vary a cushion bar distance between the head rest cushion and the cushion bar.

17. The chair of claim 16, wherein the seat frame further comprises at least one channel layer positioned between the upper well and the front panel;

wherein except for the at least one channel the seat frame is comprised of a chair pan formed of a metallic material and a polymer layer formed of a polymer material;

wherein the at least one channel layer is not formed of the polymer layer;

and wherein the polymer layer defines at least one hinge opening about the at least one channel layer.

18. The chair of claim 17, wherein the at least one channel layer comprises a first channel layer and a second channel layer;

wherein the at least one hinge opening comprises a first hinge opening about the first channel layer and a second hinge opening about the second channel layer;

wherein a first hinge insert adjacently abuts the first channel layer thereon with the first hinge insert being configured to receive a portion of the foot support frame therein;

wherein a second hinge insert adjacently abuts the second channel layer thereon with the second hinge insert being configured to receive a portion of the foot support frame therein;

wherein the first hinge opening defines a first shoulder over a portion of the first hinge insert, wherein the second hinge opening defines a second shoulder over a portion of the second hinge insert;

wherein a first hinge extends through the foot support frame, the first hinge insert, and the chair pan to form a first hinged connection;

and wherein a second hinge extends through the foot support frame, the second hinge insert, and the chair pan to form a second hinged connection.

* * * * *